US008596024B2

(12) United States Patent
Trpkovski

(10) Patent No.: US 8,596,024 B2
(45) Date of Patent: Dec. 3, 2013

(54) SEALED UNIT AND SPACER

(75) Inventor: Paul Trpkovski, Buffalo, WY (US)

(73) Assignee: Infinite Edge Technologies, LLC, White Bear Lake, MN (US)

( * ) Notice: Subject to any disclaimer, the term of this patent is extended or adjusted under 35 U.S.C. 154(b) by 205 days.

(21) Appl. No.: 12/270,215

(22) Filed: Nov. 13, 2008

(65) Prior Publication Data

US 2009/0120035 A1 May 14, 2009

Related U.S. Application Data

(60) Provisional application No. 60/987,681, filed on Nov. 13, 2007, provisional application No. 61/049,593, filed on May 1, 2008, provisional application No. 61/049,599, filed on May 1, 2008, provisional application No. 61/038,803, filed on Mar. 24, 2008.

(51) Int. Cl.

| | |
|---|---|
| ***E04C 2/54*** | (2006.01) |
| ***E06B 7/00*** | (2006.01) |
| ***E06B 7/12*** | (2006.01) |
| ***E06B 3/00*** | (2006.01) |

(52) U.S. Cl.

USPC ..... 52/786.13; 52/786.1; 52/786.11; 52/204.593; 52/204.595; 52/172; 428/34

(58) Field of Classification Search

USPC ..... 52/786.1, 786.11, 786.13, 204.593, 52/204.595, 172; 428/34

See application file for complete search history.

(56) References Cited

U.S. PATENT DOCUMENTS

| | | | |
|---|---|---|---|
| 32,436 | A | 5/1861 | Scofield |
| 367,236 | A | 7/1887 | Eeinhaedt |
| 423,704 | A | 3/1890 | Simpson |
| 1,310,206 | A | 7/1919 | Mowat |
| 1,425,207 | A | 8/1922 | Milner |
| 2,235,680 | A | 3/1941 | Haven et al. |
| 2,275,812 | A | 3/1942 | Woelfel |

(Continued)

FOREIGN PATENT DOCUMENTS

| | | |
|---|---|---|
| AT | 379 860 | 3/1986 |
| CA | 1260624 | 12/1986 |

(Continued)

OTHER PUBLICATIONS

PCT/US2008/083428, International Search Report and Written Opinion mailed Jan. 22, 2009 corresponding with U.S. Appl. No. 12/270,215.

(Continued)

*Primary Examiner* — Brian Glessner
*Assistant Examiner* — Omar Hijaz
(74) *Attorney, Agent, or Firm* — Pauly, DeVries Smith & Deffner, LLC

(57) ABSTRACT

A sealed unit includes at least two sheets of transparent or translucent material separated from each other by a spacer. One example of a spacer for a sealed unit includes a first elongate strip, a second elongate strip, and filler arranged therebetween. The first and second elongate strips have a small undulating shape in some embodiments. Methods of making spacers and window assemblies as well as devices for use in the manufacture of spacers and assemblies are disclosed including a manufacturing jig and a spool storage rack. The spool storage rack stores a plurality of spools configured to store spacer materials thereon.

21 Claims, 44 Drawing Sheets

(56) References Cited

U.S. PATENT DOCUMENTS 2,597,097 A * 5/1952 Haven ..... 52/172
2,618,819 A 11/1952 Goodwillie
2,708,774 A 5/1955 Seelen
2,885,746 A 5/1956 Güra
2,833,031 A 5/1958 Flumerfelt
2,838,810 A 6/1958 Englehart et al.
3,027,608 A 4/1962 Ryan
3,045,297 A * 7/1962 Ljungdahl ..... 428/34
3,143,009 A 8/1964 Pfeiffer
3,280,523 A 10/1966 Stroud et al.
3,288,667 A 11/1966 Martin
3,367,161 A 2/1968 Avakian
3,645,121 A 2/1972 Pfeiffer et al.
3,756,060 A 9/1973 Bindernagel
3,758,996 A 9/1973 Bowser
3,796,080 A 3/1974 Munchbach
3,839,137 A 10/1974 Davis et al.
3,921,359 A 11/1975 Brichard et al.
3,935,893 A 2/1976 Stang et al.
3,956,998 A 5/1976 Bavetz
3,971,243 A 7/1976 Jones
3,974,011 A 8/1976 Jarchow et al.
3,981,111 A 9/1976 Berthagen
4,002,048 A 1/1977 Pozsgay
4,027,517 A 6/1977 Bodnar
4,057,944 A 11/1977 Wyatt, Jr. et al.
4,057,945 A 11/1977 Kessler
4,074,480 A 2/1978 Burton
4,080,482 A 3/1978 Lacombe
4,098,722 A 7/1978 Cairns et al.
4,113,799 A 9/1978 Van Ornum et al.
4,113,904 A 9/1978 Kiefer
4,113,905 A 9/1978 Kessler
4,114,342 A 9/1978 Okawa
4,145,237 A 3/1979 Mercier et al.
4,222,213 A * 9/1980 Kessler ..... 52/786.13
4,226,063 A * 10/1980 Chenel ..... 52/172
4,233,833 A 11/1980 Balinski
4,241,146 A 12/1980 Sivachenko et al.
4,244,203 A 1/1981 Pryor et al.
4,382,375 A 5/1983 Yamamoto et al.
4,400,338 A 8/1983 Rundo
4,406,726 A 9/1983 Lisec
4,408,474 A 10/1983 Hutzenlaub et al.
4,431,691 A 2/1984 Greenlee
4,434,024 A 2/1984 Lisec
4,494,283 A 1/1985 Lisec
4,495,023 A 1/1985 Lisec
4,499,703 A 2/1985 Rundo
4,536,424 A * 8/1985 Laurent ..... 428/34
4,551,364 A 11/1985 Davies
4,561,929 A 12/1985 Lenhardt
4,567,710 A 2/1986 Reed
4,576,841 A 3/1986 Lingemann
4,580,428 A 4/1986 Brettbacher et al.
4,654,057 A 3/1987 Rhodes
4,658,553 A 4/1987 Shinagawa
4,711,692 A 12/1987 Lisec
4,716,686 A 1/1988 Lisec
4,719,728 A 1/1988 Eriksson et al.
4,720,950 A 1/1988 Bayer et al.
4,726,875 A 2/1988 Lenhardt
4,743,336 A 5/1988 White
4,753,096 A 6/1988 Wallis
4,762,743 A 8/1988 von Alven et al.
4,769,105 A 9/1988 Lisec
4,780,164 A 10/1988 Rueckheim et al.
4,791,773 A 12/1988 Taylor
4,803,775 A 2/1989 Lisec
4,808,452 A 2/1989 McShane
4,815,245 A 3/1989 Gartner
4,831,799 A 5/1989 Glover et al.
4,835,130 A 5/1989 Box
4,835,926 A 6/1989 King
4,836,005 A 6/1989 Lisec
4,850,175 A 7/1989 Berdan
4,854,022 A 8/1989 Lisec
4,862,666 A 9/1989 Kero
4,866,967 A 9/1989 Sporenberg et al.
4,881,355 A 11/1989 Bosl et al.
4,885,926 A 12/1989 Lisec
4,886,095 A 12/1989 Lisec
4,886,410 A 12/1989 Lisec
4,902,213 A 2/1990 Lisec
4,921,022 A 5/1990 Lisec
4,929,814 A 5/1990 Lisec
4,949,666 A 8/1990 Lisec
4,961,816 A 10/1990 Lisec
4,972,938 A 11/1990 Lisec
4,973,426 A 11/1990 Ohno et al.
5,052,164 A 10/1991 Sandow
5,079,054 A 1/1992 Davies
5,080,146 A 1/1992 Arasteh
5,087,489 A 2/1992 Lingemann
5,088,258 A 2/1992 Schield et al.
5,113,678 A 5/1992 Mannaka et al.
5,120,584 A * 6/1992 Ohlenforst et al. ..... 428/34
5,167,756 A 12/1992 Lenhardt
5,182,931 A 2/1993 Noe et al.
5,209,034 A 5/1993 Box et al.
5,254,377 A 10/1993 Lingemann
5,280,832 A 1/1994 Lisec
5,290,611 A 3/1994 Taylor
5,295,292 A 3/1994 Leopold
5,302,425 A 4/1994 Taylor
5,308,662 A * 5/1994 Woodard et al. ..... 428/34
5,313,762 A 5/1994 Guillemet
5,361,476 A 11/1994 Leopold
5,377,473 A 1/1995 Narayan
5,390,406 A 2/1995 Lisec
5,391,416 A 2/1995 Kunert
5,394,671 A 3/1995 Taylor
5,394,725 A 3/1995 Lisec
5,413,156 A 5/1995 Lisec
5,439,716 A 8/1995 Larsen
5,441,779 A 8/1995 Lafond
5,443,871 A 8/1995 Lafond
5,461,840 A 10/1995 Taylor
5,485,709 A 1/1996 Guillemet
5,512,341 A 4/1996 Newby et al.
5,514,428 A 5/1996 Kunert
5,531,047 A 7/1996 Leopold et al.
5,553,440 A 9/1996 Bulger et al.
5,564,631 A 10/1996 Leopold
5,567,258 A 10/1996 Lee et al.
5,568,714 A 10/1996 Peterson
5,573,618 A 11/1996 Rueckheim
5,581,971 A 12/1996 Peterson
5,601,677 A 2/1997 Leopold
5,617,699 A 4/1997 Thompson
5,626,712 A 5/1997 Lisec
5,630,306 A * 5/1997 Wylie ..... 52/786.13
5,644,894 A 7/1997 Hudson
5,655,282 A 8/1997 Hodek et al.
5,658,645 A 8/1997 Lafond
5,675,944 A 10/1997 Kerr et al.
5,679,419 A 10/1997 Larsen
5,705,010 A 1/1998 Larsen
5,714,214 A 2/1998 Larsen
5,759,665 A 6/1998 Lafond
5,773,135 A 6/1998 Lafond
5,775,393 A 7/1998 Kovacik
5,813,191 A 9/1998 Gallagher
5,851,609 A 12/1998 Baratuci et al.
5,855,132 A 1/1999 Cozzi
5,873,256 A 2/1999 Denniston
5,879,764 A 3/1999 Chu et al.
5,890,289 A 4/1999 Guillemet
5,980,666 A 11/1999 Roth et al.
6,035,602 A 3/2000 Lafond
6,038,825 A 3/2000 Shah et al.
6,079,242 A 6/2000 Allegro et al.
6,092,375 A 7/2000 Denniston
6,109,084 A 8/2000 Hutzenlaub et al.

(56) References Cited

U.S. PATENT DOCUMENTS

| | | | | |
|---|---|---|---|---|
| 6,115,989 | A | 9/2000 | Boone et al. | |
| 6,131,364 | A | 10/2000 | Peterson | |
| 6,148,890 | A | 11/2000 | LaFond | |
| 6,183,879 | B1 | 2/2001 | Deeley | |
| 6,197,129 | B1 | 3/2001 | Zhu et al. | |
| 6,223,414 | B1 | 5/2001 | Hodek et al. | |
| 6,238,755 | B1 | 5/2001 | Harvey et al. | |
| 6,250,026 | B1 * | 6/2001 | Thompson, Jr. | 52/172 |
| 6,266,940 | B1 | 7/2001 | Reichert | |
| 6,289,641 | B1 | 9/2001 | McCandless | |
| 6,295,788 | B2 | 10/2001 | Reichert | |
| 6,345,485 | B1 | 2/2002 | Boone et al. | |
| 6,355,328 | B1 | 3/2002 | Baratuci et al. | |
| 6,370,838 | B1 | 4/2002 | Evason et al. | |
| 6,415,561 | B2 | 7/2002 | Thompson, Jr. | |
| 6,477,812 | B2 | 11/2002 | Boone et al. | |
| 6,481,222 | B1 | 11/2002 | Denniston | |
| 6,488,996 | B1 | 12/2002 | Ino et al. | |
| 6,497,130 | B2 | 12/2002 | Nilsson | |
| 6,500,516 | B2 | 12/2002 | Bourlier | |
| 6,528,131 | B1 | 3/2003 | Lafond | |
| 6,581,341 | B1 | 6/2003 | Baratuci | |
| 6,622,456 | B2 | 9/2003 | Almasy | |
| 6,686,002 | B2 | 2/2004 | Auerbach | |
| 6,715,244 | B2 | 4/2004 | Boone et al. | |
| 6,796,102 | B2 | 9/2004 | Virnelson et al. | |
| 6,823,644 | B1 | 11/2004 | Peterson | |
| 6,877,292 | B2 | 4/2005 | Baratuci et al. | |
| 6,887,292 | B2 | 5/2005 | Thorwesten | |
| 6,911,103 | B2 | 6/2005 | Koizumi et al. | |
| 7,008,492 | B2 | 3/2006 | Lisec | |
| 7,043,881 | B2 | 5/2006 | Krause, Sr. et al. | |
| 7,107,729 | B2 | 9/2006 | Baratuci | |
| 7,132,151 | B2 | 11/2006 | Rasmussen | |
| 7,347,909 | B2 | 3/2008 | Reichert | |
| 7,445,682 | B2 | 11/2008 | James et al. | |
| 7,448,246 | B2 | 11/2008 | Briese et al. | |
| 7,563,739 | B2 | 7/2009 | Kilthau et al. | |
| 7,827,761 | B2 | 11/2010 | Buchanan et al. | |
| 7,856,791 | B2 | 12/2010 | Rosskamp et al. | |
| 8,025,941 | B2 | 9/2011 | Taylor et al. | |
| 8,114,488 | B2 | 2/2012 | Alvarez | |
| 8,151,542 | B2 | 4/2012 | Trpkovski | |
| 8,181,499 | B2 | 5/2012 | Ingvarsson | |
| 2001/0015037 | A1 * | 8/2001 | Thompson, Jr. | 52/172 |
| 2001/0032436 | A1 | 10/2001 | Riegelman | |
| 2003/0041557 | A1 * | 3/2003 | Trpkovski et al. | 52/788.1 |
| 2003/0074859 | A1 | 4/2003 | Reichert et al. | |
| 2003/0097818 | A1 | 5/2003 | Almasy | |
| 2003/0101664 | A1 | 6/2003 | Trpkovski | |
| 2003/0178127 | A1 | 9/2003 | Lisec | |
| 2003/0230045 | A1 * | 12/2003 | Krause et al. | 52/786.13 |
| 2005/0055901 | A1 | 3/2005 | Valentz et al. | |
| 2005/0074566 | A1 | 4/2005 | Rouanet et al. | |
| 2005/0166546 | A1 | 8/2005 | Reichert | |
| 2005/0167028 | A1 | 8/2005 | Reichert | |
| 2005/0178078 | A1 | 8/2005 | Valentz et al. | |
| 2005/0227025 | A1 | 10/2005 | Baratuci et al. | |
| 2006/0065345 | A1 | 3/2006 | James et al. | |
| 2006/0101739 | A1 | 5/2006 | Baratuci et al. | |
| 2006/0105158 | A1 | 5/2006 | Fritz et al. | |
| 2006/0130427 | A1 | 6/2006 | Hodek et al. | |
| 2006/0201606 | A1 | 9/2006 | Lisec | |
| 2007/0077376 | A1 | 4/2007 | Mamiya et al. | |
| 2007/0087140 | A1 * | 4/2007 | Dierks | 428/34 |
| 2007/0116907 | A1 | 5/2007 | Landon et al. | |
| 2007/0131338 | A1 | 6/2007 | Lisec | |
| 2007/0160781 | A1 | 7/2007 | Landon et al. | |
| 2007/0178256 | A1 | 8/2007 | Landon | |
| 2007/0178257 | A1 | 8/2007 | Landon | |
| 2008/0060290 | A1 | 3/2008 | McGlinchy et al. | |
| 2009/0120018 | A1 | 5/2009 | Trpkovski | |
| 2009/0120019 | A1 | 5/2009 | Trpkovski | |
| 2009/0120035 | A1 | 5/2009 | Trpkovski | |
| 2009/0120036 | A1 | 5/2009 | Trpkovski | |
| 2009/0123694 | A1 | 5/2009 | Trpkovski | |
| 2009/0223150 | A1 * | 9/2009 | Baratuci et al. | 52/204.593 |
| 2009/0301637 | A1 | 12/2009 | Reichert | |
| 2010/0065580 | A1 | 3/2010 | McGlinchy et al. | |
| 2010/0200164 | A1 | 8/2010 | Lisec | |
| 2010/0255224 | A1 * | 10/2010 | Gubbels et al. | 428/34 |
| 2011/0104512 | A1 | 5/2011 | Rapp et al. | |
| 2011/0303349 | A1 | 12/2011 | Nieminen et al. | |
| 2012/0151857 | A1 | 6/2012 | Heikkila et al. | |
| 2012/0177827 | A1 | 7/2012 | Trpkovski | |
| 2013/0042552 | A1 | 2/2013 | Trpkovski et al. | |
| 2013/0047404 | A1 | 2/2013 | Nieminen et al. | |

FOREIGN PATENT DOCUMENTS

| | | | |
|---|---|---|---|
| CA | 1 290 624 | C | 10/1991 |
| CA | 2757945 | | 10/2010 |
| CH | 630 993 | A5 | 7/1982 |
| DE | 1 259 823 | | 2/1968 |
| DE | 69 03 785 | U | 1/1969 |
| DE | 6903785 | | 1/1969 |
| DE | 6903785 | | 10/1969 |
| DE | 1189518 | | 4/1970 |
| DE | 1 904 907 | | 8/1970 |
| DE | 2152071 | | 2/1973 |
| DE | 3 529 434 | | 2/1986 |
| DE | 41 01 277 | A1 | 7/1992 |
| DE | 4101277 | | 7/1992 |
| DE | 196 42 669 | | 3/1998 |
| DE | 196 42 669 | C1 | 3/1998 |
| DE | 10011759 | | 9/2001 |
| DE | 100111759 | | 9/2001 |
| DE | 202 00 349 | | 5/2003 |
| DE | 202 00 349 | U1 | 5/2003 |
| EP | 0 054 251 | A1 | 6/1982 |
| EP | 0107493 | | 5/1984 |
| EP | 0128981 | | 12/1984 |
| EP | 0139262 | | 5/1985 |
| EP | 0 268 886 | | 6/1988 |
| EP | 0324488 | | 7/1989 |
| EP | 0 403 058 | | 12/1990 |
| EP | 0 500 483 | | 8/1992 |
| EP | 0 500 483 | A1 | 8/1992 |
| EP | 1320422 | | 2/2006 |
| EP | 2 177 703 | A1 | 10/2009 |
| FR | 2 276 450 | | 1/1976 |
| FR | 2 525 314 | A | 10/1983 |
| FR | 2525314 | | 10/1983 |
| FR | 2 744 165 | A | 8/1997 |
| FR | 2744165 | | 8/1997 |
| GB | 1 579 726 | | 11/1980 |
| GB | 2 181 773 | | 4/1987 |
| GB | 2 389 138 | A | 12/2003 |
| GB | 2389138 | | 12/2003 |
| WO | WO/03/074830 | | 9/2003 |
| WO | WO03101709 | | 12/2003 |
| WO | WO/2004/009944 | A | 1/2004 |
| WO | WO2004009944 | | 1/2004 |
| WO | WO/2005/054617 | A | 6/2005 |
| WO | WO-2005054617 | | 6/2005 |
| WO | WO-2009064905 | A1 | 5/2009 |
| WO | WO-2009064909 | A1 | 5/2009 |
| WO | WO-2009064915 | A1 | 5/2009 |
| WO | WO-2009064919 | A1 | 5/2009 |
| WO | WO-2009064921 | A1 | 5/2009 |
| WO | WO-2010094446 | | 8/2010 |
| WO | WO-2011008860 | | 1/2011 |
| WO | WO2011156722 | | 12/2011 |
| WO | WO-2012083156 | | 6/2012 |

OTHER PUBLICATIONS

PCT/US2008/083441, International Search Report and Written Opinion mailed Jan. 22, 2009 corresponding with U.S. Appl. No. 12/270,289.

PCT/US2008/083449, International Search Report and Written Opinion mailed Jan. 22, 2009 corresponding with U.S. Appl. No. 12/270,362.

(56) References Cited

OTHER PUBLICATIONS

PCT/US2008/083435, International Search Report and Written Opinion mailed Jan. 22, 2009 corresponding with U.S. Appl. No. 12/270,393.
PCT/US2008/083445, International Search Report and Written Opinion mailed Feb. 11, 2009 corresponding with U.S. Appl. No. 12/270,315.
Specification, Claims, Drawings and Preliminary for co-pending U.S. Appl. No. 12/836,350, filed Jul. 14, 2010, "Stretched Strips for Spacer and Sealed Unit" (50 pages).
International Search Report and Written Opinion mailed Nov. 2, 2010, International Application No. PCT/US2010/041978 (12 pages).
File History of co-pending U.S. Appl. No. 12/270,315, filed Nov. 13, 2008, entitled "Box Spacer with Sidewalls", 277 pgs. (downloaded from USPTO website Apr. 7, 2011).
File History of co-pending U.S. Appl. No. 12/270,362, filed Nov. 13, 2008, entitled "Sealed Unit and Spacer with Stabilized Elongate Strip", 263 pgs. (downloaded from USPTO website Apr. 7, 2011).
Intercept® Spacer Technologies: Your Best Answer to Energy Star® and EN-1279, GED Integrated Solutions, http://www.gedusa.com/intercept.php (Jun. 28, 2011 9:08:36 AM) (2 pages).
File History (through Jul. 25, 2011) of co-pending U.S. Appl. No. 12/270,289, filed Nov. 13, 2008, entitled "Reinforced Window Spacer", 123 pgs.
Partial File History (through Jul. 25, 2011) of co-pending U.S. Appl. No. 12/270,315, filed Nov. 13, 2008, entitled "Box Spacer With Sidewalls", 41 pgs.
File History (through Jul. 25, 2011) of co-pending U.S. Appl. No. 12/270,393, filed Nov. 13, 2008, entitled "Material With Undulating Shape", 200 pgs.
File History (through Jul. 25, 2011) of co-pending U.S. Appl. No. 12/270,350, filed Jul. 14, 2010, entitled "Stretched Strips for Spacer and Sealed Unit", 138 pgs.
File History (through Jul. 25, 2011) of co-pending U.S. Appl. No. 13/157,866, filed Jun. 10, 2011, entitled "Window Spacer Applicator", 136 pgs.
Partial File History (from Oct. 11, 2011 Jan. 17, 2012) of co-pending U.S. Appl. No. 12/270,289, filed Nov. 13, 2008, entitled "Reinforced Window Spacer", 34 pgs.
Partial File History (from Oct. 11, 2011 through Jan. 17, 2012) of co-pending U.S. Appl. No. 12/270,315, filed Nov. 13, 2008, entitled "Box Spacer With Sidewalls", 28 pgs.
Partial File History (from Jul. 25, 2011 through Jan. 17, 2012) of co-pending U.S. Appl. No. 12/270,393, filed Nov. 13, 2008, entitled "Material With Undulating Shape", 3 pgs.
Partial File History (from Jul. 25, 2011 through Jan. 17, 2012) of co-pending U.S. Appl. No. 12/270,350, filed Jul. 14, 2010, entitled "Stretched Strips for Spacer and Sealed Unit", 6 pgs.
Partial File History (from Oct. 11, 2011 through Jan. 17, 2012) of co-pending U.S. Appl. No. 13/157,866, filed Jun. 10, 2011, entitled "Window Spacer Applicator", 20 pgs.
File History (through Jan. 17, 2012) of co-pending U.S. Appl. No. 13/326,501, filed Dec. 15, 2011, entitled "Triple Pane Window Spacer, Window Assembly and Methods for Manufacturing Same", 66 pgs.
International Search Report and Written Opinion mailed Nov. 17, 2011, International Application No. PCT/US2011/039994 (15 pages).
"PCT International Search Report and Written Opinion from International", Application No. PCT/US2011065470, mailed May 7, 2012, pp. 1-11.
Unknown, "Insulating Glass Production", Glass Digest May 15, 1994, 4 pages.
International Search Report dated Nov. 2, 2010 for Co-pending Application PCT/US2010/041978.
Unknown, "Allmetal—Making windows more exciting.", Allmetal Catalog Pages from the 1990's., 2 pages.
"Chinese Office Action Received", for Chinese Application No. 200880115633.X, corresponding to U.S. Appl. No. 12/270,315, mailed Jan 5, 2012, (pp. 23) Including English translation. , 23.
"Communication Pursuant to Rules 161(1) and 162 EPC in", in Copending Application PCT/US2010041978 dated Mar. 7, 2012.
"File History", for co-pending, co-owned U.S. Appl. No. 12/836,350 from Jan. 18, 2012 until May 13, 2012, Entitled "Stretched Strips for Spacer and Sealed Unit ," filed Mar. 30, 2012 (35 pages).
"File History of Office Actions and Office Action Responses", for co-pending, co-owned U.S. Appl. No. 12/270,315 from Jan. 18, 2012 until May 13, 2012, Entitled "Box Spacer with Sidewalls," filed Nov. 13, 2008 (154 pages).
"First Office Action Received", for Chinese Application No. 200880115858.5, corresponding to U.S. Appl. No. 12/270,215, mailed Dec. 12, 2011, (pp. 17), 17.
"PCT Notification Concerning Transmittal of International Preliminary Report on Patentability", from International Application No. PCT/US2008/083428, corresponding to U.S. Appl. No. 12/270,215 mailed May 18, 2010, pp. 7.
"PCT Notification Concerning Transmittal of International Preliminary Report on Patentability", from International Application No. PCT/US2008/083435, corresponding to U.S. Appl. No. 12/270,393, mailed May 18, 2010, pp. 1-6.
"PCT Notification Concerning Transmittal of International Preliminary Report on Patentability", from International Application No. PCT/US2008/083441, corresponding to U.S. Appl. No. 12/270,289, mailed Jan. 12, 2010, pp. 1-7.
"PCT Notification Concerning Transmittal of International Preliminary Report on Patentability", from International Application No. PCT/US2008/083445, corresponding to U.S. Appl. No. 12/270,315, mailed May 18, 2010, pp. 1-9.
"PCT Notification Concerning Transmittal of International Preliminary Report on Patentability", from International Application No. PCT/US2008/083449, corresponding to U.S. Appl. No. 12/270,362, mailed May 18, 2012, pp. 1-7.
"PCT Notification Concerning Transmittal of International Preliminary Report on Patentability", Application No. PCTUS2010041978, corresponding to U.S. Appl. No. 12/836,350, mailed Jan 26, 2012, pp. 1-6.
Partial File History (from Jul. 26, 2011 through Oct. 11, 2011) of co-pending U.S. Appl. No. 12/270,289, filed Nov. 13, 2008, entitled "Reinforced Window Spacer", 50 pgs.
Partial File History (from Jul. 26, 2011 through Oct. 11, 2011) of co-pending U.S. Appl. No. 12/270,315, filed Nov. 13, 2008, entitled "Box Spacer With Sidewalls", 56 pgs.
Partial File History (from Jul. 26, 2011 through Oct. 11, 2011) of co-pending U.S. Appl. No. 13/157,866, filed Jun. 10, 2011, entitled "Window Spacer Applicator", 57 pgs.
"Edgetech I.G., Super Spacer® Cushion Edge™, Decorative Glass, Foam Space . . . ", http://www.edgetechig.com/SuperSpacer/CushionEdge.aspx (1 page) (May 23, 2011).
Partial International Search Report Opinion mailed Aug. 2, 2011, International Application No. PCT/US2011/039994 (8 pages).
"Replacement Window Spacers: The Swiggle Spacer System", http://www.replacement-windows.com/spacers-swiggle-system.php (downloaded from web site Oct. 10, 2011).
"Chinese Final Office Action", for Chinese Application No. 200880115633.X, corresponding to U.S. Appl. No. 12/270,315, mailed Sep 5, 2012, Including English translation, 17pages.
"File History", for co-pending U.S. Appl. No. 13/424,088 dated from Mar. 19, 2012, entitled "Box Spacer With Sidewalls", 128 pages.
"Partial File History", for co-pending U.S. Appl. No. 12/836,350 dated from Jun. 27, 2012, entitled "Stretched Strips for Spacer and Sealed Unit", 14 pages.
"Office Action", from MX Application No. MX/a/2010/005260, mailed Jul. 4, 2013, 4 pages.
"Final Office Action", for co-pending, co-owned U.S. Appl. No. 13/424,088, mailed Jul. 31, 2013 (17 pages).
"Office Action (Translation)", from JP Application No. 2010-534186, mailed Jul. 11, 2013, 2 pages.
"Partial Translation of Japanese Patent Document S38-4432"(1 page).

(56) References Cited

OTHER PUBLICATIONS

Translated Abstract for Japanese Publication No. 09-272848. Published Oct. 21, 1997, Entitled "Cold-Curing Moisture-Absorbing Adhesive Tape for Double Glazing and Double Glazing Produced by Using the Tape" (2 pages).
Translated Abstract for Japanese Publication No. 2007-277052. Published Oct. 25, 2007, Entitled "Spacer for Multiple Glass, Multiple Glass and Method of Manufacturing Spacer for Multiple Glass" (2 pages).
English abstract and figures for patent document DE-3529403, published Apr. 17, 1986, inventor Eckelt, Josef.
English abstract and figures for patent document EP-291499, published Nov. 17, 1988, inventor Lisec, Peter.
"Description and Photos of Allmetal Spacers sold in 1990's", Four spacers made and offered for sale by Allmetal, Inc. of Itasca, Illinois in the 1990s., pp. 1-3.
"Office Action", for Mexico Application No. MX/a/2010/005259, mailed Feb. 22, 2013 (4 pages).
"Office Action", for Mexico Application No. MX/a/2010/005260, mailed Feb. 22, 2013 (7 pages).
"Partial File History", for co-pending, co-owned U.S. Appl. No. 13/424,088 filed Mar. 19, 2012 (Dec. 18, 2012 thru Jun. 25, 2013), entitled "Box Spacer With Sidewalls," 64 pages.
"Partial File History", of co-pending, co-owned U.S. Appl. No. 12/836,350, filed Jul. 14, 2010, (Dec. 18, 2012 thru Jun. 25, 2013) entitled "Stretched Strips for Spacer and Sealed Unit", 99 pgs.
"Partial File History", of co-pending, co-owned U.S. Appl. No. 13/326,501, filed Dec. 15, 2011, (Dec. 15, 2011 thru Jun. 25, 2013) entitled "Triple Pane Window Spacer, Window Assembly and Methods for Manufacturing Same", 179 pgs.
"PCT Notification Concerning Transmittal of International Preliminary Report on Patentability", from International Application No. PCT/US2011/039994, corresponding to, mailed Dec. 20, 2012, pp. 1-10.

* cited by examiner

SEALED UNIT AND SPACER

RELATED APPLICATIONS

This application claims priority to U.S. Provisional Application No. 60/987,681, filed on Nov. 13, 2007, titled "WINDOW ASSEMBLY AND WINDOW SPACER"; and to U.S. Provisional Application No. 61/049,593, filed on May 1, 2008, titled "WINDOW ASSEMBLY AND WINDOW SPACER"; and to U.S. Provisional Application No. 61/049,599, filed on May 1, 2008, titled "MANUFACTURE OF WINDOW ASSEMBLY AND WINDOW SPACER"; and to U.S. Provisional Application No. 61/038,803, filed on Mar. 24, 2008, titled "WINDOW ASSEMBLY AND WINDOW SPACER"; the disclosures of which are each hereby incorporated by reference in their entirety.

BACKGROUND

An insulated glazing unit often includes two facing sheets of glass separated by an air space. The air space reduces heat transfer through the unit, to insulate the interior of a building to which it is attached from external temperature variations. As a result, the energy efficiency of the building is improved, and a more even temperature distribution is achieved within the building. A rigid pre-formed spacer is typically used to maintain the space between the two facing sheets of glass.

SUMMARY

In general terms, this disclosure is directed to a sealed unit assembly and a spacer. In one possible configuration and by non-limiting example, the sealed unit assembly includes a first sheet and a spacer connected to the first sheet. In another possible configuration, the sealed unit assembly includes a first sheet and a second sheet and a spacer arranged between the first sheet and the second sheet. In another possible configuration, a spacer includes a first elongate strip and a second elongate strip. A filler is arranged between the first elongate strip and the second elongate strip in some embodiments.

One aspect is a spacer comprising: a first elongate strip having a first surface; a second elongate strip having a second surface and including at least one aperture extending through the second elongate strip, wherein the second surface is spaced from the first surface; and at least one filler arranged between the first and second surfaces, the filler including a desiccant.

Another aspect is a spool comprising: a core having an outer surface; and at least one elongate strip wound around the core, wherein the elongate strip is arranged and configured for assembly with at least a filler material to form a spacer.

Yet another aspect is a method of making a spacer, the method comprising: arranging at least a first and a second elongate strip onto a sheet of material, wherein the first elongate strip has a first surface, the second elongate strip has a second surface, and the sheet of material has a third surface; and inserting at least a first filler material between the first and second surfaces of the first and second elongate strips wherein the first and second surfaces contain the filler material therebetween and wherein at least a portion of the filler material contacts the third surface of the sheet of material.

A further aspect is a method of making a spacer, the method comprising: storing a plurality of spools, wherein each spool includes a length of spacer material and wherein at least two spools include spacer material having at least one different characteristic; identifying at least one of the plurality of spools containing the spacer material having a desired characteristic; retrieving spacer material from at least one of the identified spools; and arranging the spacer material on a surface of a sheet of material.

Another aspect is a spacer comprising: a first elongate strip having a first surface; and at least one filler arranged on the first surface, wherein the filler comprises a first sealant, a desiccant, and a second sealant, wherein the first and second sealants are arranged to form joints to connect the first elongate strip to first and second sheets of a sealed unit.

There is no requirement that an arrangement include all of the features characterized herein to obtain some advantage according to the present disclosure.

DETAILED DESCRIPTION

Figure 1:
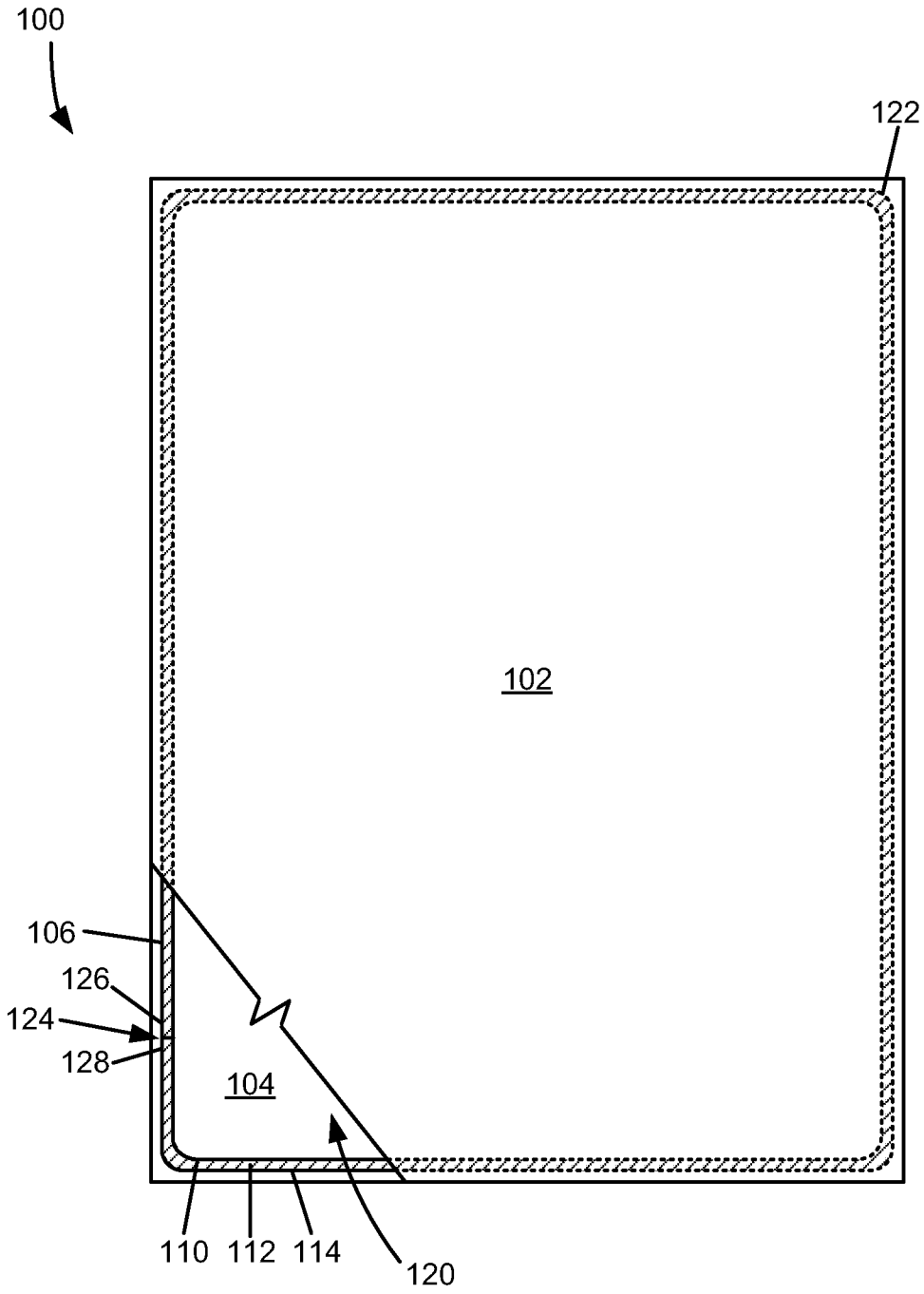
FIG. 1 is a schematic front view of an example sealed unit according to the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
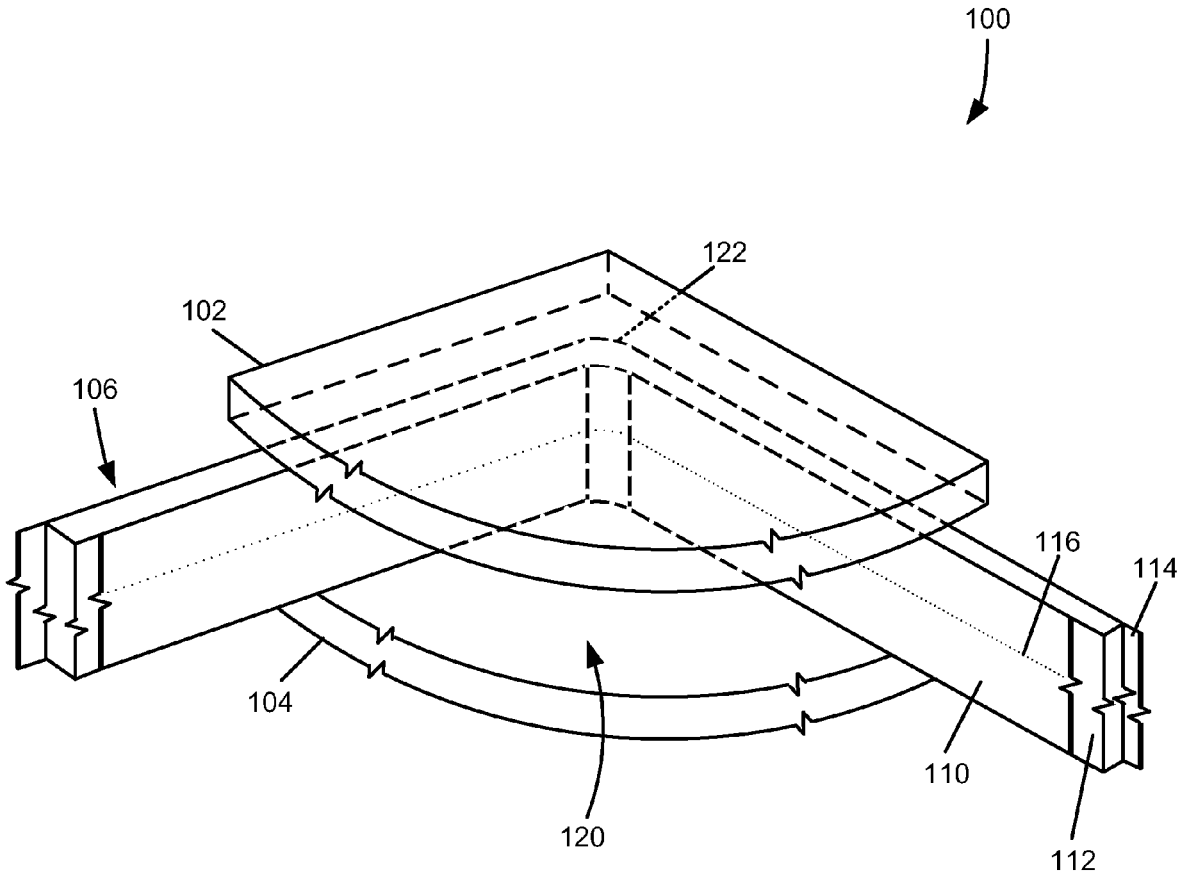
FIG. 2 is a schematic perspective view of a corner section of the example sealed unit shown in FIG. 1.

FIGS. 1 and 2 illustrate an example sealed unit 100 according to the present disclosure. FIG. 1 is a schematic front view of sealed unit 100. FIG. 2 is a schematic perspective view of a corner section of sealed unit 100. In the illustrated embodiment, sealed unit 100 includes sheet 102, sheet 104, and spacer 106. Spacer 106 includes elongate strip 110, filler 112, and elongate strip 114. Elongate strip 110 includes apertures 116.

In some embodiments, sealed unit 100 includes sheet 102, sheet 104, and spacer 106. Sheets 102 and 104 are made of a material that allows at least some light to pass through. Typically, sheets 102 and 104 are made of a transparent material, such as glass, plastic, or other suitable materials. Alternatively, a translucent or semi-transparent material is used, such as etched, stained, or tinted glass or plastic. More or fewer layers or materials are included in other embodiments.

One example of a sealed unit 100 is an insulated glazing unit. Another example of a sealed unit 100 is a window assembly. In further embodiments a sealed unit is an automotive part (e.g., a window, a lamp, etc.). In other embodiments a sealed unit is a photovoltaic cell or solar panel. In some embodiments a sealed unit is any unit having at least two sheets (e.g., 102 and 104) separated by a spacer, where the spacer forms a gap between the sheets to define an interior space therebetween. Other embodiments include other sealed units.

In some embodiments the spacer 106 includes elongate strip 110, filler 112, and elongate strip 114. Spacer 106 includes first end 126 and second end 128 that are connected together at joint 124 (shown in FIG. 1). Spacer 106 is disposed between sheets 102 and 104 to maintain a desired space between sheets 102 and 104. Typically, spacer 106 is arranged near to the perimeter of sheets 102 and 104. However, in other embodiments spacer 106 is arranged between sheets 102 and 104 at other locations of sealed unit 100. Spacer 106 is able to withstand compressive forces applied to sheets 102 and/or 104 to maintain an appropriate space between sheets 102 and 104. Interior space 120 is bounded on two sides by sheets 102 and 104 and is surrounded by spacer 106. In some embodiments spacer 106 is a window spacer.

Elongate strips 110 and 114 are typically long and thin strips of a solid material, such as metal or plastic. An example of a suitable metal is stainless steel. An example of a suitable plastic is a thermoplastic polymer, such as polyethylene terephthalate. A material with low or no permeability is preferred in some embodiments, such as to prevent or reduce air or moisture flow therethrough. Other embodiments include a material having a low thermal conductivity, such as to reduce heat transfer through spacer 106. Other embodiments include other materials.

Figure 12:
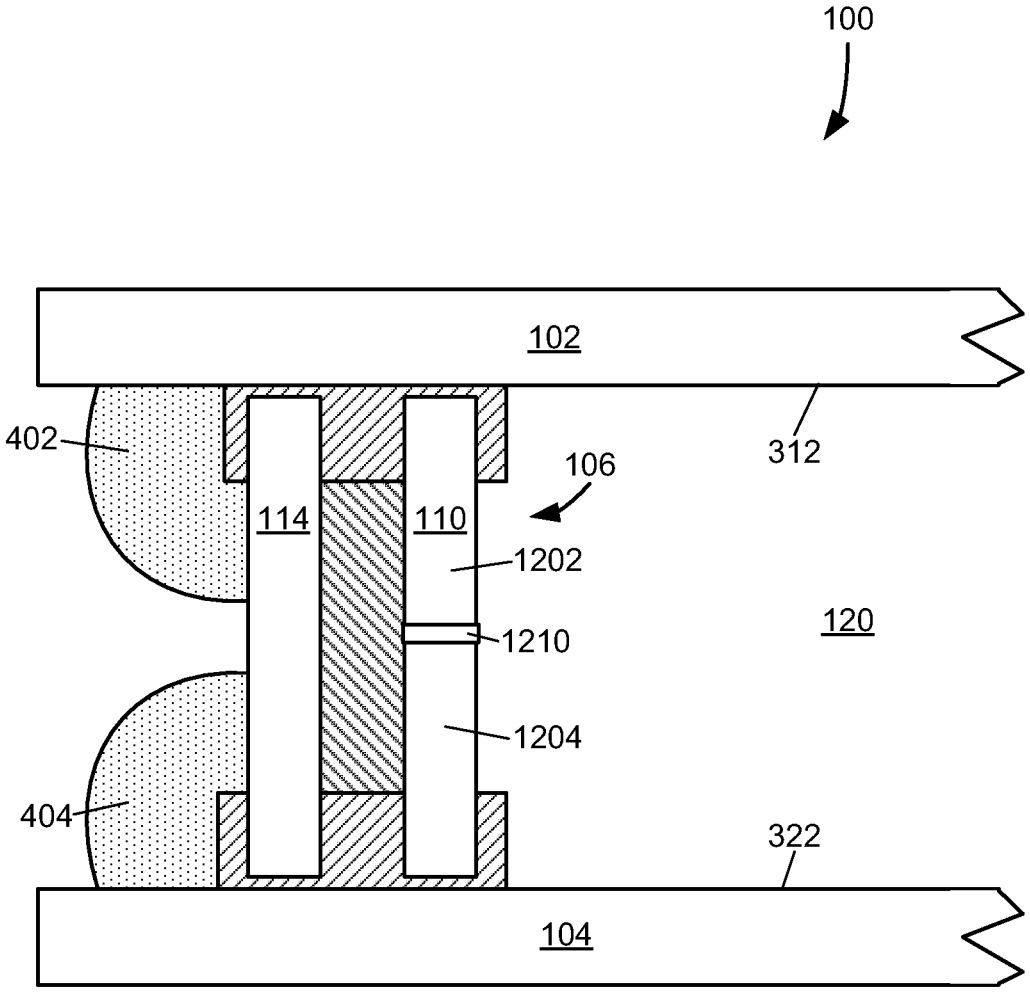
FIG. 12 is a schematic cross-sectional view of another embodiment of a sealed unit according to the present disclosure, the sealed unit including a spacer having a thermal break.

Elongate strips 110 and 114 are typically flexible, including both bending and torsional flexibility. Bending flexibility (as shown in FIG. 12) allows spacer 106 to be bent to form corners (e.g., corner 122 shown in FIGS. 1 and 2). Bending and torsional flexibility also allows for ease of manufacturing, such as by allowing the spacer to be stored on a spool, and allowing the spacer to be more easily handled by robots or other automated assembly devices. Such flexibility includes either elastic or plastic deformation such that elongate strips 110 or 114 do not fracture during installation into sealed unit 100.

Figure 6:
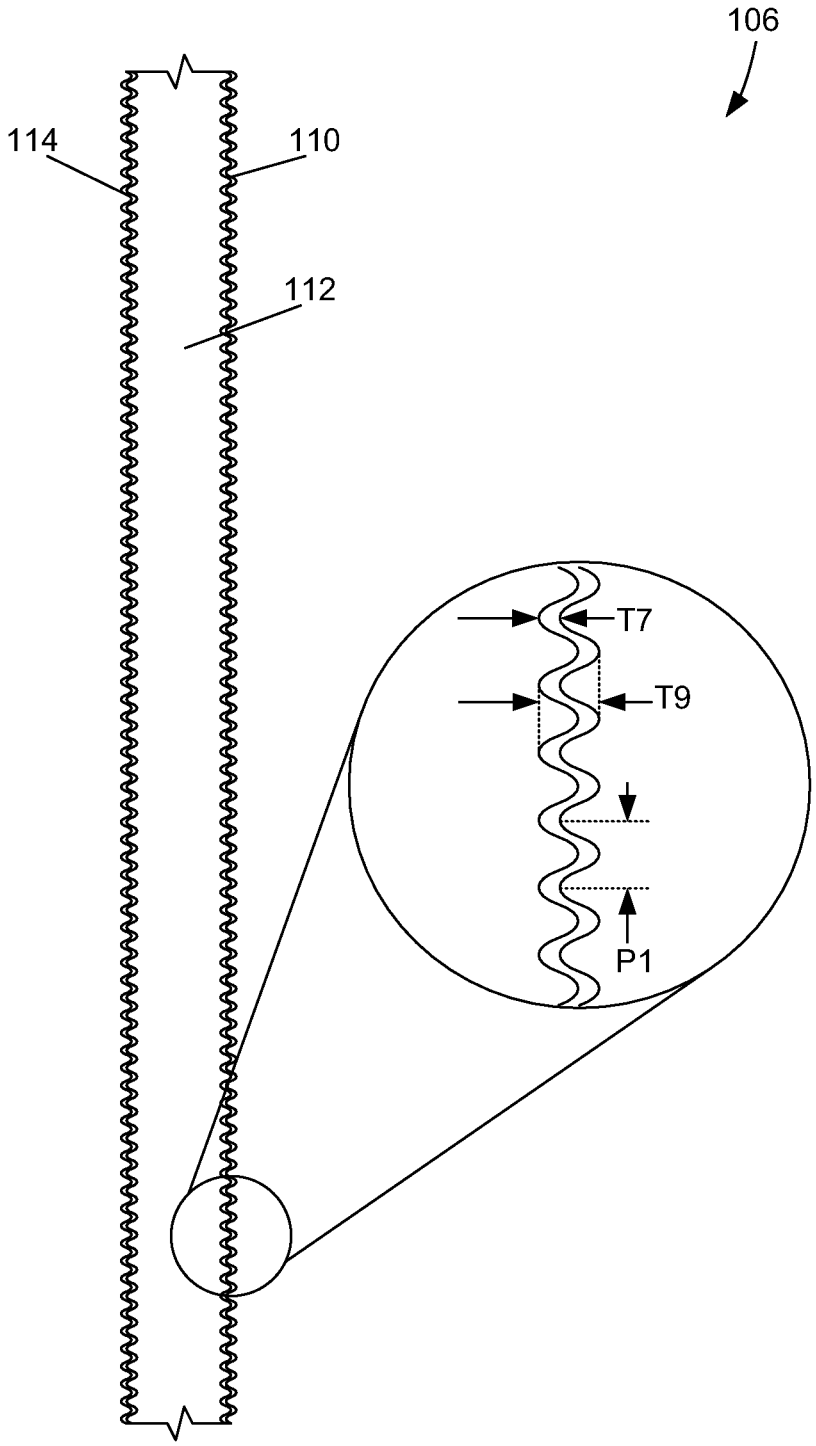
FIG. 6 is a schematic front view of a portion of another example spacer according to the present disclosure, the spacer including elongate strips having an undulating shape.

In some embodiments, elongate strips include an undulating shape, such as a sinusoidal or other undulating shape (such as shown in FIG. 6). The undulating shape provides various advantages in different embodiments. For example, the undulating shape provides additional bending and torsional flexibility, and also provides stretching flexibility along a longitudinal axis of the elongate strips. An advantage of such flexibility is that the elongate strips 110 and 114 (or the entire spacer 106) are more easily manipulated during manufacturing without causing permanent damage (e.g., kinking, creasing, or breaking) to the elongate strips 110 and 114 or to the spacer 106. The undulating shape provides increased surface area per unit of length of the spacer, providing increased surface area for bonding the spacer to one or more sheets. In addition, the increased surface area distributes forces present at the intersection of an elongate strip and the one or more sheets to reduce the chance of breaking, cracking, or otherwise damaging the sheet at the location of contact.

In some embodiments, filler 112 is arranged between elongate strip 110 and elongate strip 114. Filler 112 is a deformable material in some embodiments. Being deformable allows spacer 106 to flex and bend, such as to be formed around corners of sealed unit 100. In some embodiments, filler 112 is a desiccant that acts to remove moisture from interior space 120. Desiccants include molecular sieve and silica gel type desiccants. One particular example of a desiccant is a beaded desiccant, such as PHONOSORB® molecular sieve beads manufactured by W. R. Grace & Co. of Columbia, Md. If desired, an adhesive is used to attach beaded desiccant between elongate strips 110 and 114.

In many embodiments, filler 112 is a material that provides support to elongate strips 110 and 114 to provide increased structural strength. Without filler 112, the thin elongate strips 110 and 114 may have a tendency to bend or buckle, such as when a compressive force is applied to one or both of sheets 102 and 104. Filler 112 fills (or partially fills) space between elongate strips 110 and 114 to resist deformation of elongate strips 110 and 114 into filler 112. In addition, some embodiments include a filler 112 having adhesive properties that further allows spacer 106 to resist undesired deformation. Because the filler 112 is trapped in the space between the elongate strips 110 and 114 and the sheets 102 and 104, the filler 112 cannot leave the space when a force is applied. This increases the strength of the spacer to more than the strength of the elongate strips 110 and 114 alone. As a result, spacer 106 does not rely solely on the strength and stability of elongate strips 110 and 114 to maintain appropriate spacing between sheets 102 and 104 and to prevent buckling, bending, or breaking. An advantage is that the strength and stability of elongate strips 110 and 114 themselves can be reduced, such as by reducing the material thickness (e.g., T7 shown in FIG. 6) of elongate strips 110 and 114. In doing so, material costs are reduced. Furthermore, thermal transfer through elongate strips 110 and 114 is also reduced. In some embodiments, filler 112 is a matrix desiccant material that not only acts to provide structural support between elongate strips 110 and 114, but also functions to remove moisture from interior space 120.

Examples of filler materials include adhesive, foam, putty, resin, silicon rubber, and other materials. Some filler materials are a desiccant or include a desiccant, such as a matrix desiccant material. Matrix desiccant typically includes desiccant and other filler material. Examples of matrix desiccants include those manufactured by W.R. Grace & Co. and H.B. Fuller Corporation. In some embodiments, filler 112 includes a beaded desiccant that is combined with another filler material.

In some embodiments, filler 112 is made of a material providing thermal insulation. The thermal insulation reduces heat transfer through spacer 106 both between sheets 102 and 104, and between the interior space 120 and an exterior side of spacer 106.

In some embodiments, elongate strip 110 includes a plurality of apertures 116 (shown in FIG. 2). Apertures 116 allow gas and moisture to pass through elongate strip 110. As a result, moisture located within interior space 120 is allowed to pass through elongate strip 110 where it is removed by desiccant of filler 112 by absorption or adsorption. In one possible embodiment, elongate strip 110 includes a regular and repeating arrangement of apertures. For example, one possible embodiment includes apertures in a range from about 10 to about 1000 apertures per inch, and preferably from about 500 to about 800 apertures per inch. Other embodiments include other numbers of apertures per unit length.

In some embodiments it is desirable to provide as much aperture area as possible through elongate strip 110. In one example, the aperture area is defined as a percentage of the elongate strip area (e.g. prior to forming the apertures) over at least a region of the elongate strip 110. In some embodiments the aperture area is in a range from about 5% to about 75% of at least a region of the elongate strip 110, and preferably in a range from about 40% to about 60%. Other embodiments include other percentages.

In another embodiment, apertures 116 are used for registration. In yet another embodiment, apertures provide reduced thermal transfer. In one example, apertures 116 have a diameter in a range from about 0.002 inches (about 0.005 centimeter) to about 0.05 inches (about 0.13 centimeter) and preferably from about 0.005 inches (about 0.015 centimeter) to about 0.02 inches (about 0.05 centimeter). Some embodiments include multiple aperture sizes, such as one aperture size for gas and moisture passage and another aperture size for registration of accessories or other devices, such as muntin bars. Apertures 116 are made by any suitable method, such as cutting, punching, drilling, laser forming, or the like.

Spacer 106 is connectable to sheets 102 and 104. In some embodiments, filler 112 connects spacer 106 to sheets 102 and 104. In other embodiments, filler 112 is connected to sheets 102 and 104 by a fastener. An example of a fastener is a sealant or an adhesive, as described in more detail below. In yet other embodiments, a frame, sash, or the like is constructed around sealed unit 100 to support spacer 106 between sheets 102 and 104. In some embodiments, spacer 106 is connected to the frame or sash by another fastener, such as adhesive. Spacer 106 is fastened to the frame or sash prior to installation of sheets 102 and 104 in some embodiments.

Ends 126 and 128 (shown in FIG. 1) of spacer 106 are connected together in some embodiments to form joint 124, thereby forming a closed loop. In some embodiments a fastener is used to form joint 124. Examples of suitable joints are described in more detail with reference to FIGS. 21-25. Spacer 106 and sheets 102 and 104 together define an interior space 120 of sealed unit 100. In some embodiments, interior space 120 acts as an insulating region, reducing heat transfer through sealed unit 100.

A gas is sealed within interior space 120. In some embodiments, the gas is air. Other embodiments include oxygen, carbon dioxide, nitrogen, or other gases. Yet other embodiments include an inert gas, such as helium, neon or a noble gas such as krypton, argon, and the like. Combinations of these or other gases are used in other embodiments. In other embodiments, interior space 120 is a vacuum or partial vacuum.

Figure 3:
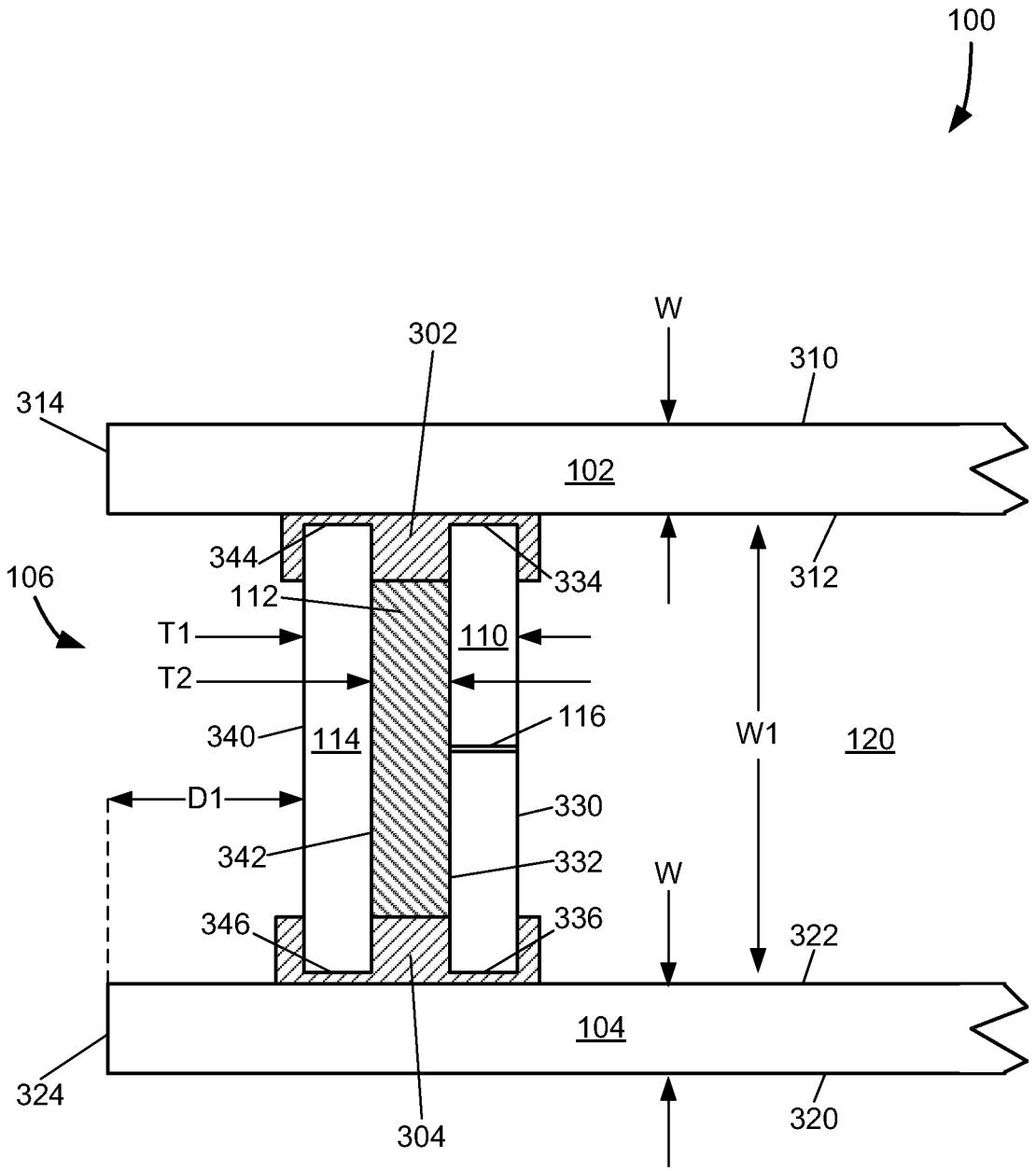
FIG. 3 is a schematic cross-sectional view of a portion of another example sealed unit according to the present disclosure, the sealed unit including a first sealant.

FIG. 3 is a schematic cross-sectional view of a portion of the example sealed unit 100, shown in FIG. 1. In this embodiment, sealed unit 100 includes sheet 102, sheet 104, and spacer 106. Sealants 302 and 304 are also shown.

Sheet 102 includes outer surface 310, inner surface 312, and perimeter 314. Sheet 104 includes outer surface 320, inner surface 322, and perimeter 324. In one example, W is the thickness of sheets 102 and 104. W is typically in a range from about 0.05 inches (about 0.13 centimeter) to about 1 inch (about 2.5 centimeters), and preferably from about 0.1 inches (about 0.25 centimeter) to about 0.5 inches (about 1.3 centimeters). Other embodiments include other dimensions.

Spacer 106 is arranged between inner surface 312 and inner surface 322. Spacer 106 is typically arranged near perimeters 314 and 324. In one example, D1 is the distance between perimeters 314 and 324 and spacer 106. D1 is typically in a range from about 0 inches (about 0 centimeter) to about 2 inches (about 5 centimeters), and preferably from about 0.1 inches (about 0.25 centimeter) to about 0.5 inches (about 1.3 centimeters). However, in other embodiments spacer 106 is arranged at other locations between sheets 102 and 104.

Spacer 106 maintains a space between sheets 102 and 104. In one example, W1 is the overall width of spacer 106 and the distance between sheets 102 and 104. W1 is typically in a range from about 0.1 inches (about 0.25 centimeter) to about 2 inches (about 5 centimeters), and preferably from about 0.3 inches (about 0.76 centimeter) to about 1 inch (about 2.5 centimeters). Other embodiments include other dimensions. In some embodiments W1 is also the space between sheets 102 and 104. In other embodiments, the space between sheets 102 and 104 is slightly larger than W1, such as due to the presence of one or more other materials, such as sealants 302 and 304.

Spacer 106 includes elongate strip 110 and elongate strip 114. Elongate strip 110 includes external surface 330, internal surface 332, edge 334, and edge 336. In some embodiments elongate strip 110 also includes apertures 116. Elongate strip 114 includes external surface 340, internal surface 342, edge 344, and edge 346. In some embodiments, external surface 330 of elongate strip 110 is visible by a person when looking through sealed unit 100. Internal surface 332 of elongate strip 110 provides a clean and finished appearance to spacer 106.

In one example, T1 is the overall thickness of spacer 106 from external surface 330 to external surface 340. T1 is typically in a range from about 0.02 inches (about 0.05 centimeter) to about 1 inch (about 2.5 centimeters), and preferably from about 0.05 inches (about 0.13 centimeter) to about 0.5 inches (about 1.3 centimeters), and more preferably from about 0.15 inches (about 0.4 centimeter) to about 0.25 inches (about 0.6 centimeter). T2 is the distance between elongate strip 110 and elongate strip 114, and more specifically the distance from internal surface 332 to internal surface 342. T2 is also the thickness of filler material 112 in some embodiments. T2 is in a range from about 0.02 inches (about 0.05 centimeter) to about 1 inch (about 2.5 centimeters), and preferably from about 0.05 inches (about 0.13 centimeter) to about 0.5 inches (about 1.3 centimeters), and more preferably from about 0.15 inches (about 0.4 centimeter) to about 0.25 inches (about 0.6 centimeter).

The thickness of spacer 106 involves a balancing of multiple factors. One factor is the ability of spacer 106 to be formed around a corner. Some of these dimensions are beneficial to enable spacer 106 to be formed along a radius, such as to form a corner, without damaging spacer 106 or filler 112. Generally the thinner spacer 106 is, the more bending can occur without damaging spacer 106 or filler 112. Another factor to consider is the heat transfer characteristic. Generally, the thinner spacer 106 (an in particular elongate strips 110 and 114), the less heat transfer will occur across spacer 106 between sheet 102 and 104. On the other hand, a thicker filler layer 112 generally provides greater insulating characteristics across the spacer 106 from external surface 340 to external surface 330. Another factor is the cost of materials. The thicker spacer 106 is, the more expensive the spacer will be to make because of the increased material required. A further consideration is that filler 112 should have sufficient desiccant to adequately remove moisture from interior space 120.

If filler 112 is too thin, there may not be a sufficient amount of desiccant to remove moisture, possibly resulting in condensation of the moisture on sheets 102 or 104.

In some embodiments the dimension T2 is an average dimension. For example, in some embodiments elongate strips 110 and 114 and filler 112 are not flat and straight, but rather have an undulating shape. As a result, the distance T2 may vary slightly with the undulating shape. In these embodiments, T2 is an average thickness. Other embodiments include other dimensions than those discussed above.

In some embodiments, a first sealant material 302 and 304 is used to connect spacer 106 to sheets 102 and 104. In one embodiment, sealant 302 is applied to an edge of spacer 106, such as on edges 334 and 344, and the edge of filler 112 and then pressed against inner surface 312 of sheet 102. Sealant 304 is also applied to an edge of spacer 106, such as on edges 336 and 346, and an edge of filler 112 and then pressed against inner surface 322 of sheet 104. In other embodiments, beads of sealant 302 and 304 are applied to sheets 102 and 104, and spacer 106 is then pressed into the beads.

In some embodiments, first sealant 302 and 304 is a material having adhesive properties, such that first sealant 302 and 304 acts to fasten spacer 106 to sheets 102 and 104. Typically, sealant 302 and 304 is arranged to support spacer 106 such that spacer 106 extends in a direction normal to inner surfaces 312 and 322 of sheets 102 and 104. First sealant 302 and 304 also acts to seal the joint formed between spacer 106 and sheets 102 and 104 to inhibit gas or liquid intrusion into interior space 120. Examples of first sealant 302 and 304 are primary sealants. Examples of primary sealants include polyisobutylene (PIB), butyl, curable PIB, hot melt silicon, acrylic adhesive, acrylic sealant, and other Dual Seal Equivalent (DSE) type materials. Other embodiments include other materials.

In some embodiments, a reactive sealant is included. In other embodiments a sealant having a low viscosity is included. In yet other embodiments a sealant having a long cure time is included. In another embodiment, a non-reactive hot melt is included. In further embodiments a temperature cured sealant is included. Elongate strips provide a good heat transfer media in some embodiments to transfer heat from a sealant. In some embodiments the heat transfer is further improved by using stainless steel elongate strips.

First sealant 302 and 304 is illustrated as extending out from the edges of spacer 106, such that the first sealant 302 and 304 contacts surfaces 330 and 340 of elongate strips 110 and 114. The additional contact area between first sealant 302 and 304 and spacer 106 is beneficial. For example, the additional surface area increases adhesion strength. The increased thickness of sealants 302 and 304 also improves the moisture and gas barrier. In some embodiments, however, sealants 302 and 304 are confined to space between spacer 106 and sheets 102 and 104.

Figure 4:
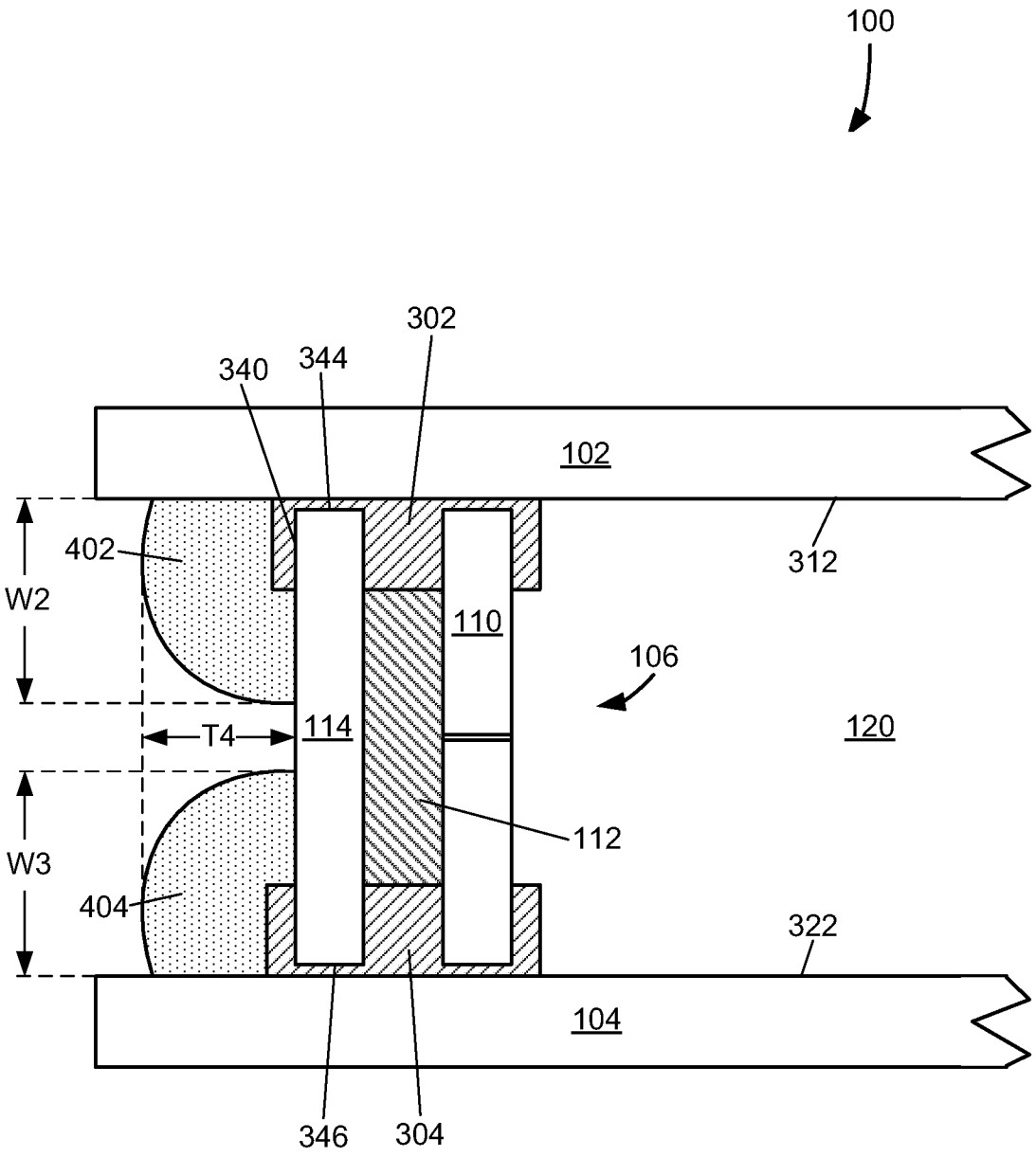
FIG. 4 is a schematic cross-sectional view of a portion of another example sealed unit according to the present disclosure, the sealed unit including a first sealant and a second sealant.

FIG. 4 is a schematic cross-sectional view of a portion of another example sealed unit 100. Sealed unit 100 is the same as that shown in FIG. 3, except for the addition of a second sealant 402 and 404. Sealed unit 100 includes sheet 102, sheet 104, spacer 106, and second sealant 402 and 404. Sealed unit 100 defines an interior space 120 between inner surface 312 and inner surface 322.

In this embodiment, second sealant 402 and 404 is included to provide a second barrier against gas and fluid intrusion into interior space 120. Sealant 402 is applied at the intersection of elongate strip 114 and sheet 102, and connects to external surface 340 and inner surface 312. Sealant 404 is applied at the intersection of elongate strip 114 and sheet 104, and connects to external surface 340 and inner surface 322. In some embodiments, second sealant provides additional thermal insulation. Examples of second sealant 402 and 404 are secondary sealants. Examples of secondary sealants include reactive hot melt beutal (such as D-2000 manufactured by Delchem, Inc. located in Wilmington, Del.), curative hot melt (such as HL-5153 manufactured by H.B. Fuller Company), silicon, copolymers of silicon and polyisobutylene, and other dual seal equivalents. Other embodiments include other materials.

In one example, sealants 402 and 404 have a width W2 and W3. W2 and W3 are typically in a range from about 0.1 inches (about 0.25 centimeter) to about 1 inch (about 2.5 centimeters), and preferably from about 0.1 inches (about 0.25 centimeter) to about 0.3 inches (about 0.76 centimeter). In some embodiments, the sum of W2 and W3 is in a range from about 20 percent to about 100 percent of the width of spacer 106 (e.g., W1 shown in FIG. 3), and preferably from about 50 percent to about 90 percent. A benefit of embodiments in which the second sealant (e.g., 402) extends entirely (100%) across surface 340 of spacer 106 is that the second sealant provides an additional layer of insulation across all of spacer 106, providing improved thermal performance. T4 is the thickness of sealants 402 and 404. T4 is typically in a range from about 0.1 inches (about 0.25 centimeter) to about 1 inch (about 2.5 centimeters), and preferably from about 0.1 inches (about 0.25 centimeter) to about 0.3 inches (about 0.76 centimeter). In some embodiments, dimensions W2, W3, and T4 are average dimensions.

As discussed in more detail herein, in some embodiments spacer 106 is formed directly on a sheet (e.g., sheet 104). As a result, in some embodiments spacer 106 includes one or more reactive sealants, such as for first sealants 302 and 304 or for second sealants 402 and 404. Non-reactive sealants are used in other embodiments.

Figure 5:
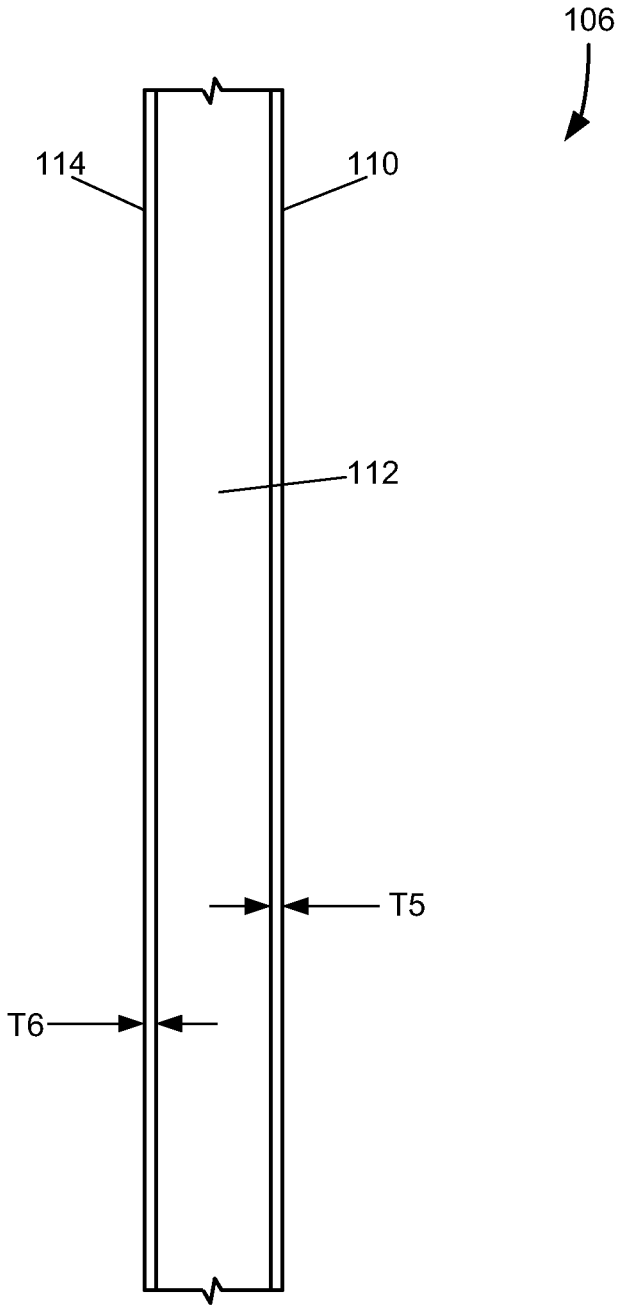
FIG. 5 is a schematic front view of a portion of an example spacer according to the present disclosure, the spacer including flat elongate strips.

FIG. 5 is a schematic front view of a portion of an example spacer 106 of the sealed unit shown in FIG. 1. Spacer 106 includes elongate strip 110, filler 112, and elongate strip 114. In this embodiment, spacer 106 includes elongate strips 110 and 114 that are generally flat and smooth (e.g. having an amplitude of about 0 inches (about 0 centimeter) and a period of about 0 inches (about 0 centimeter)).

In one example, elongate strips 110 and 114 are made of stainless steel. One benefit of stainless steel is that it is resistant to ultraviolet radiation. Other metals are used in other embodiments, such as titanium or aluminum. Titanium has a lower thermal conductivity, a lower density, and better corrosion resistance than stainless steel. An aluminum alloy is used in some embodiments, such as an alloy of aluminum and one or more of copper, zinc, magnesium, manganese or silicon. Other metal alloys are used in other embodiments. Another embodiment includes a material that is coated. A painted substrate is included in some embodiments. Some embodiments of elongate strips 110 and 114 are made of a material having memory. Some embodiments include elongate strips 110 and 114 made of a polymer, such as plastic. Other embodiments include other materials or combinations of materials.

In this example, elongate strips 110 and 114 have a thickness T5 and T6. T5 and T6 are typically in a range from about 0.0001 inches (about 0.00025 centimeter) to about 0.01 inches (about 0.025 centimeter), and preferably from about 0.0003 inches (about 0.00076 centimeter) to about 0.004 inches (about 0.01 centimeter). In some embodiments T5 and T6 are about equal. In other embodiments, T5 and T6 are not equal. Other embodiments include other dimensions.

In some embodiments, the materials used to form elongate strips 110 and 114, allow elongate strips 110 and 114 to have at least some bending flexibility and torsional flexibility. Bending flexibility allows spacer 106 to form a corner (e.g., corner 122 shown in FIG. 2), for example. In addition, bending flexibility allows elongate strips 110 and 114 to be stored in a roll or on a spool as rolled stock. Rolled stock saves space during transportation and is therefore easier and less expensive to transport. Portions of elongate strips 110 and 114 are then unrolled during assembly. In some embodiments a tool is used to guide elongate strips 110 and 114 into the desired arrangement and to insert filler 112 to form spacer 106. In other embodiments, a machine or robot is used to automatically manufacture spacer 106 and sealed unit 100.

FIG. 6 is a schematic front view of a portion of another example spacer 106. FIG. 6 includes an enlarged view of a portion of spacer 106. Spacer 106 includes elongate strip 110, filler 112, and elongate strip 114. In this embodiment, elongate strips 110 and 114 have a laterally undulating shape. The laterally undulating shape defines peaks that extend in a direction transverse to a longitudinal direction of the elongate strips.

In some embodiments, elongate strips 110 and 114 are formed of a ribbon of material, which is then bent into the undulating shape. In some embodiments, the elongate strip material is metal, such as steel, stainless steel, aluminum, titanium, a metal alloy, or other metal. Other embodiments include other materials, such as plastic, carbon fiber, graphite, or other materials or combinations of these or other materials. Some examples of the undulating shape include sinusoidal, arcuate, square, rectangular, triangular, and other desired shapes.

In one embodiment, undulations are formed in the elongate strips 110 and 114 by passing a ribbon of elongate strip material through a roll-former. An example of a suitable roll-former is a pair of corrugated rollers. As the flat ribbon of material is passed between the corrugated rollers, the teeth of the roller bend the ribbon into the undulating shape. Depending on the shape of the teeth, different undulating shapes can be formed. In some embodiments, the undulating shape is sinusoidal. In other embodiments, the undulating shape has another shape, such as squared, triangular, angled, or other regular or irregular shape.

Other embodiments form undulating elongate strips in other manners. For example, some embodiments form undulating elongate strips by injection molding. A continuous injection molding process is used in some embodiments.

One of the benefits of the undulating shape is that the flexibility of elongate strips 110 and 114 is increased over that of a flat ribbon, including bending and torsional flexibility, in some embodiments. The undulating shape of elongate strips 110 and 114 resist permanent deformation, such as kinks and fractures, in some embodiments. This allows elongate strips 110 and 114 to be more easily handled during manufacturing without damaging elongate strips 110 and 114. The undulating shape also increases the structural stability of elongate strips 110 and 114 to improve the ability of spacer 106 to withstand compressive and torsional loads. Some embodiments of elongate strips 110 and 114 are also able to extend and contract (e.g., stretch longitudinally), which is beneficial, for example, when spacer 106 is formed around a corner. In some embodiments, the undulating shape reduces or eliminates the need for notching or other stress relief.

In one example, elongate strips 110 and 114 have material thicknesses T7. T7 is typically in a range from about 0.0001 inches (about 0.00025 centimeter) to about 0.01 inches (about 0.025 centimeter), and preferably from about 0.0003 inches (about 0.00076 centimeter) to about 0.004 inches (about 0.01 centimeter). Such thin material thickness reduces material costs and also reduces thermal conductivity through elongate strips 110 and 114. In some embodiments, such thin material thicknesses are possible because of the undulating shape of elongate strips 110 and 114 increases the structural strength of elongate strips.

In one example, the undulating shape of elongate strips 110 and 114 defines a waveform having a peak-to-peak amplitude and a peak-to-peak period. The peak-to-peak amplitude is also the overall thickness T9 of elongate strips 110 and 114. T9 is typically in a range from about 0.005 inches (about 0.013 centimeter) to about 0.1 inches (about 0.25 centimeter), and preferably from about 0.02 inches (about 0.05 centimeter) to about 0.04 inches (about 0.1 centimeter). P1 is the peak-to-peak period of undulating elongate strips 110 and 114. P1 is typically in a range from about 0.005 inches (about 0.013 centimeter) to about 0.1 inches (about 0.25 centimeter), and preferably from about 0.02 inches (about 0.05 centimeter) to about 0.04 inches (about 0.1 centimeter). As described with reference to FIG. 7, larger waveforms are used in other embodiments. Yet other embodiments include other dimensions than described in this example.

Figure 7:
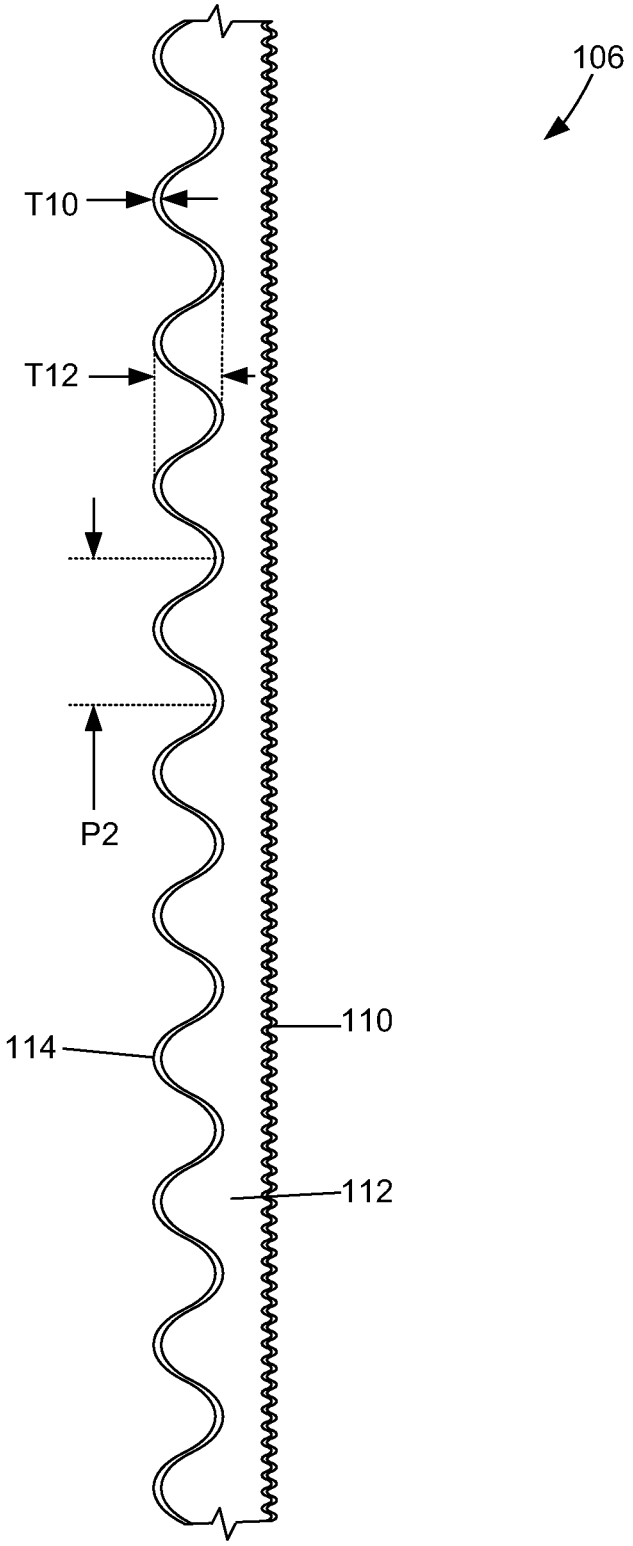
FIG. 7 is a schematic front view of a portion of another example spacer according to the present disclosure, the spacer including elongate strips having different undulating shapes.

FIG. 7 is a schematic front view of a portion of another example embodiment of spacer 106. Spacer 106 includes elongate strip 110, filler 112, and elongate strip 114. This embodiment is similar to the embodiment shown in FIG. 6, except that elongate strip 114 has an undulating shape that is much larger than the undulating shape of elongate strip 110.

In one example, elongate strip 114 has a material thickness T10. T10 is typically in a range from about 0.0001 inches (about 0.00025 centimeter) to about 0.01 inches (about 0.025 centimeter), and preferably from about 0.0003 inches (about 0.00076 centimeter) to about 0.004 inches (about 0.01 centimeter). The undulating shape of elongate strip 114 defines a waveform having a peak-to-peak amplitude and a peak-to-peak period. The peak-to-peak amplitude is also the overall thickness T12 of elongate strip 114. T12 is typically in a range from about 0.05 inches (about 0.13 centimeter) to about 0.4 inches (about 1 centimeters), and preferably from about 0.1 inches (about 0.25 centimeter) to about 0.2 inches (about 0.5 centimeter). P2 is the peak-to-peak period of large undulating elongate strip 114. P2 is typically in a range from about 0.05 inches (about 0.13 centimeter) to about 0.5 inches (about 1.3 centimeters), and preferably from about 0.1 inches (about 0.25 centimeter) to about 0.3 inches (about 0.76 centimeter). In some embodiments, the small undulating shape of elongate strip 110 has a range from about 5 to about 15 peaks per peak of the large undulating shape of elongate strip 114. In some embodiments, elongate strip 110 and elongate strip 114 are reversed, such that elongate strip 110 has a larger waveform than elongate strip 114.

Some embodiments having the large undulating elongate strip 114 benefit from increased stability. The larger undulating waveform has an overall thickness that is increased. This thickness resists torsional forces and in some embodiments provides increased resistance to compressive loads. Larger waveform elongate strip 114 can be expanded and compressed, such as to stretch to form a corner. In one embodiment, larger waveform elongate strip 114 is expandable between a first length (having the large undulating shape) and a second length (in which elongate strip 114 is substantially straight and substantially lacking an undulating shape). In some embodiments, the second length is in a range from 25 percent to about 60 percent greater than the first length, and preferably from about 30 percent to about 50 percent greater. Larger waveform elongate strip 114 also includes greater surface area per unit length of spacer 106, such as for connection with first sealant 302 and 304, second sealant 402 and 404, and filler 112. The greater surface area also provides increased strength and stability in some embodiments.

In some embodiments, portions of elongate strip 114 are connected to elongate strip 110 without filler 112 between. For example, a portion of elongate strip 114 is connected to elongate strip 110 with a fastener, such as a high adhesive, weld, rivet, or other fastener.

Although a few examples are specifically illustrated in FIGS. 5-7, it is recognized that other embodiments will include other arrangements not specifically illustrated. For example, another possible embodiment includes two large undulating elongate strips. Another possible embodiment includes a flat elongate strip combined with an undulating strip. Other combinations and arrangements are also possible to form additional embodiments.

Figure 8:
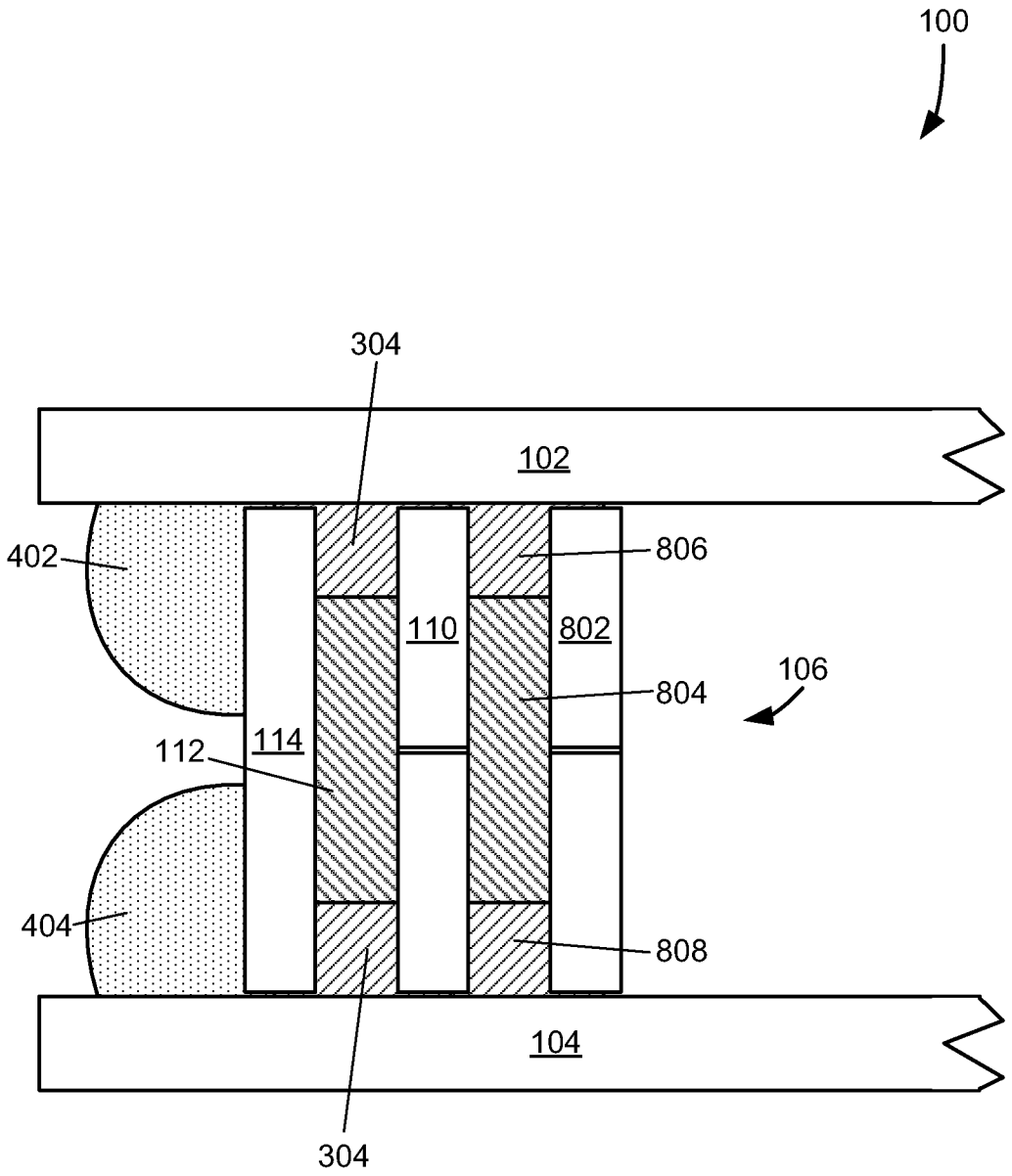
FIG. 8 is a schematic cross-sectional view of another embodiment of a sealed unit according to the present disclosure, the sealed unit including a spacer with a third elongate strip.

FIG. 8 is a schematic cross-sectional view of another embodiment of sealed unit 100. Sealed unit 100 includes sheet 102, sheet 104, and spacer 106. Spacer 106 is similar to that shown in FIG. 4 in that it includes elongate strip 110, filler 112, elongate strip 114, first sealant 302 and 304, and second sealant 402 and 404. In this embodiment, spacer 106 further includes elongate strip 802, filler 804, and sealant 806 and 808.

In some embodiments, spacer 106 includes more than two elongate strips, such as a third elongate strip 802. Elongate strip 802 can be any one of the elongate strips described herein. Elongate strip 802 includes apertures 810 that allow the passage of gas and moisture between interior space 120 and fillers 804 and 112. In some embodiments, filler 804 includes a desiccant that removes moisture from interior space 120. In other embodiments one or more of the fillers 112 and/or 804 do not include desiccant. For example, in some embodiments, filler 112 is a sealant and filler 804 includes a desiccant. In some embodiments an aperture is not included in elongate strip 110. Also, in some embodiments a separate sealant 304 is not required, such as if filler 112 is a sealant.

Some embodiments include sealant 806 and 808 that provides a seal between elongate strip 802 and filler 804. In some embodiments, sealant 806 and 808 is the same as first sealant 302 and 304. In other embodiments sealant 806 and 808 is different than first sealant 302 and 304.

Other embodiments include additional elongate strips (e.g., four, five, six, or more) and additional filler layers (e.g., three, four, five, or more).

Other possible embodiments include more than two sheets of window material (e.g., three, four, or more), such as to form a triple paned window. For example, two spacers 106 may be used to separate three sheets of glass. For example, they can be arranged in the following order: a first sheet, a first spacer, a second sheet, a second spacer, and a third sheet. In this way the second sheet is arranged between the first and second sheets and also between the first and second spacers. Any number of additional sheets can be added in the same manner to make a sealed unit including any number of sheets.

Figure 9:
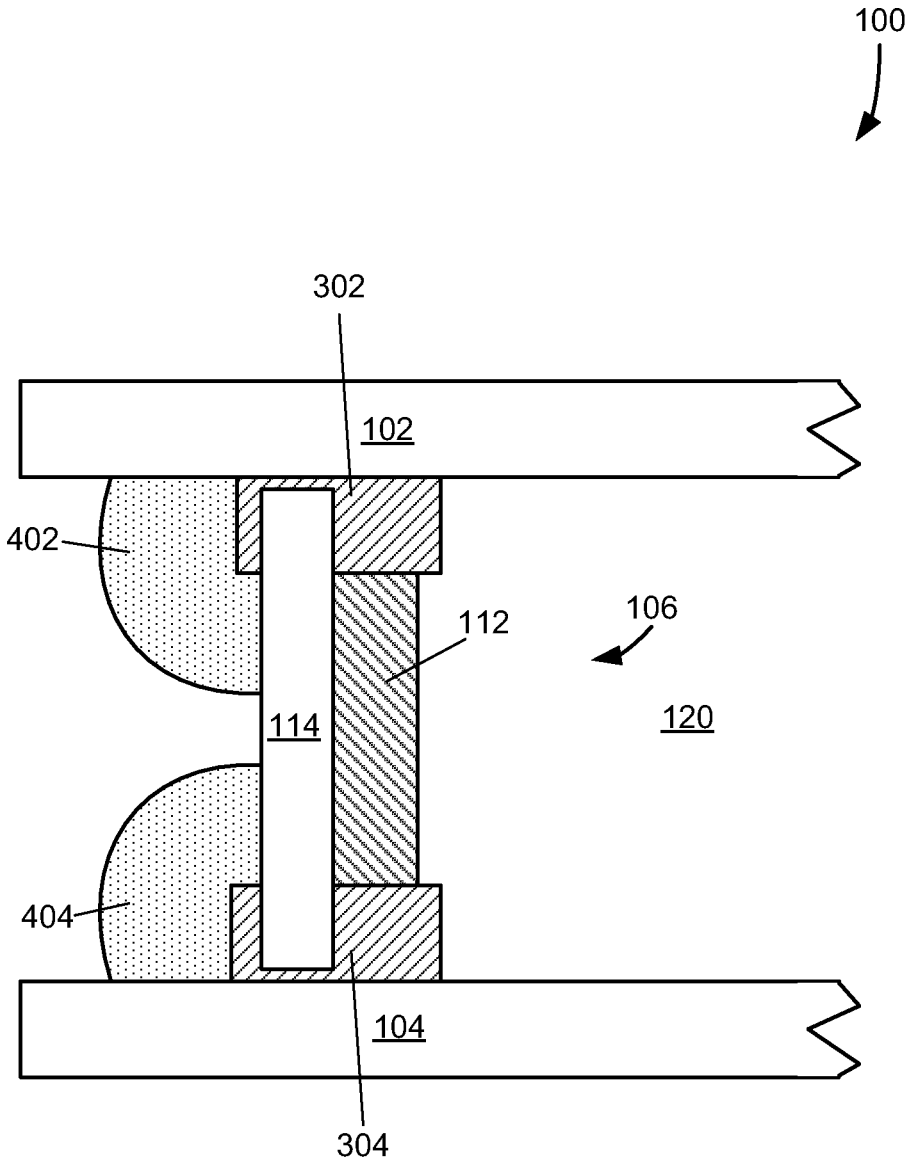
FIG. 9 is a schematic cross-sectional view of another embodiment of a sealed unit according to the present disclosure, the sealed unit including a spacer with only one elongate strip.

FIG. 9 is a schematic cross-sectional view of another embodiment of sealed unit 100. Sealed unit 100 includes sheet 102, sheet 104, and another example spacer 106. Spacer 106 is similar to that shown in FIG. 4 in that it includes elongate strip 114 and filler 112, first sealant 302 and 304, and second sealant 402 and 404. This embodiment does not include elongate strip 114. A benefit of some embodiments having a single elongate strip is increased flexibility of spacer 106. Another benefit of some embodiments having a single elongate strip is reduced thickness of spacer 106. In some embodiments, filler 112 is not included. For example, desiccant is arranged within or on sealants 302 and 304 in some embodiments. The overall thickness of spacer 106 in such an embodiment is the thickness of elongate strip 114.

Figure 10:
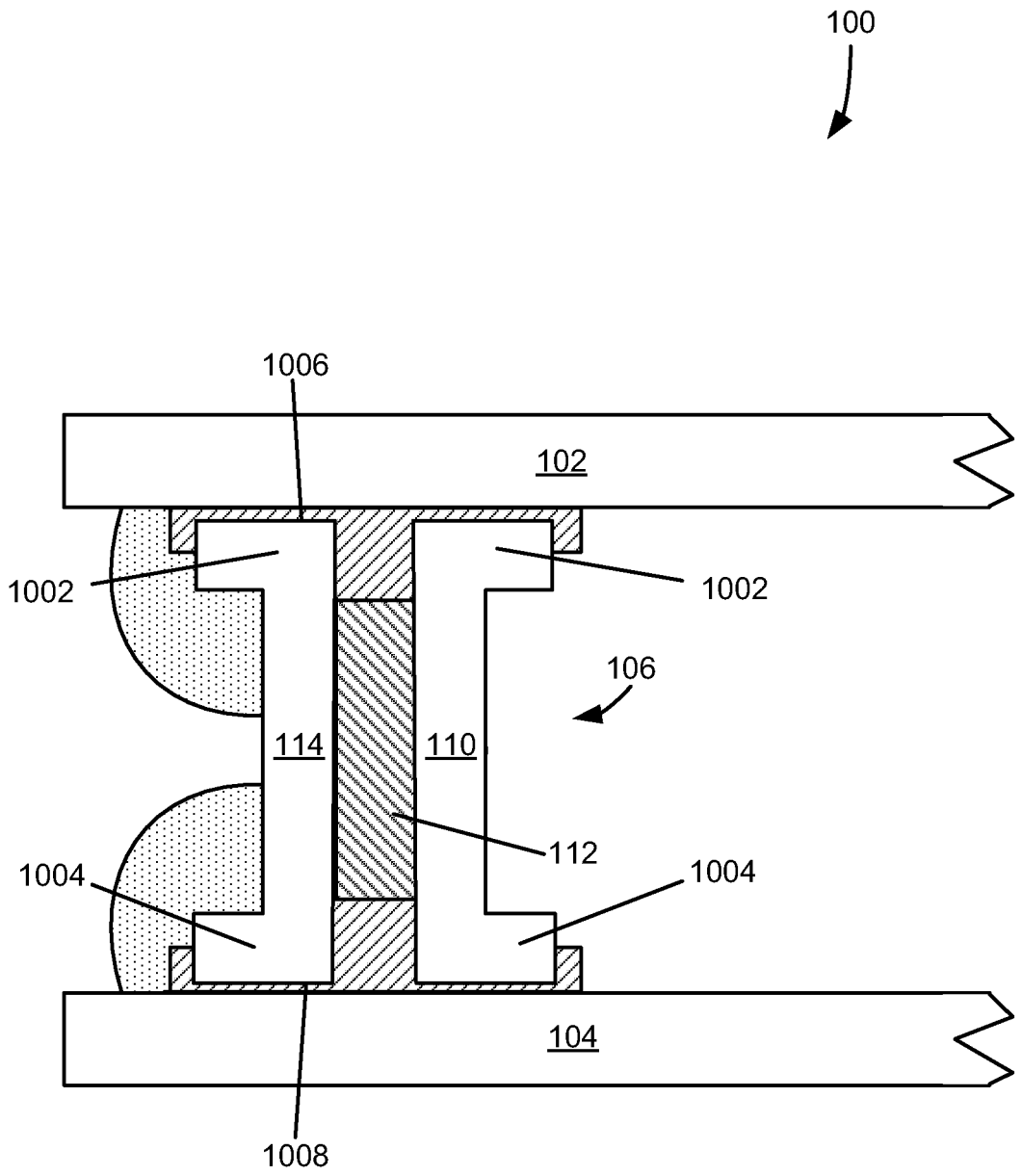
FIG. 10 is a schematic cross-sectional view of another embodiment of a sealed unit according to the present disclosure.

FIG. 10 is a schematic cross-sectional view of another embodiment of sealed unit 100. Sealed unit 100 includes sheet 102, sheet 104, and another example spacer 106. Spacer 106 is similar to that shown in FIG. 4 in that it includes elongate strip 110, filler 112, and elongate strip 114. As previously described, elongate strips 110 and 114 have an undulating shape in some embodiments and have a flat shape in other embodiments. However, in this embodiment, elongate strips 110 and 114 further include flanges 1002 and 1004.

To form flanges 1002 and 1004, elongate strips 110 and 114 are bent at about a right angle (e.g., about 90 degrees). In some embodiments flanges 1002 and 1004 are formed by passing the elongate strips 110 and 114 through a roll-former. In some embodiments the resulting elongate strips 110 and 114 have a squared C-shape. Flanges 1002 and 1004 provide increased structural stability to spacer 106, such as to resist torsional loads. Flanges 1002 and 1004 also provide increased surface area at ends 1006 and 1008. The increased surface area increases surface area for adhesion of the spacer 106 with sheets 102 and 104. Another benefit of flanges 1002 and 1004 is a force applied to sheets 102 or 104 by spacer 106 are distributed out across a larger area, reducing the load at a particular point of sheets 102 and 104. FIG. 10 illustrates an embodiment in which flanges 1002 and 1004 extend out from spacer 106. In another possible embodiment, flanges 1002 and 1004 are oriented such that they extend toward the interior of spacer 106. In another possible embodiment, one of flanges 1002 and 1004 extends toward the interior of spacer 106 and the other of flanges 1002 and 1004 extends out from spacer 106. In some embodiments, elongate strips 110 and 114 include additional bends.

Figure 11:
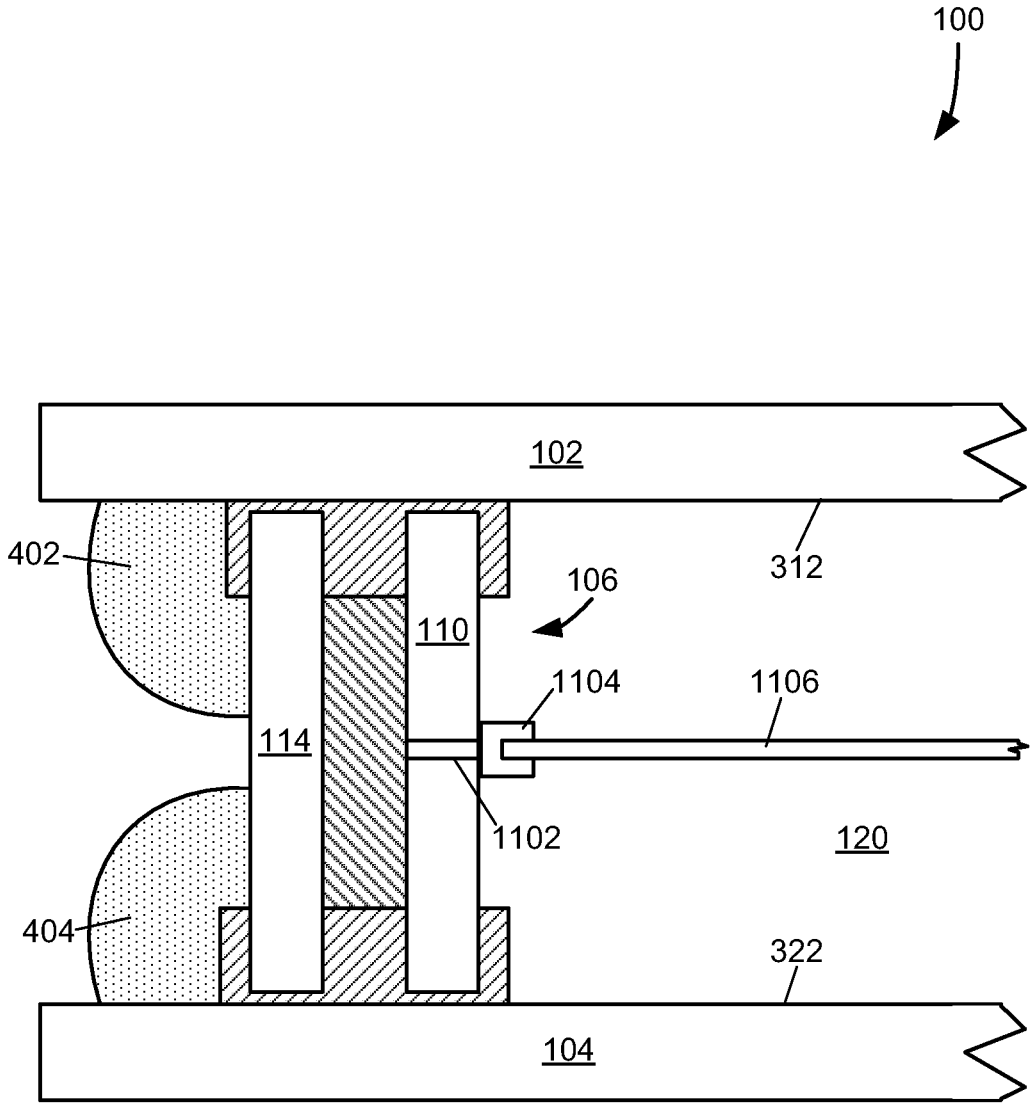
FIG. 11 is a schematic cross-sectional view of another embodiment of a sealed unit according to the present disclosure, the sealed unit including a spacer having an intermediary member.

FIG. 11 is a schematic cross-sectional view of another embodiment of sealed unit 100. Sealed unit 100 includes sheet 102, sheet 104, and another example spacer 106. Spacer 106 is similar to that shown in FIG. 4 in that it includes elongate strip 110, filler 112, elongate strip 114, first sealant 302 and 304, and second sealant 402 and 404. In this embodiment, spacer 106 further includes fastener aperture 1102, fastener 1104, and intermediary member 11106.

In some embodiments additional components can be attached to spacer 106. Connection to spacer 106 can be accomplished in various ways. One way is to punch or cut apertures 1102 in elongate strip 110 of spacer 106 at the desired location(s). In some embodiments, apertures 1102 are slots, slits, holes, and the like. A fastener 1102 is then inserted into the aperture and connected to elongate strip 110. One example of a fastener 1102 is a screw. Another example is a pin. Another example of fastener 1102 is a tab. Apertures 1102 are not required in all embodiments. For example, in some embodiments, fastener 1104 is an adhesive that does not require an aperture 1102. Other embodiments include a fastener 1104 and an adhesive. Some fasteners 1104 are arranged and configured to connect with an intermediary member 1106, to connect the intermediary member 1106 to spacer 106. One such example of a fastener 1104 is a muntin bar clip.

In one embodiment, intermediary member 1106 is a sheet of glass or plastic, such as to form a triple-paned window. In another embodiment, intermediary member is a film or plate. For example, intermediary member 1106 is a film or plate of material that absorbs ultraviolet radiation, thereby warming interior space 120. In another embodiment, intermediary member 1106 reflects ultraviolet radiation, thereby warming interior space 120. In some embodiments, intermediary member 1106 divides interior space into two or more regions. Intermediary member 1106 is or includes biaxially-oriented polyethylene terephthalate, such as MYLAR® brand film, manufactured by DuPont Teijin Films, in some embodiments. In another embodiment, intermediary member 1106 is a muntin bar. Intermediary member 1106 acts, in some embodiments, to provide additional support to spacer 106. A benefit of some embodiments, such as shown in FIG. 11, is that the addition of intermediary member 1106 does not require additional spacers 106 or sealants.

FIG. 12 is a schematic cross-sectional view of another embodiment of sealed unit 100. Sealed unit 100 includes sheet 102, sheet 104, and another example of spacer 106. Spacer 106 is similar to that shown in FIG. 4 in that it includes elongate strip 110, filler 112, elongate strip 114, first sealant 302 and 304, and second sealant 402 and 404. In this embodiment, elongate strip 110 is divided into an upper strip 1202 and a lower strip 1204. Between upper strip 1202 and lower strips 1204 is thermal break 1210.

In this embodiment, elongate strip 110 is divided into two strips that are separated by thermal break 1210. The separation of elongate strip 110 by thermal break 1210 further reduces heat transfer through elongate strip 110 to improve the insulating properties of spacer 106. For example, if sheet 102 is adjacent a relatively cold space and sheet 104 is adjacent a relatively warm space, some heat transfer may occur through elongate strip 114. Thermal break 1210 reduces the heat transfer through elongate strip 114. Thermal break 1210 typically extends along the entire length of elongate strip 110. However, in another embodiment thermal break 1210 extends longitudinally through a portion or multiple portions of elongate strips 110.

Thermal break 1210 is preferably made of a material with low thermal conductivity. In one embodiment, thermal break 1210 is a fibrous material, such as paper or fabric. In other embodiments, thermal break 1210 is an adhesive, sealant, paint, or other coating. In yet other embodiments, thermal break 1210 is a polymer, such as plastic. Further embodiments include other materials, such as metal, vinyl, or any other suitable material. In some embodiments, thermal break 1210 is made of multiple materials, such as paper coated with an adhesive or sealant material on both sides to adhere the paper to elongate strip 110.

Alternate embodiments divide both of elongate strips 110 or 114 into upper and lower strips and include a thermal break therebetween. In another embodiment, only elongate strip 114 has a thermal break. Another alternative embodiment divides one or more elongate strips into at least three strips, and includes more than one thermal break.

Figure 13:
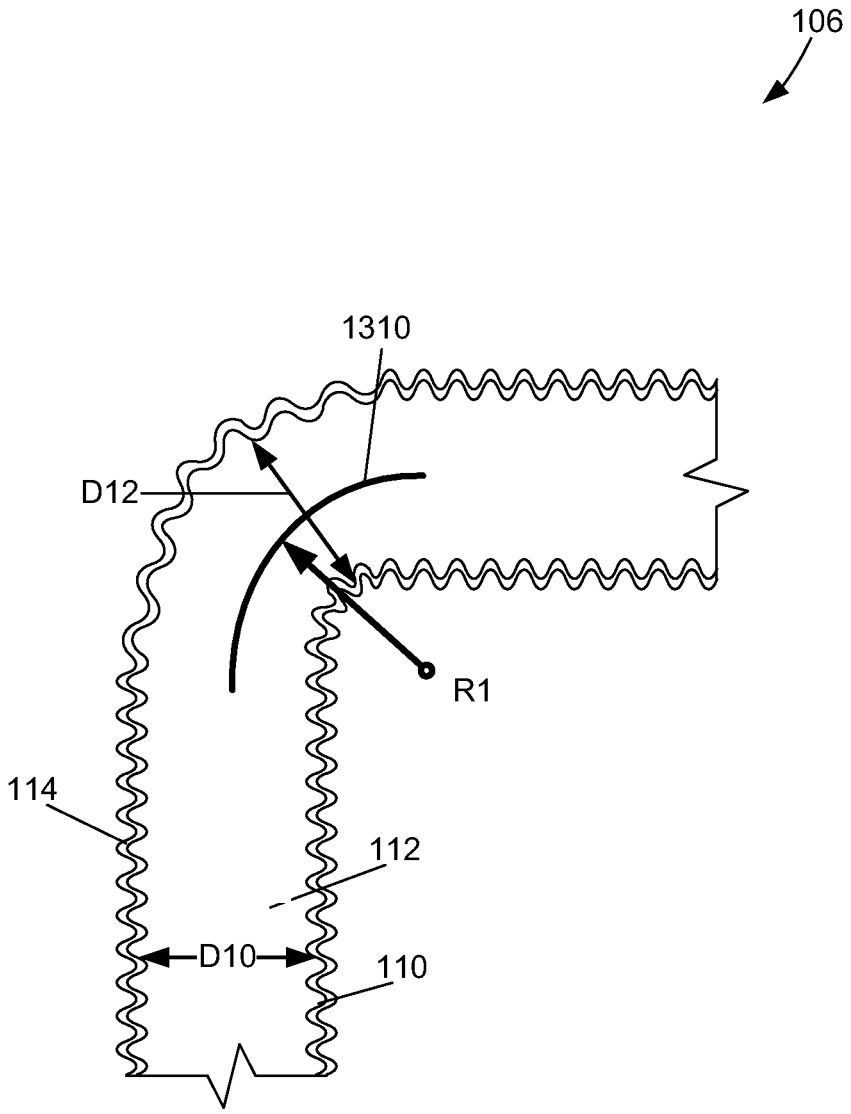
FIG. 13 is a schematic front view of a portion of the example spacer shown in FIG. 6 arranged in a corner configuration to illustrate one dimension of flexibility.

FIG. 13 is schematic front view of a portion of spacer 106, such as shown in FIG. 6. Spacer 106 includes elongate strip 110, filler 112, and elongate strip 114. In this embodiment, elongate strips 110 and 114 have an undulating shape. The portion of spacer 106 is shown arranged as a corner (e.g., corner 122 shown in FIG. 1), such that part of the spacer 106 is oriented about ninety degrees from another part of the spacer 106. Some embodiments of spacer 106 are able to form a corner without being damaged (e.g., kinking, fracturing, etc.).

In this example, elongate strips 110 and 114 include an undulating shape. As a result, elongate strips 110 and 114 are capable of expanding and compressing as necessary. The undulating shape is able to expand by stretching. In the illustrated example, elongate strip 114 has been expanded to form the corner. In some embodiments, the undulating shape of elongate strips 110 and 114 is expandable from a first length (having an undulating shape) to a second length (at which point the elongate strip is substantially flat and without an undulating shape). The second length is typically in a range from about 5 percent to about 25 percent longer than the first length, and preferably from about 10 percent to about 20 percent longer than the first length. The stretch length can be increased by increasing the amplitude of the undulations of unstretched elongate strips 110 and 114, thereby providing additional length of material for stretching.

In some embodiments, the undulating shape of elongate strips 110 and 114 is also compressible. The illustrated embodiment shows elongate strip 110 slightly compressed.

In some embodiments, spacer 106 has bending flexibility as shown. For example, a radius of curvature (as measured from a centerline 1310 of spacer 106, is typically in a range from about 0.05 inches (about 0.13 centimeter) to about 0.5 inches (about 1.3 centimeters), and preferably from about 0.05 inches (about 0.13 centimeter) to about 0.25 inches (about 0.6 centimeter) without undesired kinking or fracture to elongate strips 110 and 114. In other embodiments, the radius of curvature in spacer 106 is also attainable without permanently damaging filler 112, such as by causing cracking or forming air gaps in filler 112.

In some embodiments, the distance between first and second elongate strips 110 and 114 is substantially constant without significant narrowing at the corner. For example, D10 is the distance between elongate strip 110 and elongate strip 114 in a substantially linear portion of spacer 106. D12 is the distance between elongate strip 110 and elongate strip 114 in a portion of spacer 106 that has been formed into about a 90 degree corner. In some embodiments, D12 is in a range from about 95% to about 100% of D10. In other embodiments, D12 is in a range from about 75% to about 100% of D10. As a result of the substantially constant thickness of spacer 106, spacer has substantially constant thermal properties in linear portions and non-linear portions, such as corners.

Figure 14:
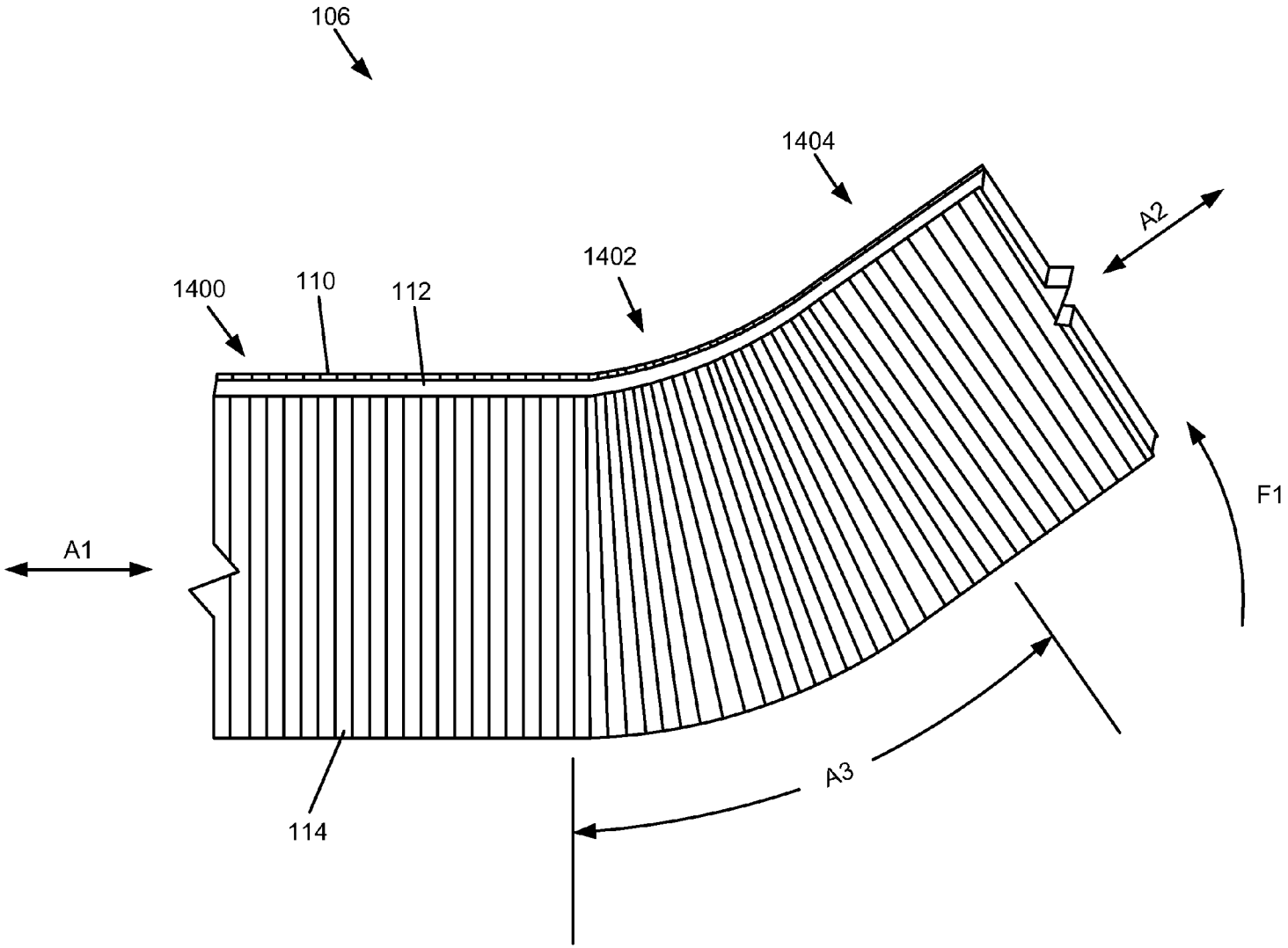
FIG. 14 is a schematic perspective side view of the portion of the example spacer shown in FIG. 6 and illustrating another dimension of flexibility.

FIG. 14 is a schematic perspective side view of a portion of an example spacer 106, further illustrating the flexibility of spacer 106. Spacer 106 includes elongate strip 110, filler 112, and elongate strip 114. In this embodiment, elongate strips 110 and 114 have an undulating shape, such as shown in FIGS. 6 and 13. The portion of spacer 106 includes three regions, including a first region 1400, a second region 1402, and a third region 1404. The second region 1402 is between the first region 1400 and the third region 1404.

The undulating shape of elongate strips 110 and 114 give spacer 106 flexibility in all three dimensions including bending flexibility in two dimensions as well as stretching and compression flexibility in a third dimension. The undulating shape of elongate strips 110 and 114 further provides spacer 106 with a twisting (e.g. torsional) flexibility about the longitudinal axis.

In addition to the cornering flexibility illustrated in FIG. 13, spacer 106 also exhibits a lateral flexibility illustrated in FIG. 14. In this example, first region 1400 extends substantially straight along a longitudinal axis A1. A third region 1404 of spacer 106 is bent such that third region 1404 is substantially straight along a longitudinal axis A2. Upon bending of third region 1404, second region 1402 is also bent and has a curved shape.

Bending of third region 1404 is accomplished by applying a force in the direction of arrow F1 to third region 1404 while maintaining first region 1400 fixed in alignment with axis A1. The force causes spacer 106 to bend, as shown.

When the force in direction F1 is applied to third region 1404, elongate strips 110 and 114 bend. Upon bending, the undulating shape of elongate strips 110 and 114 changes. Elongate strips 110 and 114 are capable of extending at one edge (thereby decreasing the amplitude of the undulations in that region). As a result, spacer 106 bends in the direction of arrow F1. In another embodiment, the undulating shape contracts on one side, thereby increasing the amplitude of the undulations. Such contraction allows spacer 106 to bend in the direction of arrow F1. In another embodiment, bending causes both a contraction of the undulations on one end and an extension of the undulations at another end.

In some embodiments, first region 1400 and third region 1404 are bent to form an angle A3, without damaging spacer 106. Angle A3 is the difference between the direction of axis A1 and axis A2. In one example, A3 is in a range from about 0 degrees to about 90 degrees, and preferably from about 15 degrees to about 45 degrees. In some embodiments, A3 is measured per unit of length prior to bending (such as the pre-bend length of second region 1402). In such embodiments, A3 is in a range from about 1 degree to about 30 degrees per inch of length, and preferably from about 2 degrees to about 10 degrees per inch of length.

Although FIGS. 13 and 14 each illustrate bending in only one direction, spacer 106 is capable of bending in multiple directions at once. Furthermore, spacer 106 is also capable of stretching and twisting without causing permanent damage to spacer 106, such as buckling, cracking, or breaking.

Figure 15:
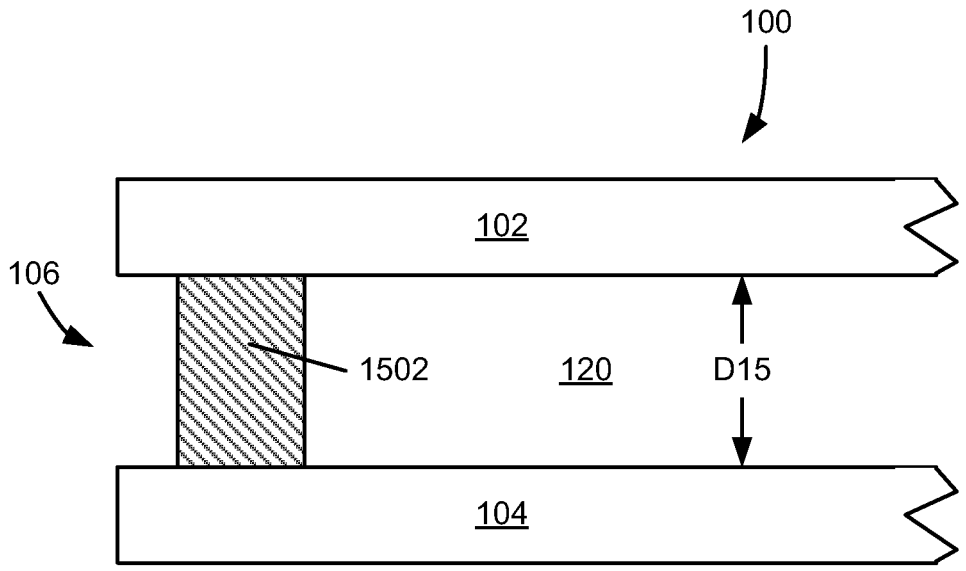
FIG. 15 is a schematic cross-sectional view of another example sealed unit according to the present disclosure, the sealed unit including a spacer having a single layer of filler material.
Figure 16:
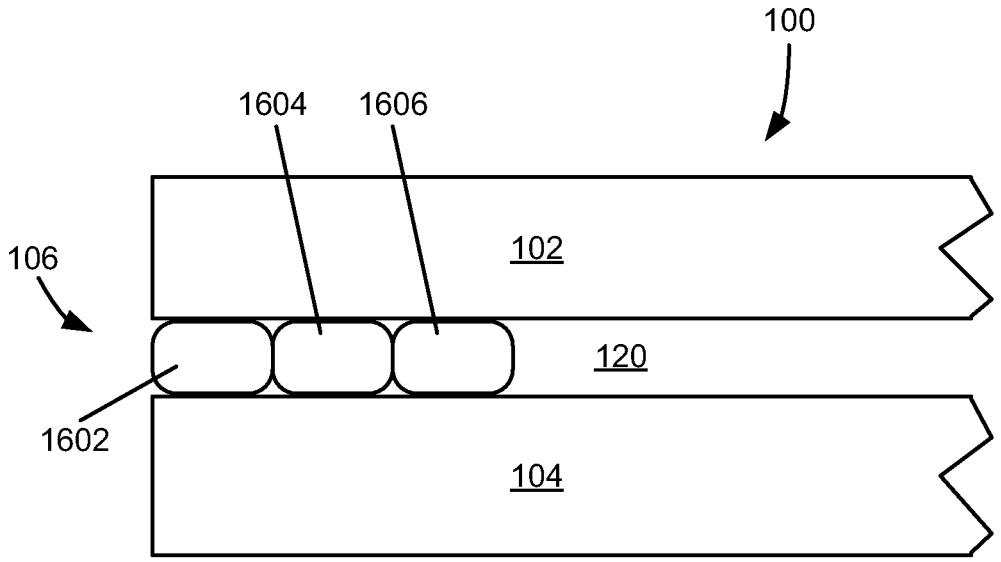
FIG. 16 is a schematic cross-sectional view of another example sealed unit according to the present disclosure, the sealed unit including a spacer having two layers of filler material.

FIGS. 15 and 16 illustrate alternate embodiments of spacers 106 that do not include elongate strips. In some embodiments, spacers 106 provide for a low profile unit. FIG. 15 is a schematic cross-sectional view of another example sealed unit 100. Sealed unit 100 includes sheet 102, sheet 104, and another example spacer 106. Sealed unit defines interior space 120.

In this embodiment, spacer 106 includes filler material 1502. Filler material acts to provide a seal around interior space 120. Filler material 1502 may be any of the filler materials or sealants described herein or combinations thereof. In some embodiments filler material 1502 includes multiple layers. In some embodiments, filler material 1502 is a horizontal stack or a vertical stack. Additional sealant or other material layers are included in spacer 106 in some embodiments, such as shown in FIG. 16.

In some embodiments, sealed unit 100 has a distance D15 between sheets 102 and 104 that is small. In some embodiments, D15 is in a range from about 0.01 inches (about 0.025 centimeter) to about 0.08 inches (about 0.2 centimeter), and preferably from about 0.02 inches (about 0.05 centimeter) to about 0.06 inches (about 0.15 centimeter).

FIG. 16 is a schematic cross-sectional view of another example sealed unit 100. Sealed unit 100 includes sheet 102, sheet 104, and another example spacer 106. Sealed unit defines interior space 120. In some embodiments, spacer 106 has a low profile, thereby resulting in a low profile sealed unit 100.

In this embodiment, spacer 106 includes a first bead 1602, a second bead 1604, and a third bead 1606. Some embodiments include more or fewer beads. In one example, first bead 1602 is a secondary sealant (such as dual seal equivalent, silicone, or other primary sealant), second bead 1604 is a primary sealant (such as polyisobutylene, dual seal equivalent, or other primary sealant), and third bead 1606 is a matrix desiccant or other desiccant.

In this configuration, the matrix desiccant of third bead 1606 is in communication with interior space 120 to remove moisture from interior space 120. Primary sealant of second bead 1604 provides a first seal to separate interior space from external gas and moisture and to insulate the interior space. Secondary sealant of third bead 1606 provides a second seal to further separate interior space from external gas and moisture and to insulate the interior space. Spacer 106 also acts to connect first and second sheets 102 and 104 together while maintaining a substantially constant spacing between the sheets 102 and 104 in some embodiments. In some embodiments the thickness of spacer 106 is shown to scale in FIG. 16 with respect to the thickness of first and second sheets 102 and 104. Other embodiments include other thicknesses of spacer 106 or sheets 102 and 104.

Other embodiments include more or fewer beads (e.g., one, two, three, four, five, six, or more). For example another possible embodiment includes only one of the first and second beads. In another possible embodiment, the third bead is not included. Other embodiments include other arrangements of one or more of first, second, and third beads 1602, 1604, 1606 and other beads or layers.

A multi-layered filler that is arranged as shown in FIG. 16 is sometimes referred to herein as a vertical stack. In some embodiments a vertical stack is used in place of a single filler layer in other embodiments discussed herein. In some embodiments a vertical stack includes one or more elongate strips or one or more wires.

In some embodiments, beads 1602, 1604, and 1606 are applied with a caulk gun or other devices for applying sealants, adhesives, and/or matrix materials. In other embodiments a nozzle, such as in manufacturing jig 2600 shown in FIG. 26 (or jig 3900 shown in FIG. 43, or jig 4600 shown in FIGS. 46-47, or other manufacturing jigs) are used to apply one or more beads to a sheet. In some embodiments, jigs are modified so as to not include spacer guides. In other embodiments, spacer guides act to ensure proper spacing between the nozzle and the sheet to which the bead is being applied.

Figure 17:
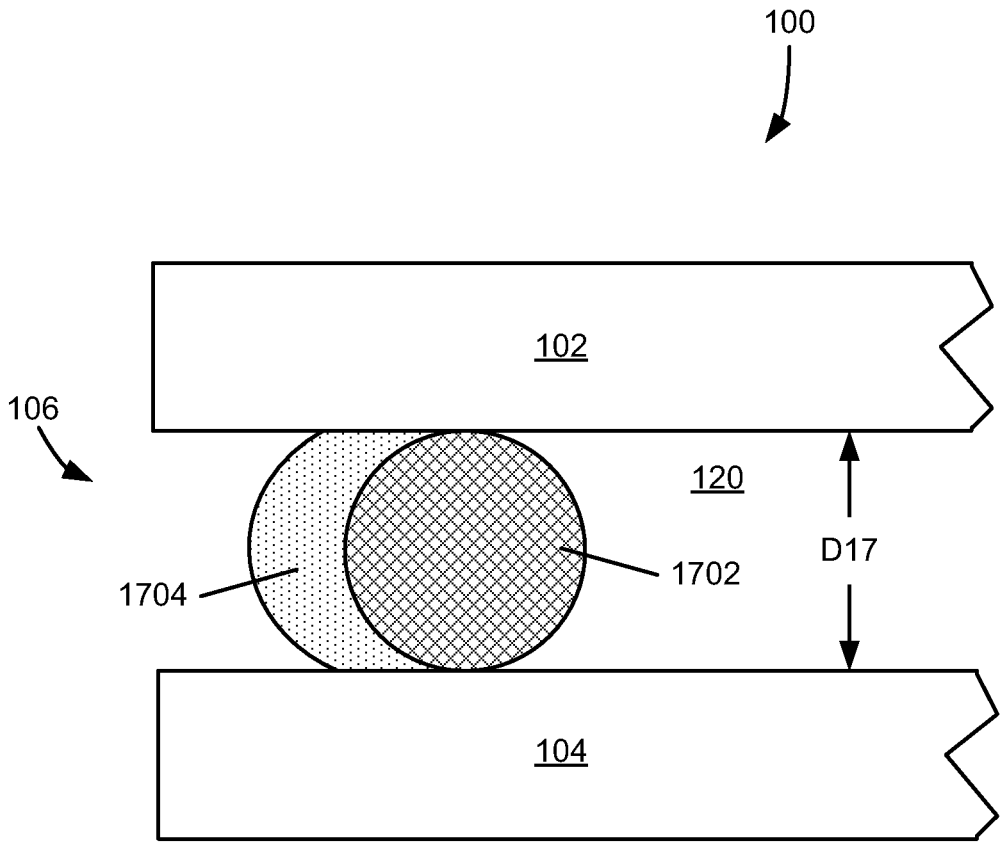
FIG. 17 is a schematic cross-sectional view of another example sealed unit according to the present disclosure, the sealed unit including a spacer including a wire.

FIG. 17 is a schematic cross-sectional view of another example sealed unit 100. Sealed unit 100 includes sheet 102, sheet 104, and another example spacer 106. Example spacer 106 includes wire 1702 and sealant 1704.

In some embodiments, sealed unit 100 has a distance D17 between sheets 102 and 104 that is too large to be supported by sealant or filler alone. In this embodiment, distance D17 is in a range from about 0.04 inches (about 0.1 centimeter) to about 0.25 inches (about 0.6 centimeter), and preferably from about 0.08 inches (about 0.2 centimeter) to about 0.2 inches (about 0.5 centimeter). D17 is also the diameter of wire 1702. In some embodiments wire 1702 is in a range from about 12 American Wire Gauge (AWG) to about 4 AWG.

In this embodiment, wire 1702 is provided to maintain the desired space (distance D17) between sheets 102 and 104. In some embodiments, wire 1702 is made of a metal or combination of metals. In other embodiments other materials are used, such as a fibrous material, plastic, or other materials. In another embodiment, wire 1702 is plastic with a metal jacket. The metal jacket acts as a moisture barrier to prevent moisture from getting into the interior space 120.

In some embodiments, wire 1702 has a circular cross-sectional shape. In other embodiments, wire 1702 has other cross-sectional shapes, such as square, rectangular, elliptical, hexagonal, or other regular or irregular shapes.

Figure 18:
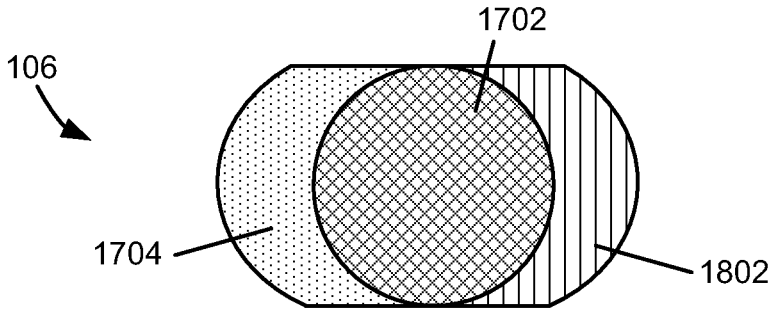
FIG. 18 is a schematic cross-sectional view of another example spacer according to the present disclosure.
Figure 19:
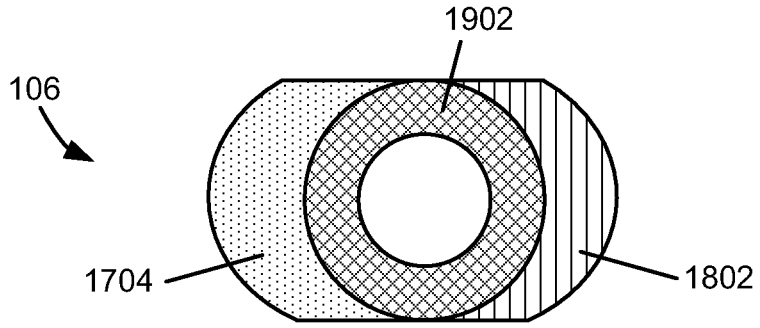
FIG. 19 is a schematic cross-sectional view of another example spacer according to the present disclosure.
Figure 20:
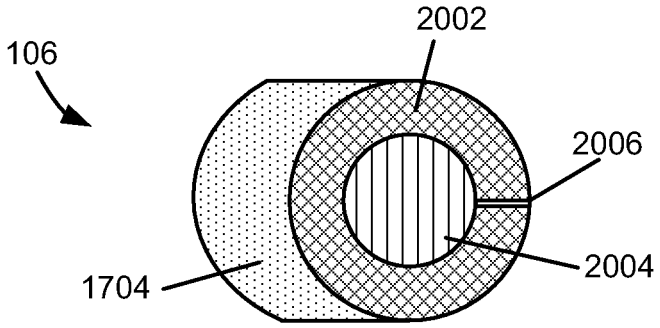
FIG. 20 is a schematic cross-sectional view of another example spacer according to the present disclosure.

FIGS. 18-20 illustrate further example embodiments of spacer 106 including a wire.

FIG. 18 is a schematic cross sectional view of another example spacer 106. Spacer 106 includes wire 1702, sealant 1704, and further includes filler 1802. Filler 1802 is any of the filler materials described herein, such as a matrix desiccant or a sealant.

FIG. 19 is a schematic cross sectional view of another example spacer 106. Spacer 106 includes wire 1902, sealant 1704, and filler 1802. Spacer 106 is the same as the spacer shown in FIG. 18, except that wire 1902 is a hollow tube. By making wire 1902 hollow, the material cost for wire 1902 is reduced.

FIG. 20 is a schematic cross sectional view of another example spacer 106. Spacer 106 includes wire 2002, sealant 1704, and filler 2004. Wire 2002 includes aperture 2006.

Spacer 106 shown in FIG. 20 is the same as spacer 106 shown in FIG. 19; except that wire 2002 includes aperture 2006 and that filler 2004 is arranged within wire 2002. Aperture 2006 extends through wire 2002 to allow moisture and gas from an interior space to pass through wire 2002 and communicate with filler 2004. In some embodiments, filler 2004 includes a desiccant.

FIGS. 21-25 illustrate example embodiments of joints 124 (such as shown in FIG. 1) that can be used to connect ends 126 and 128 of spacer 106 (or multiple spacers 106) together. Only a portion of spacer 106 near joint 124 is illustrated.

Figure 21:
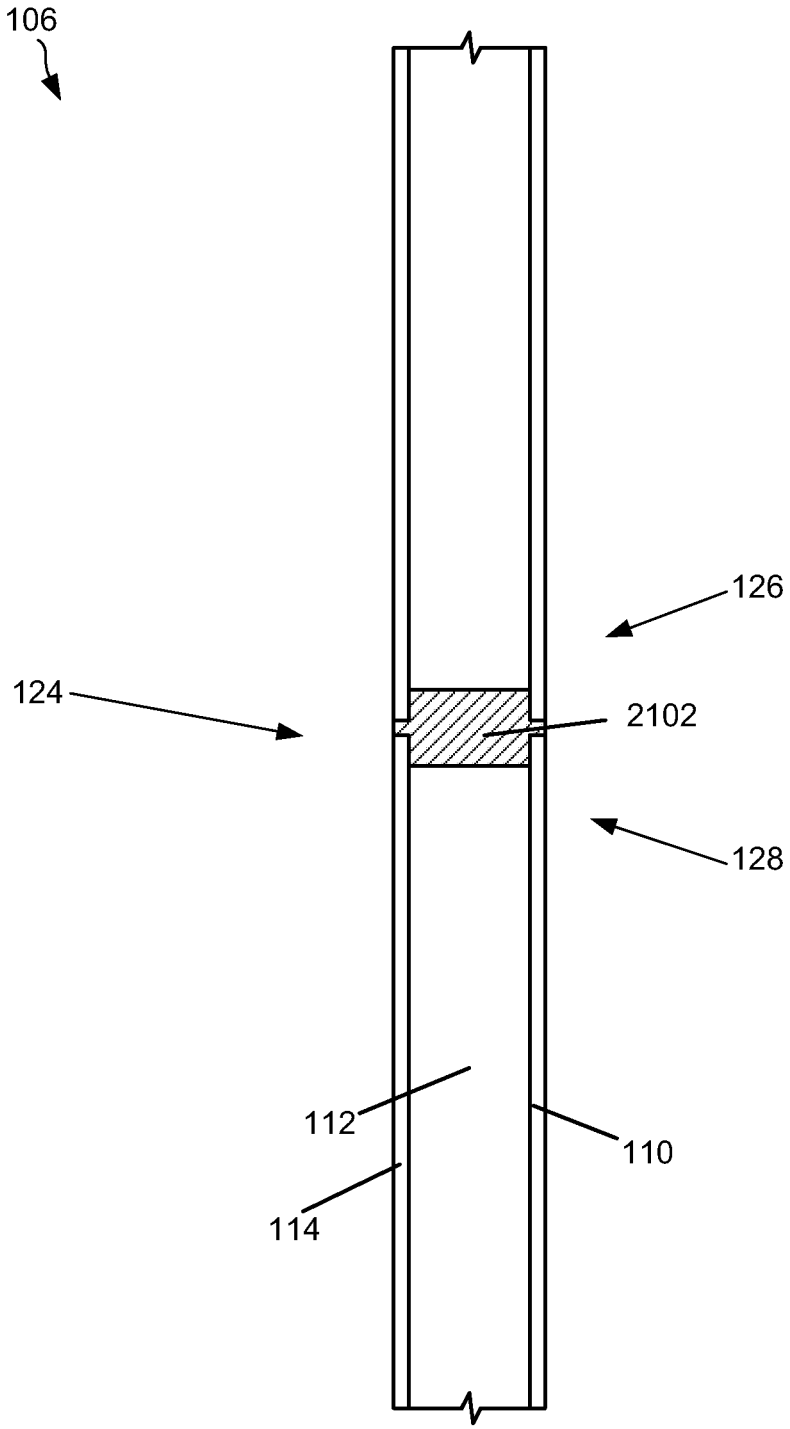
FIG. 21 is a schematic front view of an example butt joint according to the present disclosure for connecting ends of a spacer of a sealed unit, such as shown in FIG. 1.

FIG. 21 is a schematic front view of an example joint 124 for connecting first and second ends 126 and 128 of spacer 106 together. Spacer includes elongate strip 110, filler 112, and elongate strip 114. In this example, joint 124 is a butt joint. Joint 124 includes adhesive 2102. In some embodiments, adhesive 2102 is a sealant.

In this embodiment, a joint is formed by applying adhesive 2102 onto first and second ends 126 and 128 and pressing first and second ends 126 and 128 together. Adhesive 2102 forms an air tight seal at joint 124.

Figure 22:
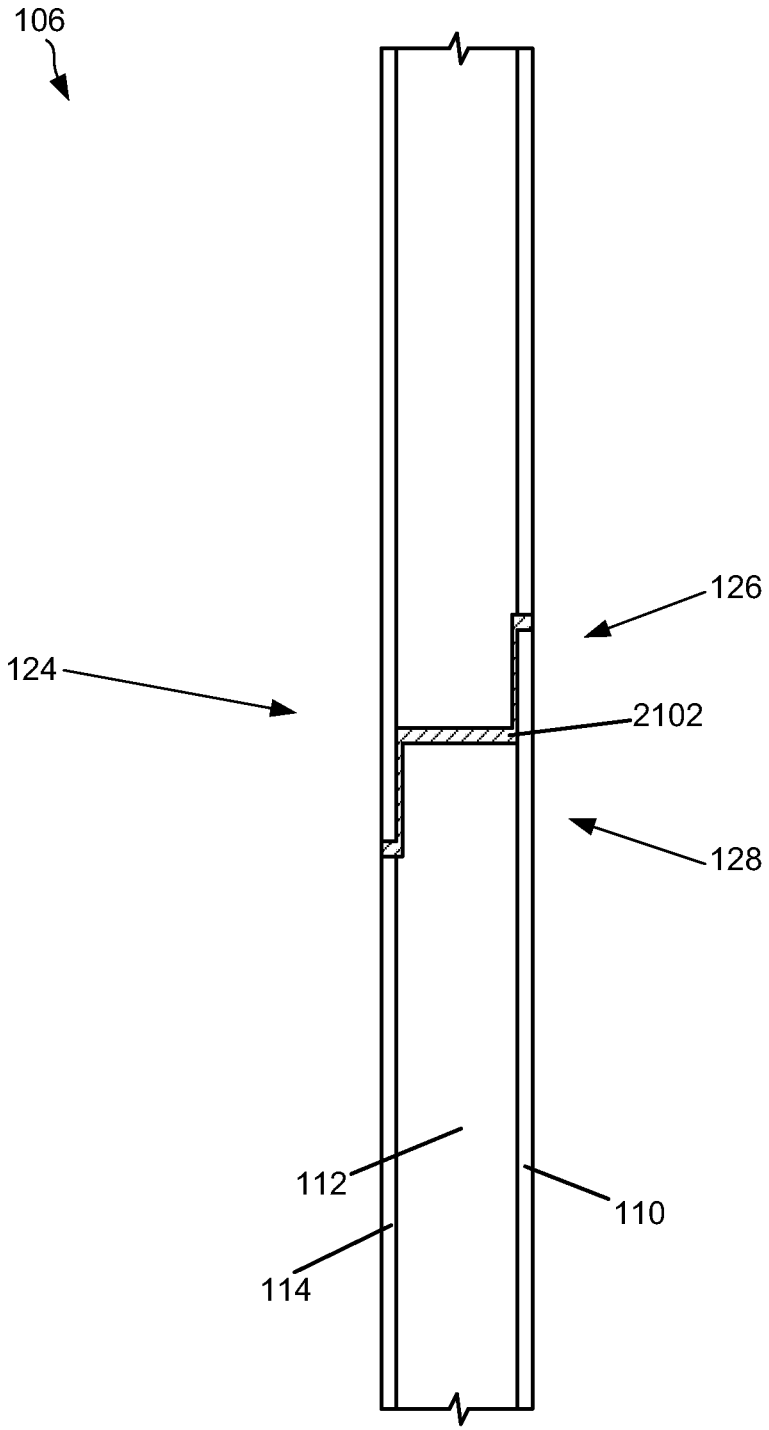
FIG. 22 is a schematic front view of an example offset joint according to the present disclosure for connecting ends of a spacer of a sealed unit, such as shown in FIG. 1.

FIG. 22 is a schematic front view of an example joint 124 for connecting first and second ends 126 and 128 of spacer 106 together. Spacer includes elongate strip 110, filler 112, and elongate strip 114. In this example, joint 124 is an offset joint. Joint 124 includes adhesive 2102.

In this embodiment, elongate strips 110 and 114 are formed so that they are offset from each other. For example, elongate strip 110 protrudes out from second end 128 but is recessed from first end 126. Elongate strip 114, however, is recessed from second end 126 and protrudes out from first end 126. The protrusions of each elongate strip 110 and 114 fit into the recess of the same elongate strip 110 and 114. Adhesive 2102 is applied between the joint to connect first end 126 with second end 128. An advantage of this embodiment is increased surface area for adhesion as compared to the butt joint shown in FIG. 21. Another advantage of this embodiment is that the profile of spacer 106 is relatively uniform at joint 124.

Figure 23:
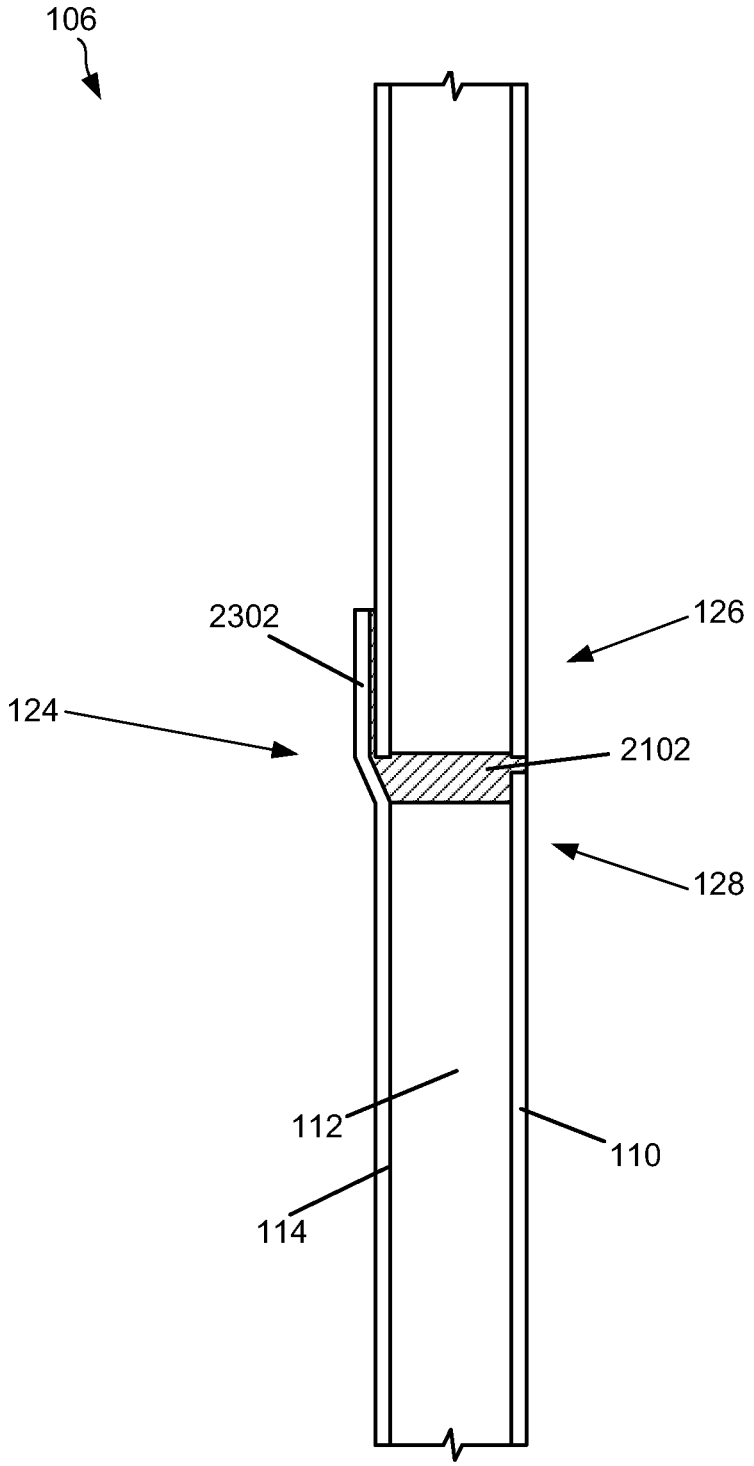
FIG. 23 is a schematic front view of an example single overlapping joint according to the present disclosure for connecting ends of a spacer of a sealed unit, such as shown in FIG. 1.

FIG. 23 is a schematic front view of an example joint 124 for connecting first and second ends 126 and 128 of spacer 106 together. Spacer includes elongate strip 110, filler 112, and elongate strip 114. In this example, joint 124 is a single overlapping joint. Joint 124 includes adhesive 2102.

This embodiment is the same as the butt joint shown in FIG. 21, except that second elongate strip 114 protrudes out from second end 128 to form flap 2302. The joint is connected by applying an adhesive between first end 126 and second end 128, and also along a side of flap 2302. The first and second ends 126 and 128 are then pressed together and flap 2302 is arranged to overlap a portion of elongate strip 114 at second end 126. Flap 2302 provides a secondary seal in addition to the primary seal formed by the butt joint between the first and second ends 126 and 128. In addition, flap 2302 provides increased surface area for adhesion.

Figure 24:
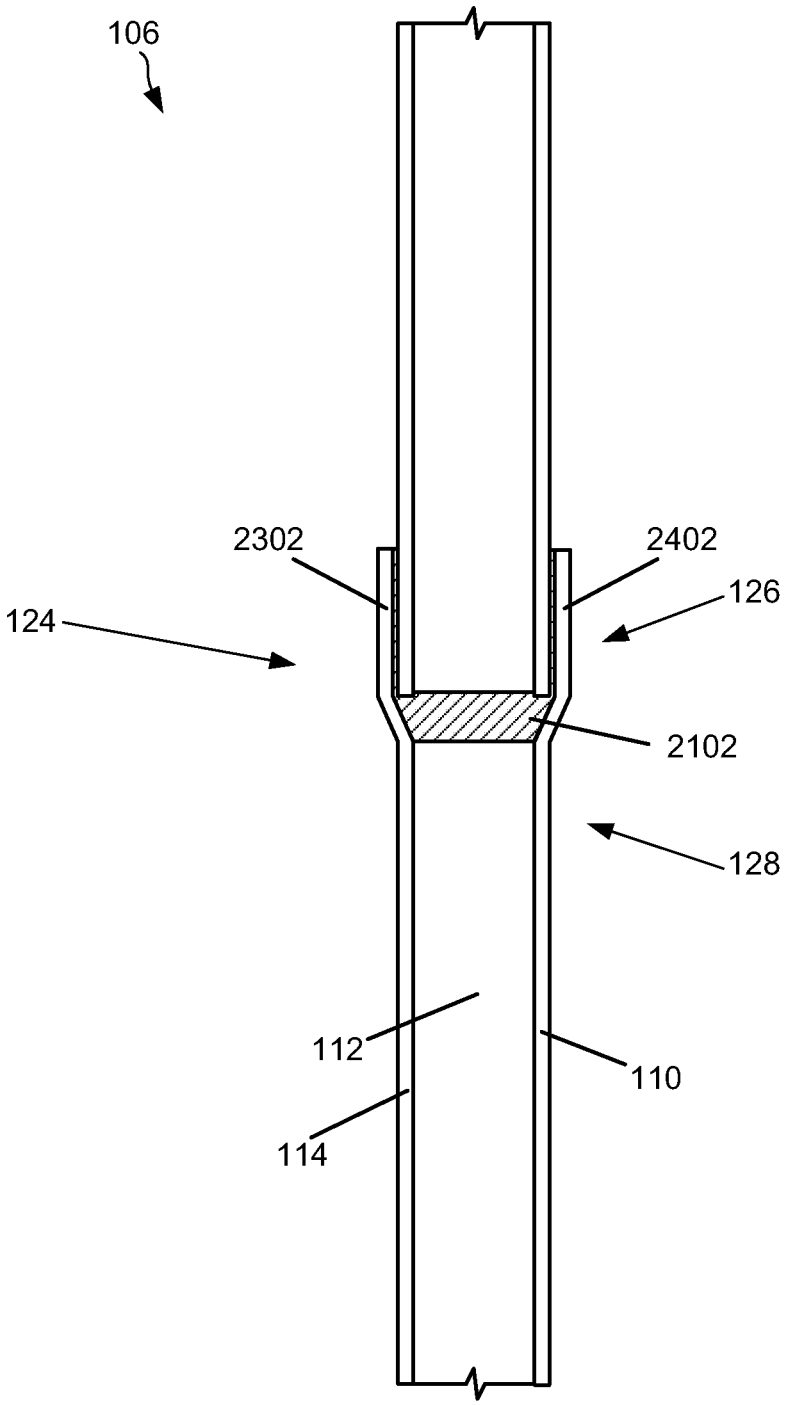
FIG. 24 is a schematic front view of an example double overlapping joint according to the present disclosure for connecting ends of a spacer of a sealed unit, such as shown in FIG. 1.

FIG. 24 is a schematic front view of an example joint 124 for connecting first and second ends 126 and 128 of spacer 106 together. Spacer 106 includes elongate strip 110, filler 112, and elongate strip 114. In this example, joint 124 is a double overlapping joint. Joint 124 includes adhesive 2102.

This embodiment is the same as the embodiment shown in FIG. 23, except for the addition of flap 2402. The double overlapping joint includes flap 2302 and 2402. To connect the joint, adhesive 2102 is applied between first and second ends 126 and 128 of spacer 106 and on adjacent sides of flaps 2302 and 2402. First and second ends 126 and 128 are pressed together to form a butt joint. Next, flaps 2302 and 2402 are pressed onto adjacent portions at the first end 126 of elongate strips 114 and 110, respectively. Flaps 2302 and 2402 provide two secondary seals in addition to the primary seal of the butt joint to form an air and moisture resistant seal. In addition, flaps 2302 and 2402 provide additional surface area for adhesion to further increase the strength of the joint.

Figure 25:
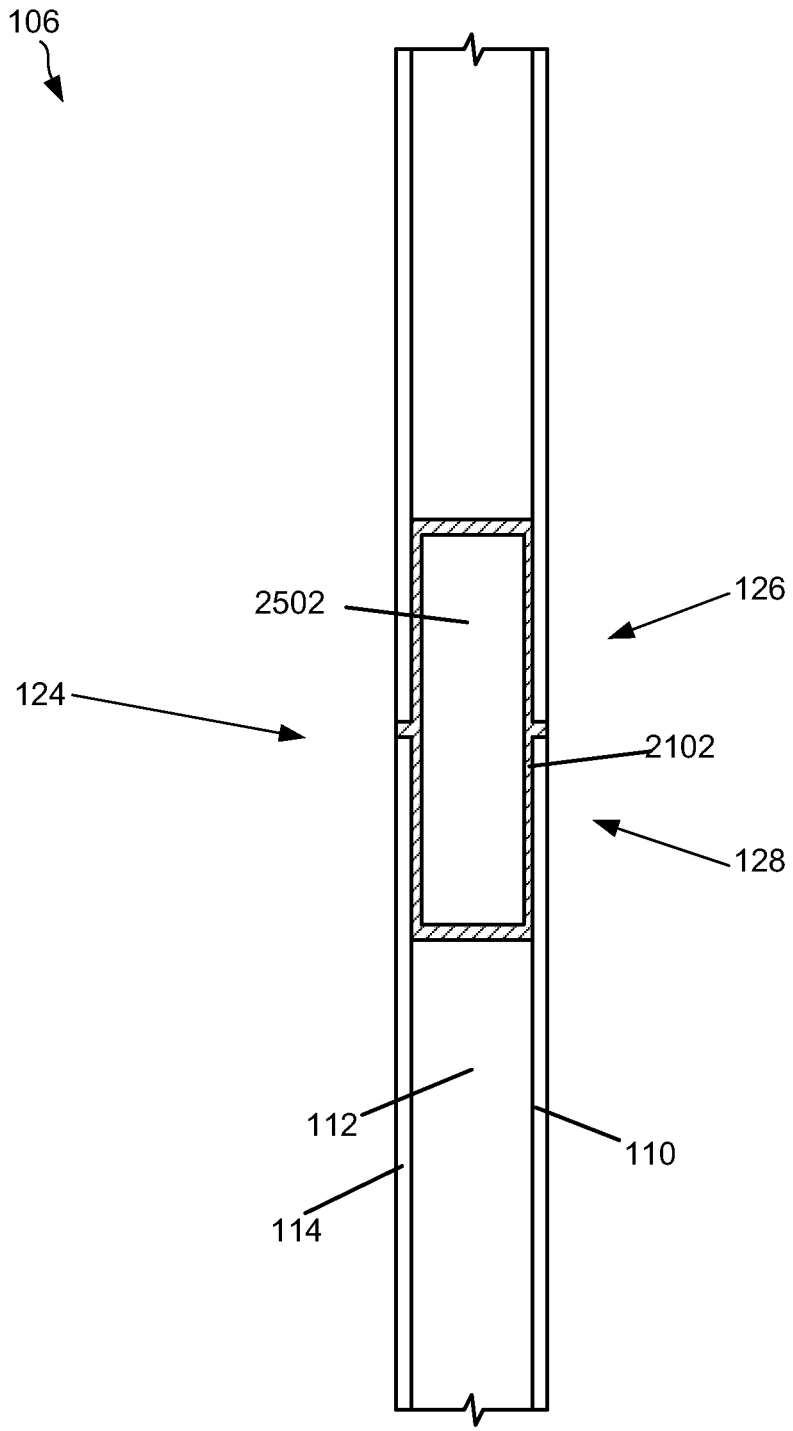
FIG. 25 is a schematic front view of an example butt joint including a joint key according to the present disclosure for connecting ends of a spacer of a sealed unit, such as shown in FIG. 1.

FIG. 25 is a schematic front view of an exemplary joint 124 for connecting first and second ends 126 and 128 of spacer 106 together. Spacer 106 includes elongate strip 110, filler 112, and elongate strip 114. In this example, joint 124 is a butt joint including a joint key 2502.

Joint key 2502 is made of a solid material, such as metal, plastic, or other suitable materials. In this example, joint key is a generally rectangular block that is sized to fit between elongate strips 110 and 114. Adhesive is first applied to both ends 126 and 128 and/or to joint key 2502. Then joint key 2502 is inserted into joint 124 and ends 126 and 128 are pressed together. Joint key 2502 provides additional structural support to joint 124.

In some embodiments joint key 2502 includes other shapes and configurations. For example, in some embodiments joint key 2502 includes a plurality of teeth that resist disengagement of joint key 2502 from ends 126 and 128 after assembly.

In some embodiments joint key 2502 includes an angled bend, such as a right angled bend, a 30 degree angled bend, a 45 degree angled bend, a 60 degree angled bend, or a 120 degree angled bend. Such embodiments of joint key 2502 are referred to as a corner key, because they enable joint 124 to be arranged at a corner. Further, in some embodiments ends 126 and 128 are ends of two distinct spacers 106. Multiple joint keys 2502 are used in some embodiments.

In some embodiments, joint key 2502 is alternatively used to form an offset joint, single overlapping joint, double overlapping joint, or other joints. Further, other embodiments include other joints. For example, some embodiments use one or more fasteners other than an adhesive.

Figure 26:
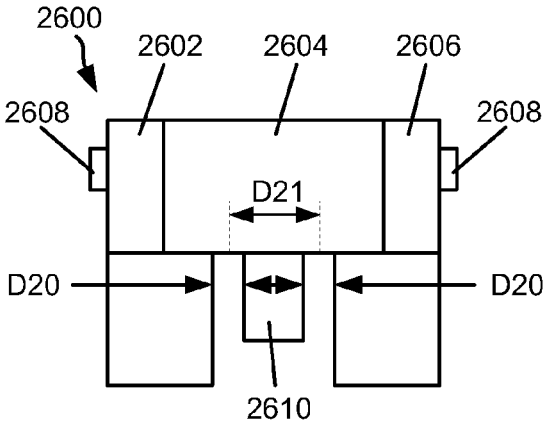
FIG. 26 is a schematic front view of an example manufacturing jig for use in manufacturing a spacer according to the present disclosure.
Figure 27:
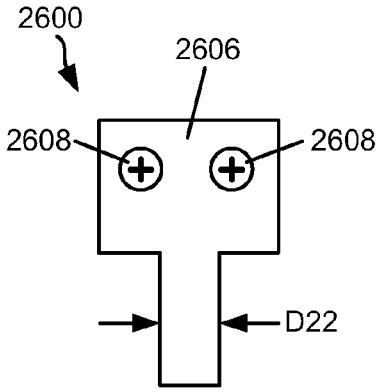
FIG. 27 is a schematic side view of the manufacturing jig shown in FIG. 26.
Figure 28:
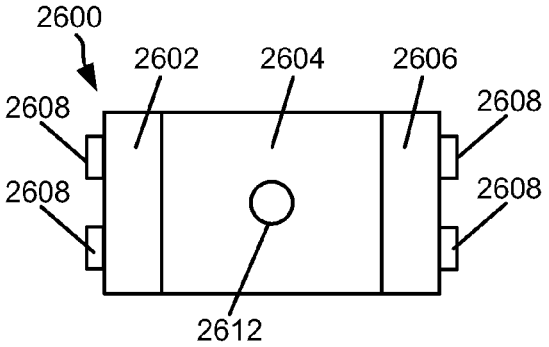
FIG. 28 is a schematic top plan view of the manufacturing jig shown in FIG. 26.
Figure 29:
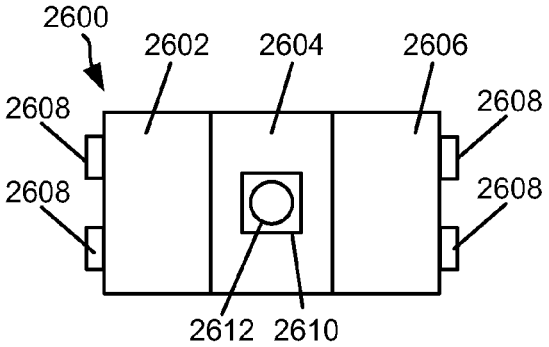
FIG. 29 is a schematic bottom plan view of the manufacturing jig shown in FIG. 26.
Figure 30:
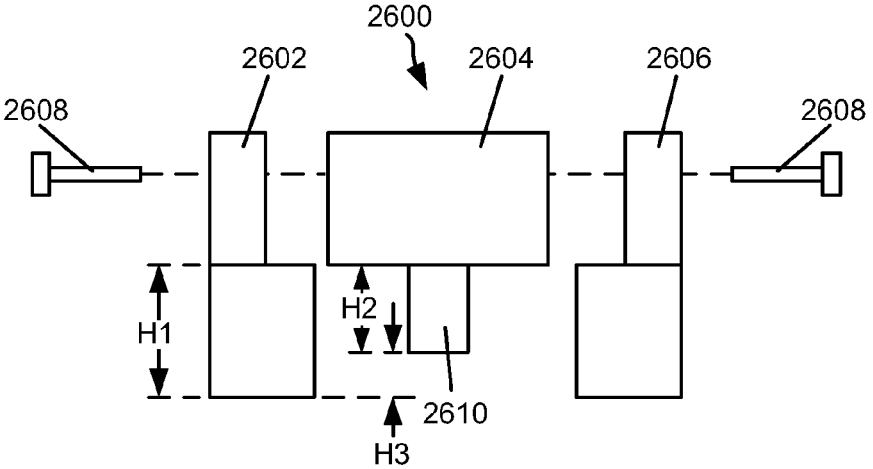
FIG. 30 is a schematic front exploded view of the manufacturing jig shown in FIG. 26.

FIGS. 26-30 illustrate an example embodiment of spacer manufacturing jig 2600 according to the present disclosure. FIG. 26 is a front view of jig 2600. FIG. 27 is a side view of jig 2600. FIG. 28 is a top plan view of jig 2600. FIG. 29 is a bottom plan view of jig 2600. FIG. 30 is a front exploded view of jig 2600. As shown and described in more detail with reference to FIGS. 31-38, jig 2600 is used in some embodiments to insert filler between two elongate strips to form a spacer.

Referring now to FIGS. 26-30 collectively, jig 2600 includes elongate strip guide 2602, body 2604, elongate strip guide 2606, and fasteners 2608. Body 2604 includes output nozzle 2610 and an orifice 2612 that extends through body 2604 and output nozzle 2610. Elongate strip guides 2602 and 2606 are fastened to opposite sides of body 2604 by fasteners 2608. In this example, fasteners 2608 are screws, but any other suitable fastener can be used, such as adhesive, a welded joint, a bolt, or other fasteners. In another embodiment, elongate strip guides 2602 and 2606 and body 2604 are a unitary piece. Body 2604 includes an orifice 2612 that extends from a top surface of body 2604 through output nozzle 2610.

During operation, filler is supplied to jig 2600 by a source, such as a pump (not shown in FIGS. 26-30). The pump typically includes a conduit (not shown) that connects with orifice 2612, such as by screwing an end of the conduit into orifice 2612 at the top surface of body 2604. In some embodiments orifice 2612 includes screw threads that are used to mate with the conduit. Filler flows through orifice 2612 and output nozzle 2610 where it is delivered to a desired location.

Elongate strip guides 2602 and 2606 cooperate with output nozzle 2610 to guide elongate strips and to supply filler therebetween. Elongate strip guides 2602 and 2606 are spaced from output nozzle 2610 a sufficient distance D20 (shown in FIG. 26) apart such that elongate strips (not shown in FIGS. 26-30) can pass on either side of output nozzle 2610 and between output nozzle 2610 and elongate strip guides 2602 and 2606. In this way, elongate strips are maintained at a proper separation D21 (shown in FIG. 8) during filling. Elongate strip guides 2602 and 2606 are relatively thin D22 to enable jig 2600 to form tight corners. D22 is typically in a range from about 0.1 inches (about 0.25 centimeter) to about 0.5 inches (about 1.3 centimeters), and preferably from about 0.2 inches (about 0.5 centimeter) to about 0.3 inches (about 0.76 centimeter).

Elongate strip guides 2602 and 2606 include an upper portion that engages with body 2604 and a lower portion that extends below body 2604. The lower portion has a height H1 (shown in FIG. 30). Height H1 is typically slightly larger than the width of elongate strips, such that when a bottom surface of the lower portion is placed onto a surface (e.g., a sheet of glass), the elongate strips fit between the surface and the bottom surface of body 2604. Output nozzle 2610 extends out from the upper portion of body 2604 a height H2. H2 is typically less than H1. The difference between H2 and H1 is the height H3. If the bottom surface of jig 2600 is placed onto a surface, H3 is the height between the bottom of output nozzle 2610 and the surface. Typically, H3 is about equal to the desired thickness of a layer of filler material. If filler material is to be applied in multiple layers, H3 is typically an equivalent fraction of the width of the elongate strip. For example, if filler is going to be applied in three layers, then H3 is typically about ⅓ of the total width of the elongate strip, so that each layer will fill about ⅓ of the space. In other embodiments, filler is applied in a number of layers, where the number of layers is typically in a range from about 1 layer to about 10 layers, and preferably in a range from about 1 layer to about 3 layers. Such a multi-layered filler is sometimes referred to herein as a horizontal stack.

In some embodiments, jig 2600 is made of metal, such as stainless steel or aluminum. Body 2604 and elongate strip guides 2602 and 2606. Jig 2600 is machined from metal by cutting, grinding, drilling, or other suitable machining steps. In other embodiments other materials are used, such as other metals, plastics, rubber, and the like.

In an alternate embodiment elongate strip guides 2602 and 2606 include rollers. In one such embodiment, rollers are oriented with a vertical axis of rotation, such that the roller rolls along a side of an elongate strip to guide the elongate strip to a proper position. In another embodiment, the rollers are oriented with a horizontal axis of rotation (parallel with fasteners 2608). In this embodiment, the rollers are used to roll along a surface (such as a sheet of glass).

FIGS. 31-38 illustrate an exemplary method of forming a sealed unit including two sheets of window material separated by a spacer. FIGS. 31-36 illustrate a method of filling a spacer and a method of applying a spacer to a sheet of window material. Only a portion of sheets 102 and 104 and elongate strips 110 and 114 are shown in FIGS. 31-38.

Figure 31:
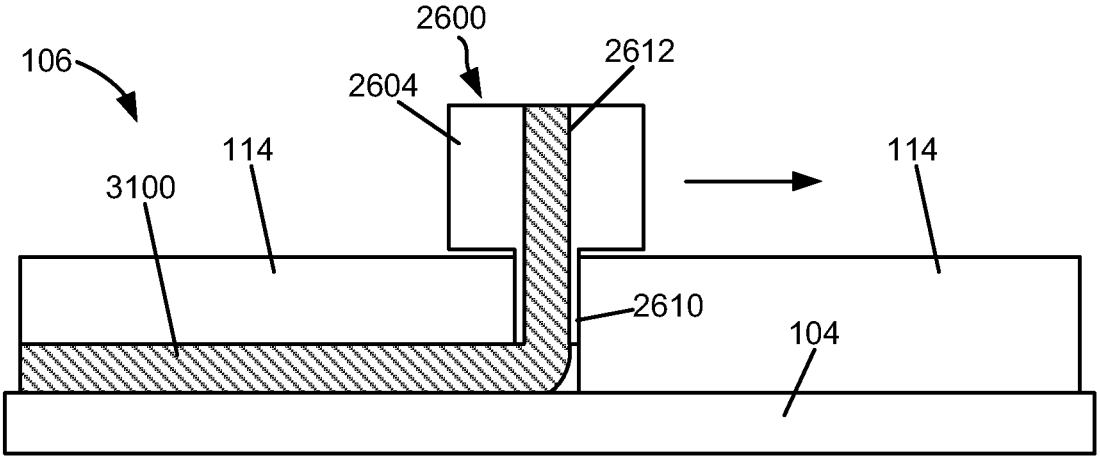
FIG. 31 is a schematic side cross-sectional view of the manufacturing jig shown in FIG. 26 while applying a first filler layer between two elongate strips.
Figure 32:
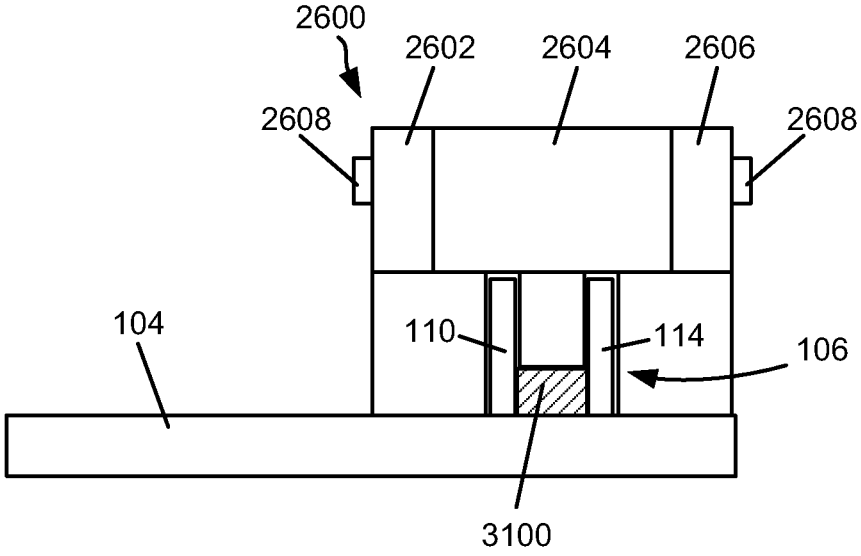
FIG. 32 is a schematic front elevational view of the manufacturing jig shown in FIG. 31.

FIGS. 31-32 illustrate an example method of applying elongate strips 110 and 114 to a sheet 104 of window material, and an exemplary method of applying a first filler layer 3100 therebetween. FIG. 31 is a schematic side cross-sectional view. FIG. 32 is a schematic front elevational view.

In this method, two elongate strips 110 and 114 are provided and fed through jig 2600. Specifically, elongate strips 110 and 114 pass through jig 2600 on either size of output nozzle 2610, and adjacent to the respective elongate strip guides 2602 and 2606. Jig 2600 operates to guide elongate strips to the proper location on sheet 104. Elongate strips 110 and 114 include an undulating shape in some embodiments.

Material for first filler layer 3100 is supplied to orifice 2612 of jig 2600, such as by a pump and conduit (not shown). An example of material for first filler layer 3100 is a primary seal material. Material for first filler layer 3100 enters from the top surface of body 2604, passes through orifice 2612, and exits jig 2600 through output nozzle 2610. In this way, first filler layer 3100 is applied to a location between elongate strips 110 and 114, and onto a surface of sheet 104. Jig 2600 is advanced relative to sheet 104 to apply a layer 3100 of filler material between elongate strips 110 and 114 and onto the surface of sheet 104.

In some embodiments, jig 2600 is advanced using a robotic arm or other drive mechanism that is connected to jig 2600. In another embodiment, jig 2600 remains stationary and a platform supporting sheet 104 is moved relative to jig 2600.

Figure 33:
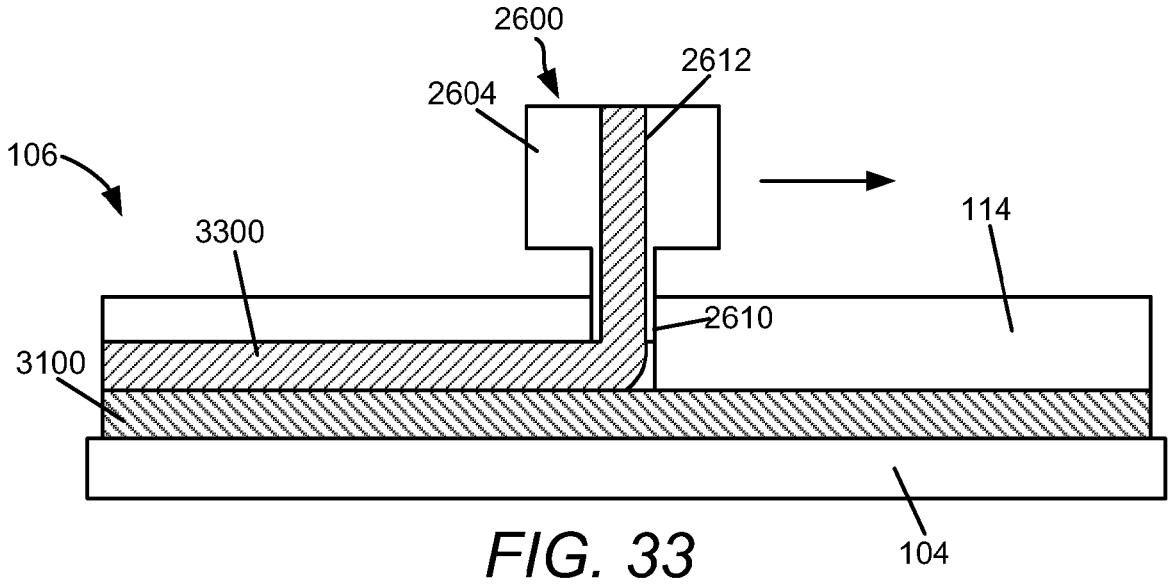
FIG. 33 is a schematic cross-sectional view of the manufacturing jig shown in FIG. 26 while applying a second filler layer between two elongate strips.
Figure 34:
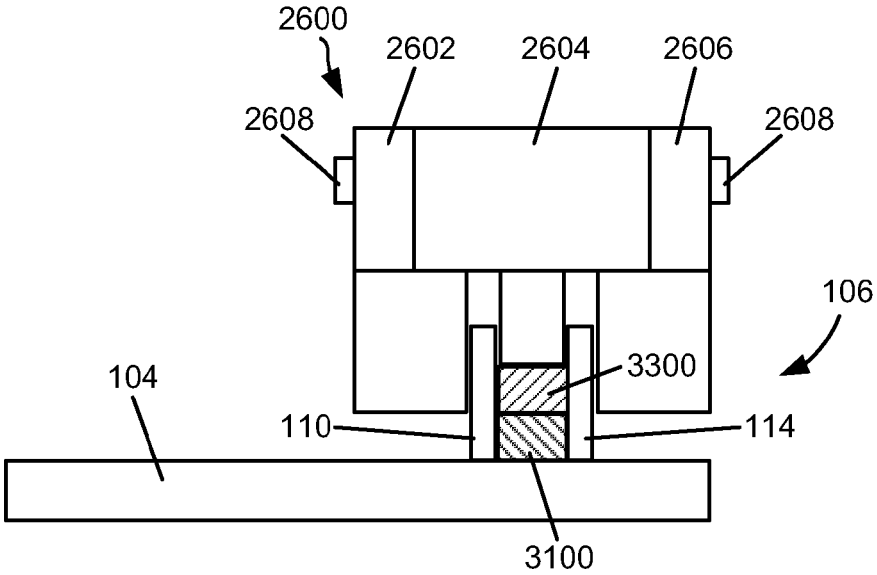
FIG. 34 is a schematic front elevational view of the manufacturing jig shown in FIG. 33.

FIGS. 33 and 34 illustrate an example method of applying a second filler layer 3300 between elongate strips 110 and 114. FIG. 33 is a schematic side cross-sectional view. FIG. 34 is a schematic front elevational view.

After first filler layer 3100 has been applied, a second filler layer 3300 is then applied over the first filler layer 3100. To do so, jig 2600 is raised relative to sheet 104 a distance about equal to the thickness of first filler layer 3100. Second filler layer 3300 (which may be the same or a different filler material) is then applied in the same manner as the first filler layer 3100. An example of a second filler layer 3300 is a matrix desiccant material. Elongate strip guides 2602 and 2606 maintain proper spacing of elongate strips 110 and 114 while the second filler layer 3300 is applied.

In another possible embodiment, rather than raising jig 2600, a second jig (not shown) is used that has a shorter output nozzle 2610. The second jig is the same as jig 2600, except that the height of output nozzle 2610 is reduced (e.g., H2, shown in FIG. 30). For example, the height may be a half of H2. This doubles the space between sheet 104 and output nozzle 2610 (H3). If more or less than three layers are to be applied within the elongate strips, the heights may be adjusted accordingly.

Figure 35:
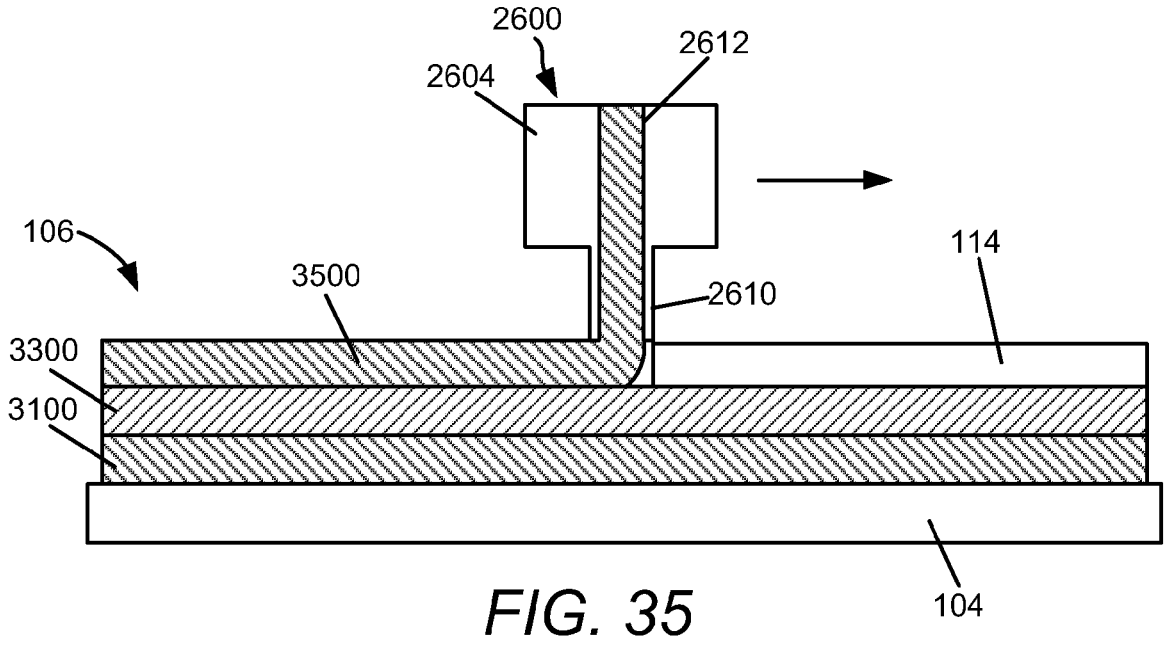
FIG. 35 is a schematic side cross-sectional view of the manufacturing jig shown in FIG. 26 while applying a third filler layer between two elongate strips.
Figure 36:
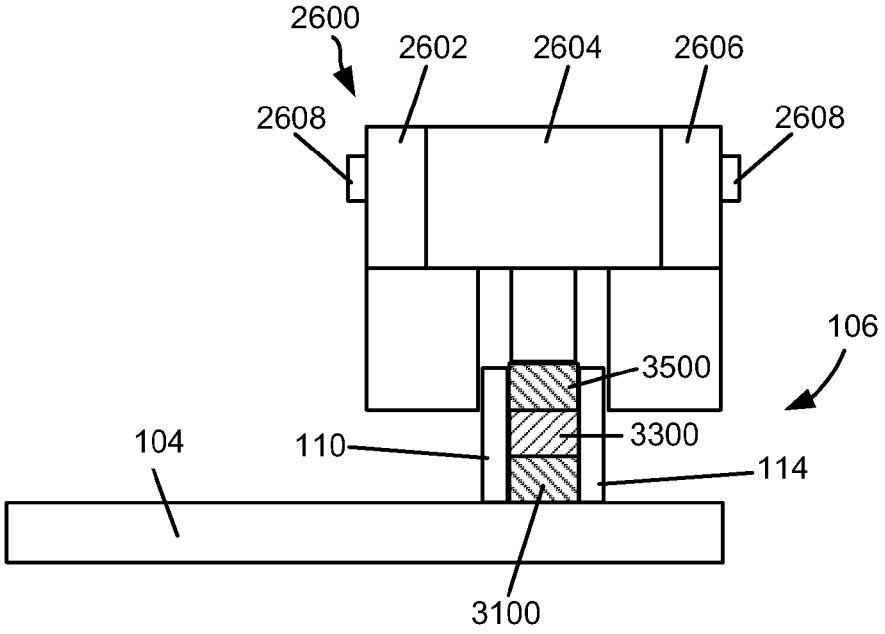
FIG. 36 is a front elevational view of the manufacturing jig shown in FIG. 35.

FIGS. 35 and 36 illustrate an example method of applying a third filler layer 3500 between elongate strips 110 and 114. FIG. 35 is a schematic side cross-sectional view. FIG. 36 is a schematic front elevational view.

After first and second filler layers 3100 and 3300 have been applied, a third filler layer 3500 is then applied over the second filler layer 3300 to complete filling and formation of spacer 106. To do so, jig 2600 is again raised relative to sheet 104 a distance about equal to the thickness of second filler layer 3300. Third filler layer 3500 (which may be the same or different materials than first and second filler layers 3100 and 3300) is then applied in the same manner as the first and second filler layers. An example of third filler layer 3500 is a primary seal material. Elongate strip guides 2602 and 2606 maintain proper spacing of elongate strips 110 and 114 while the third filler layer 3500 is applied. After third filler layer 3500 has been applied, jig 2600 is removed.

In another possible embodiment, rather than raising jig 2600, a third jig (not shown) is used that has a shorter output nozzle 2610. The third jig is the same as jig 2600, except that the height of output nozzle 2610 is reduced (e.g., H2, shown in FIG. 30). For example, the height may be about equal to zero (such that the output nozzle does not extend out from, or only slightly extends out from, the bottom surface of body 2604). This provides adequate space for the third filler layer between body 2604 and the second filler layer 602. If more or less than three layers are to be applied within the elongate strips, the heights may be adjusted accordingly.

In some embodiments, the thickness of filler layers 3100, 3300, and 3500 combined are slightly more than the width of elongate strips 110 and 114, such that third filler layer 3500 extends slightly above elongate strips 110 and 114. This is useful for connecting spacer 106 with a second sheet 102, as shown in FIGS. 37 and 38.

Figure 37:
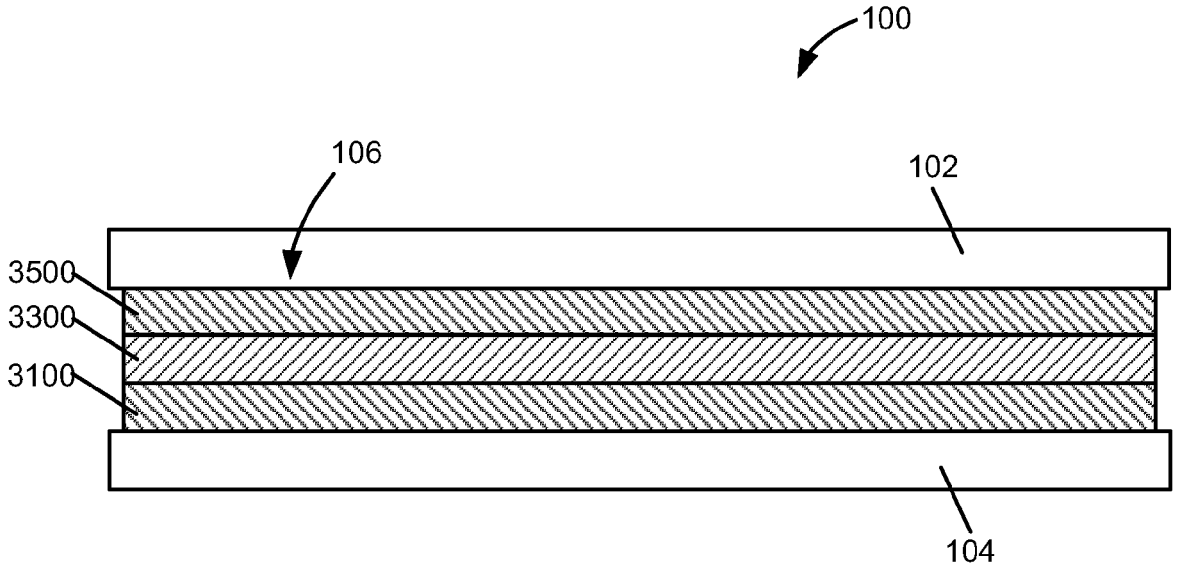
FIG. 37 is a schematic side cross-sectional view of an example sealed unit according to the present disclosure after the operations illustrated in FIGS. 31-36.
Figure 38:
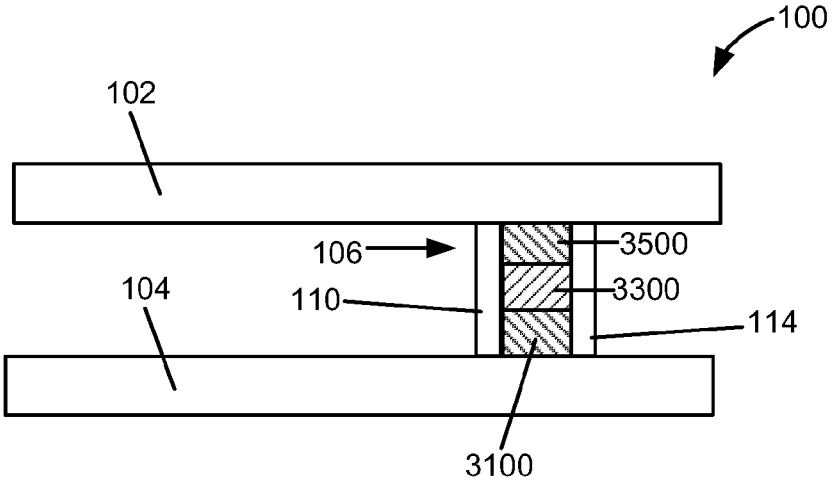
FIG. 38 is another schematic side cross-sectional view of the sealed unit shown in FIG. 37.

FIGS. 37 and 38 illustrate an example method of applying a second sheet of window material to the spacer to form a complete sealed unit 100. FIG. 37 is a schematic side cross-sectional view of sealed unit 100. FIG. 38 is another schematic side cross-sectional view of sealed unit 100. The sealed unit includes sheet 104, spacer 106, and sheet 102. Spacer 106 includes elongate strips 110 and 114, first filler layer 3100, second filler layer 3300, and third filler layer 3500.

After spacer 106 has been formed, sheet 102 is connected to spacer 106. Upon placing sheet 102 onto spacer 106, sheet 102 is pressed against third filler layer 3500, which forms a seal between spacer 106 and sheet 102.

Additional sealants, adhesives, or layers are used in other embodiments, such as described herein.

Figure 39:
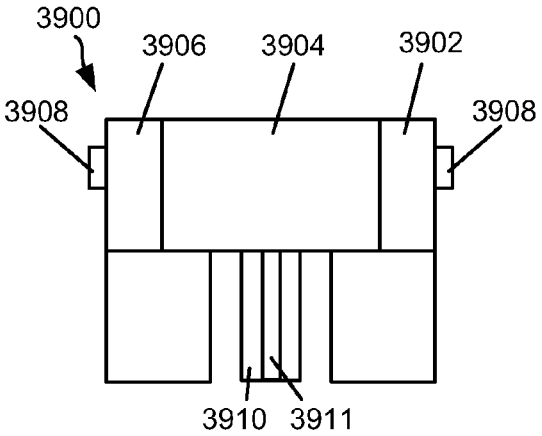
FIG. 39 is a schematic rear elevational view of another example manufacturing jig according to the present disclosure.
Figure 40:
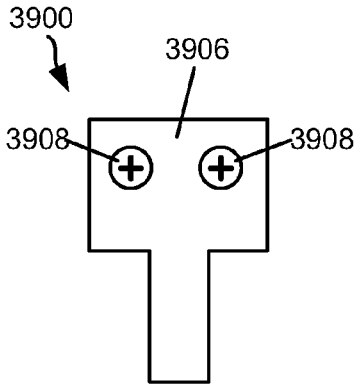
FIG. 40 is a schematic side view of the manufacturing jig shown in FIG. 39.
Figure 41:
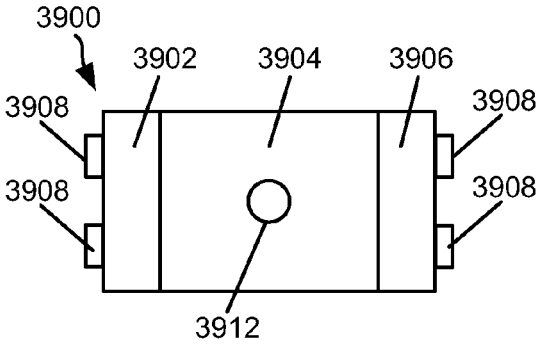
FIG. 41 is a schematic top plan view of the manufacturing jig shown in FIG. 39.
Figure 42:
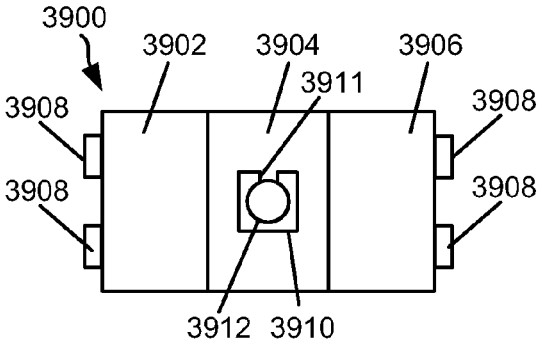
FIG. 42 is a schematic bottom plan view of the manufacturing jig shown in FIG. 39.
Figure 43:
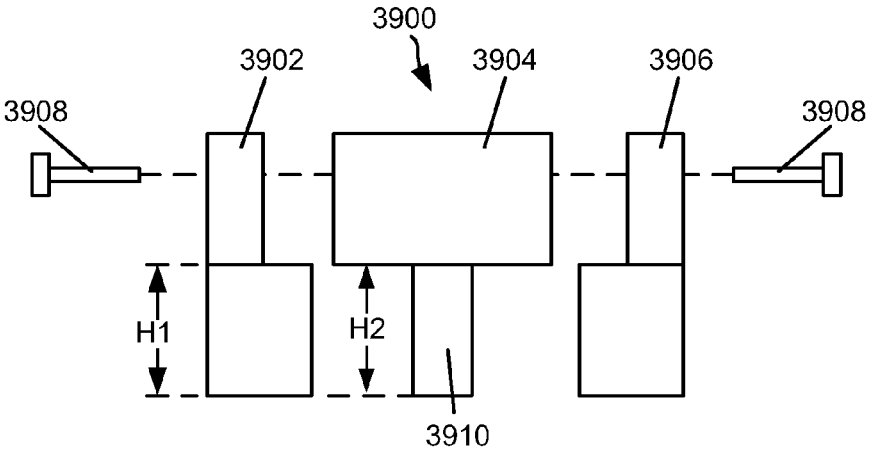
FIG. 43 is a schematic front exploded view of the manufacturing jig shown in FIG. 39.

FIGS. 39-43 illustrate another example embodiment of a manufacturing jig 3900. FIG. 39 is a schematic rear elevational view of jig 3900. FIG. 40 is a schematic side view of jig 3900. FIG. 41 is a schematic top plan view of jig 3900. FIG. 42 is a schematic bottom plan view of jig 3900. FIG. 43 is a schematic front exploded view of jig 3900. As shown and described in more detail with reference to FIGS. 44-45, jig 3900 is used in some embodiments to insert filler between two elongate strips to form a spacer.

Jig 3900 includes elongate strip guide 3902, body 3904, elongate strip guide 3906, and fasteners 3908. Body 3904 includes output nozzle 3910 and an orifice 3912 that extends through, or at least partially through, body 3904 and output nozzle 3910. Output nozzle 3910 also includes an output slit 3911 through which filler exits output nozzle 3910. In some embodiments an end of output nozzle 3910 is closed. Elongate strip guides 3902 and 3906 are fastened to opposite sides of body 3904 by fasteners 3908.

Manufacturing jig 3900 is similar to that shown and described with reference to FIGS. 26-30, except that jig 3900 includes a different output nozzle 3910 structure. Output nozzle 3910 extends a length that is approximately equal to a width of the elongate strips (e.g., W1 shown in FIG. 3). In addition, output nozzle 3910 includes a slit 3911 through which the filler exits output nozzle 3910. In some embodiments, manufacturing jig 3900 is used to insert a single filler material between elongate strips (as illustrated with reference to FIGS. 44-45), rather than filling with multiple filler layers (as described in FIGS. 26-30). However, other embodiments are configured to apply multiple filler layers, either individually with multiple passes or simultaneously with a single pass.

In this embodiment, the lower portion of guides 3902 and 3906 have a height H1 (shown in FIG. 30). H2 is the height of output nozzle 3910. In this embodiment, height H1 is approximately equal to height H2. Other embodiments include other heights.

Figure 44:
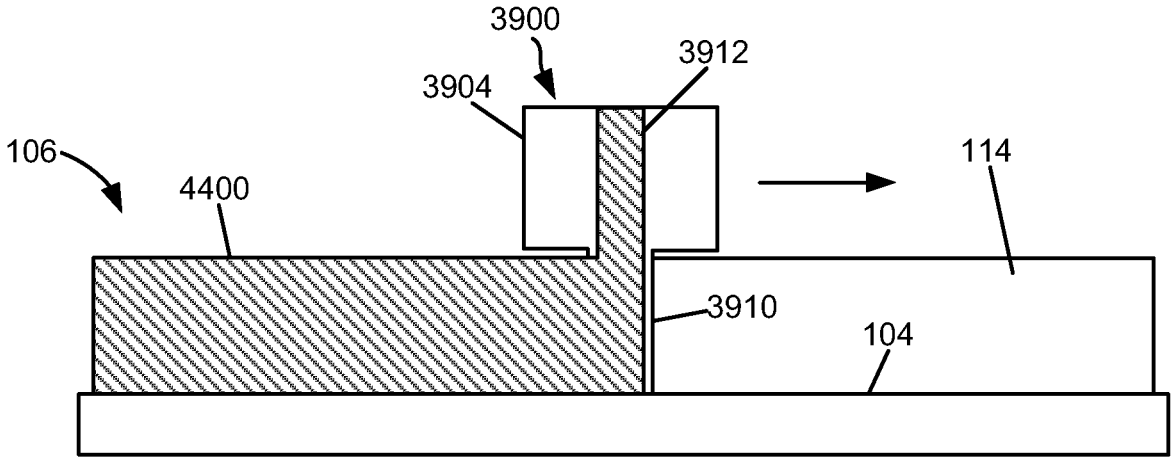
FIG. 44 is a schematic side cross-sectional view of the manufacturing jig shown in FIG. 39 while applying a single filler layer between two elongate strips.
Figure 45:
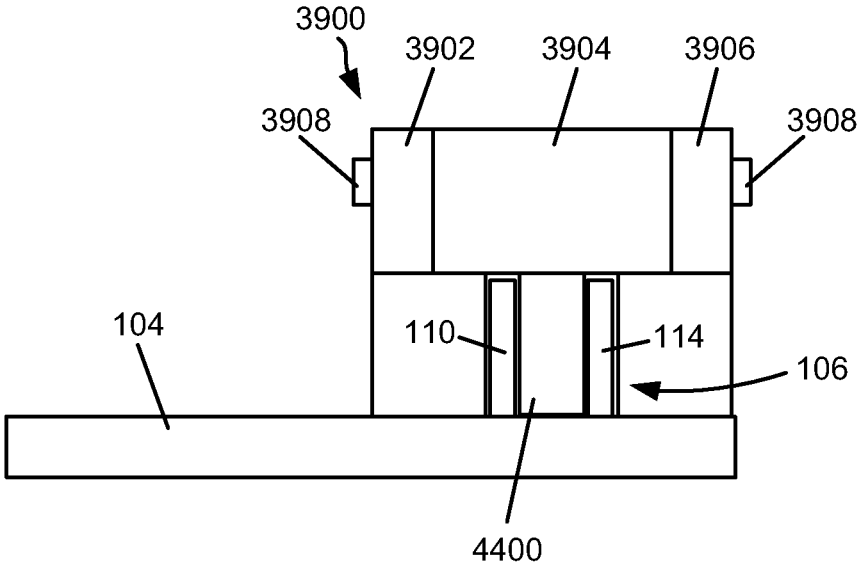
FIG. 45 is a schematic front elevational view of the manufacturing jig shown in FIG. 44.

FIGS. 44-45 illustrate an example method of forming a spacer on a sheet of window material. Only a portion of sheets 102 and 104 and elongate strips 110 and 114 are shown in FIGS. 44-45. The example method involves applying elongate strips 110 and 114 to a sheet 104 of window material and applying a single layer of filler material 4400 therebetween. FIG. 44 is a schematic side cross-sectional view. FIG. 45 is a schematic front elevational view.

In this method, two elongate strips 110 and 114 are provided and fed through jig 3900. Specifically, elongate strips 110 and 114 pass through jig 3900 on either size of output nozzle 3910, and adjacent to the respective elongate strip guides 3902 and 3906. Jig 3900 operates to guide elongate strips to the proper location on sheet 104. Elongate strips 110 and 114 include an undulating shape in some embodiments.

Filler material 4400 is supplied to orifice 3912 of jig 3900 such as by a pump and conduit (not shown). An example of filler material 4400 is a primary seal material or a matrix desiccant material. Other examples of filler material 4400 are described herein. Filler material 4400 enters from the top surface of body 3904, passes through orifice 3912, and exits jig 3900 through slit 3911 (shown in FIG. 39). In this way, filler material 4400 is directed to a location between elongate strips 110 and 114, and onto a surface of sheet 104. Filler material 4400 fills substantially all of the space between elongate strips 110 and 114 in a single pass. Jig 3900 is advanced relative to sheet 104 to apply a single layer of filler material 4400 between elongate strips 110 and 114 and onto the surface of sheet 104. In this way, multiple passes are not required to insert filler material. If desired, an additional sealant is applied to an external side of the spacer 106 in some embodiments.

Figure 46:
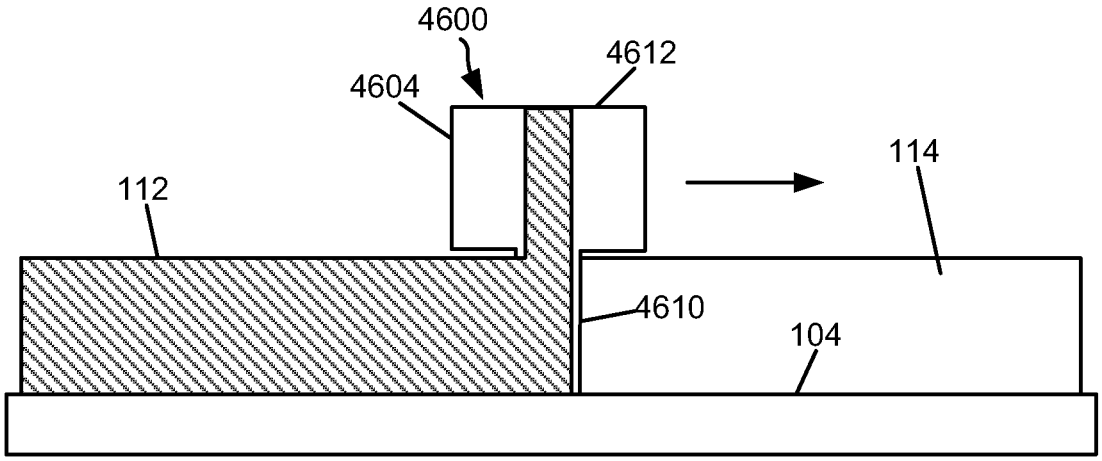
FIG. 46 is a schematic side cross-sectional view of another example manufacturing jig according to the present disclosure.
Figure 47:
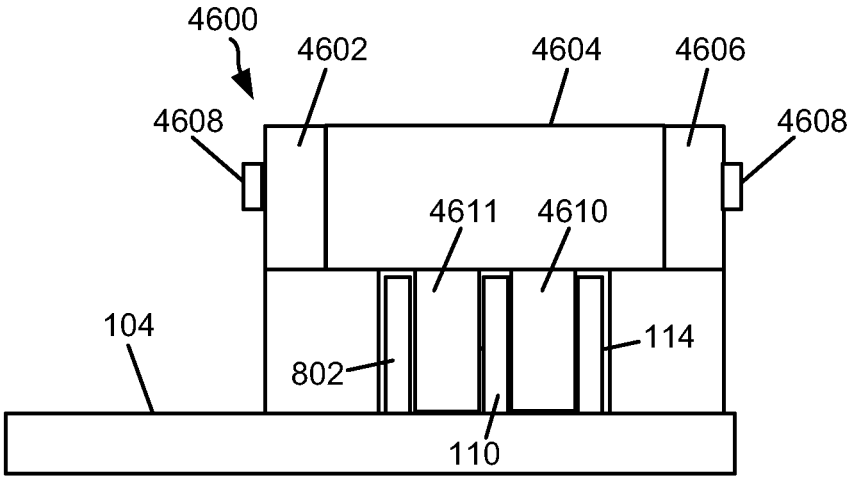
FIG. 47 is a schematic front elevational view of the manufacturing jig shown in FIG. 46.

FIGS. 46-47 illustrate an example jig 4600 and method of forming a spacer on a sheet 104 of window material. FIG. 46 is a schematic side-cross sectional view. FIG. 47 is a schematic front elevational view. Jig 4600 includes elongate strip guide 4602, body 4604, elongate strip guide 4606, and fasteners 4608. Body 4604 includes output nozzles 4610 and 4611. In some embodiments, output nozzles 4610 and 4611 include an output slit through which filler is dispensed from the output nozzles. Elongate strip guides 4602 and 4606 are fastened to opposite sides of body 4604 by fasteners 4608.

This example forms a spacer 106, such as the example spacer shown in FIG. 8. The spacer 106 includes three elongate strips 114, 110, and 802, and two layers of filler material 112 and 804 (not visible in FIGS. 46-47, but shown in FIG. 8). Other embodiments are further expanded to include additional elongate strips (e.g., four, five, six, or more) and more than two layers of filler material (e.g., three, four, five, or more). Further, in some embodiments elongate strips are not included, such as shown in FIGS. 15-16. In other embodiments, elongate strips are replaced by another material, such as the wire shown in FIGS. 17-20.

Jig 4600 operates to fill spacer 106 with filler 112 and filler 804 (shown in FIG. 8). In some embodiments, filler 112 is the same as filler 804, and can be any of the fillers or sealants discussed herein. In other embodiments, filler 112 is different than filler 804. Filler passes through body 3904 through the multiple adjacent orifices 3912. It then fills the space between two adjacent elongate strips. A single pass is used in some embodiments. Multiple passes are used in other embodiments, such as to form filler 112 and filler 804 of multiple layers. The multiple layers are the same material in some embodiments. In other embodiments the multiple layers are different materials.

Figure 48:
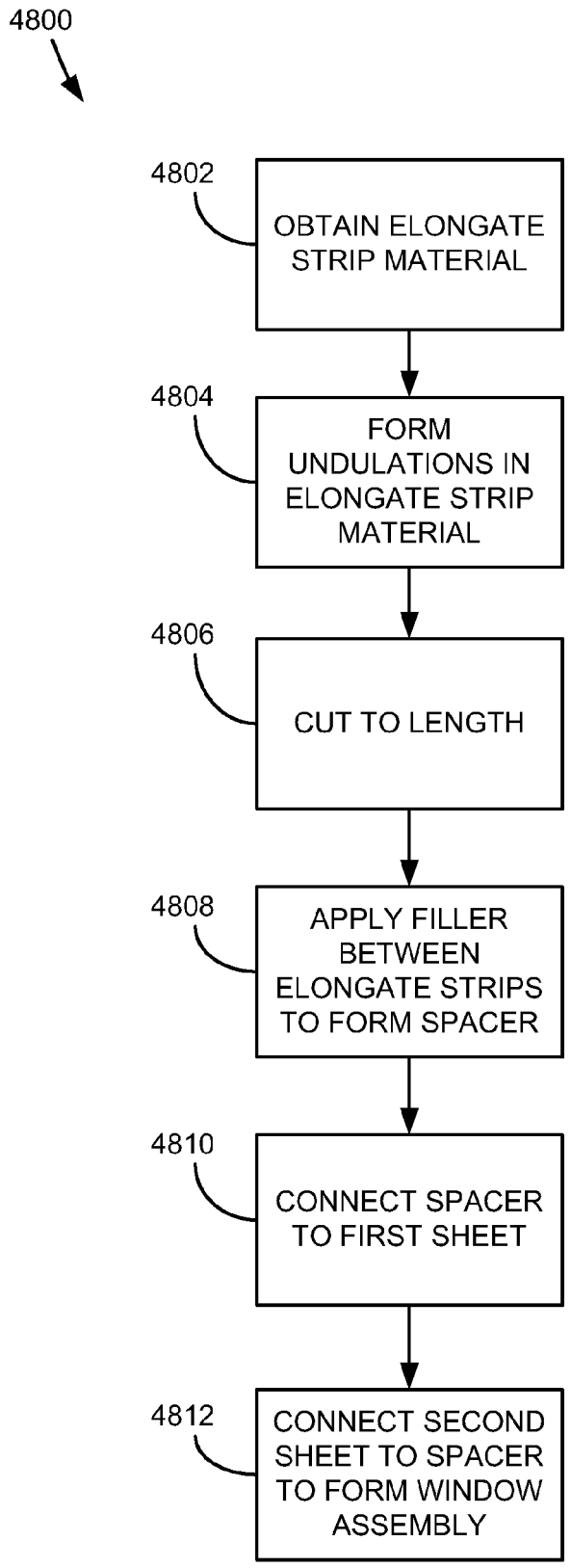
FIG. 48 is a flow chart illustrating an example method of making a sealed unit according to the present disclosure.

FIG. 48 is a flow chart illustrating an exemplary method 4800 of making a sealed unit. Method 4800 includes operations 4802, 4804, 4806, 4808, 4810, and 4812. Method 4800 is used to make a sealed unit including a first sheet, a second sheet, and a spacer therebetween.

Figure 58:
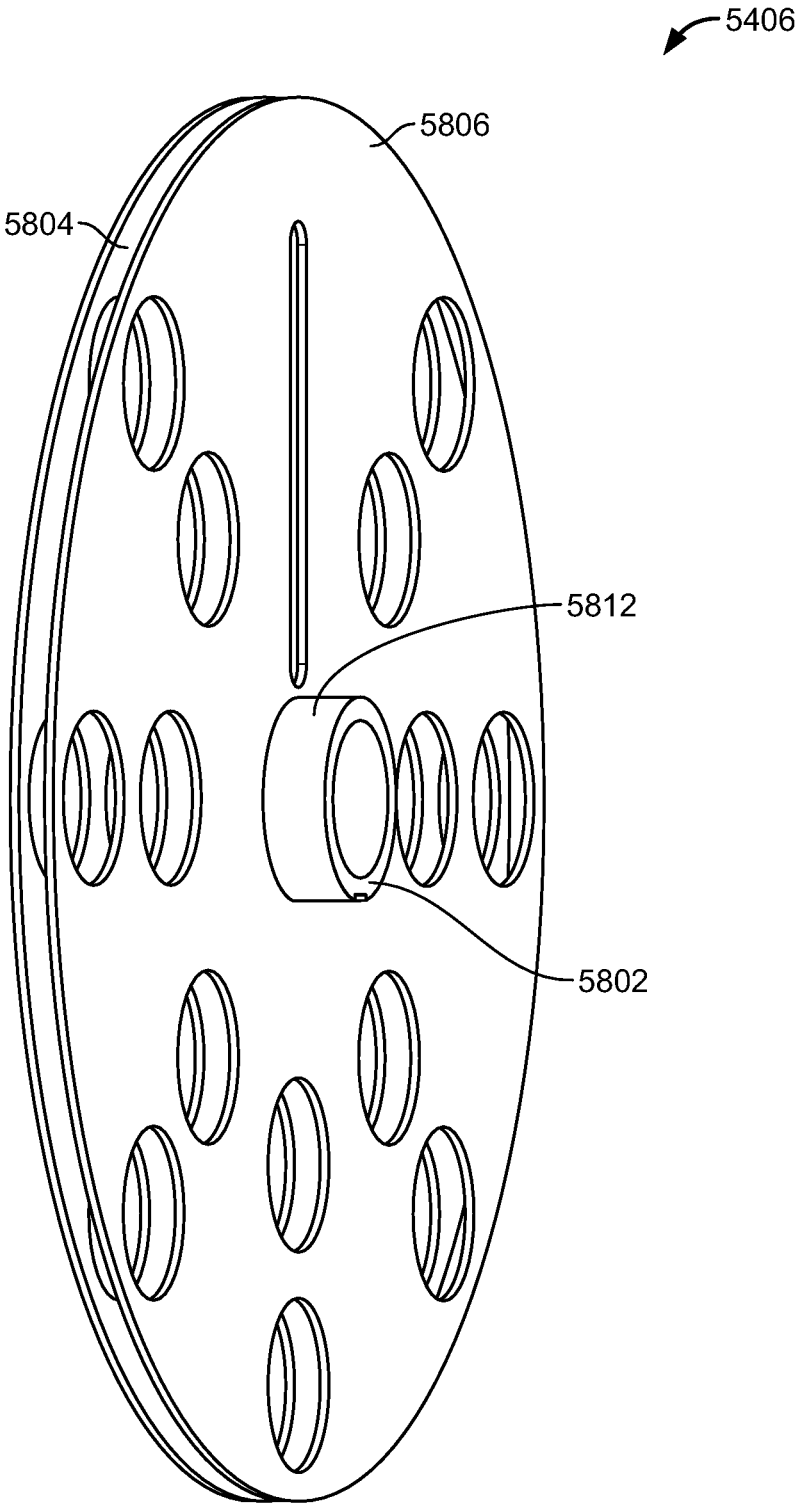
FIG. 58 is a schematic perspective view of an example spool for storing spacer material according to the present disclosure.
Figure 59:
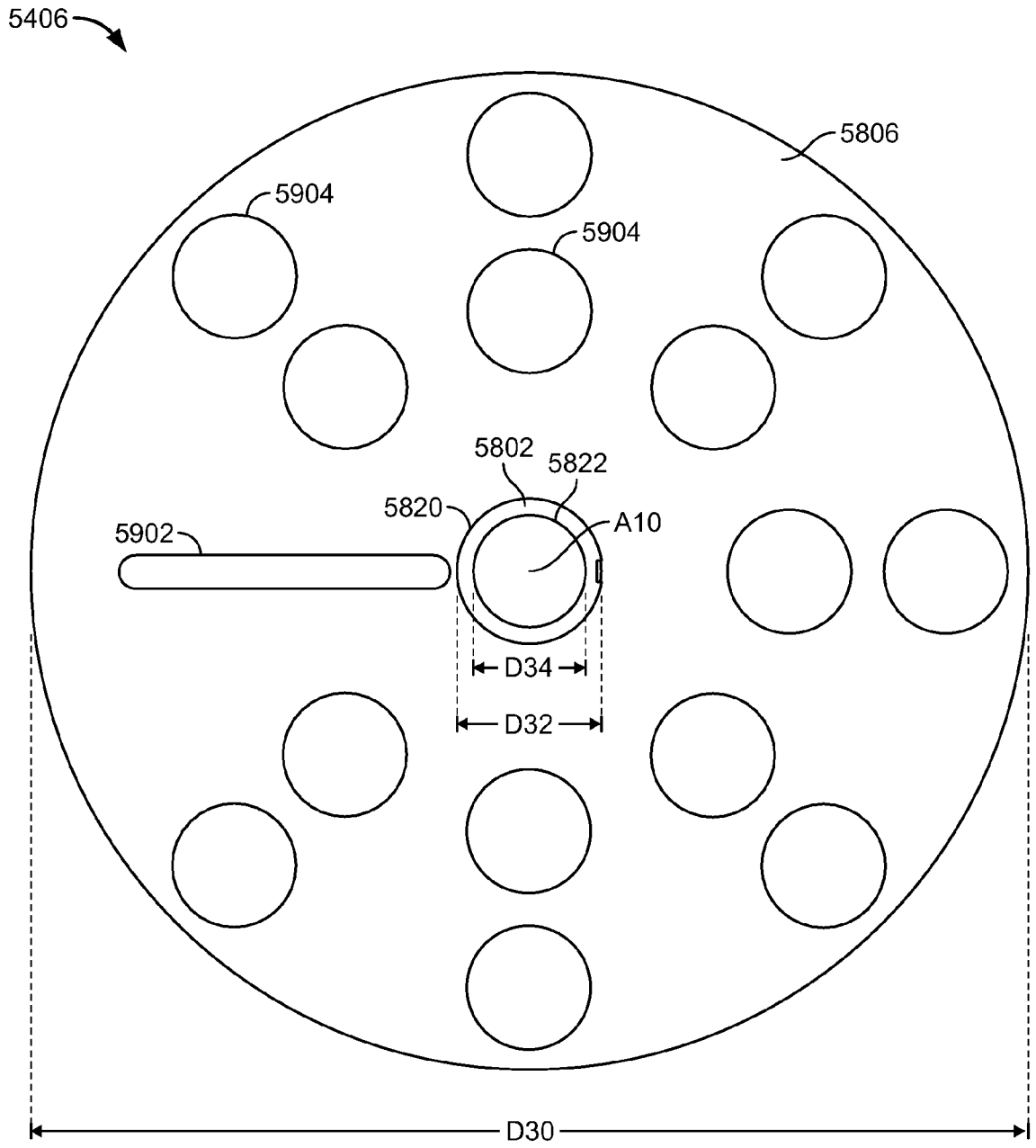
FIG. 59 is a schematic side view of the spool shown in FIG. 58.
Figure 60:
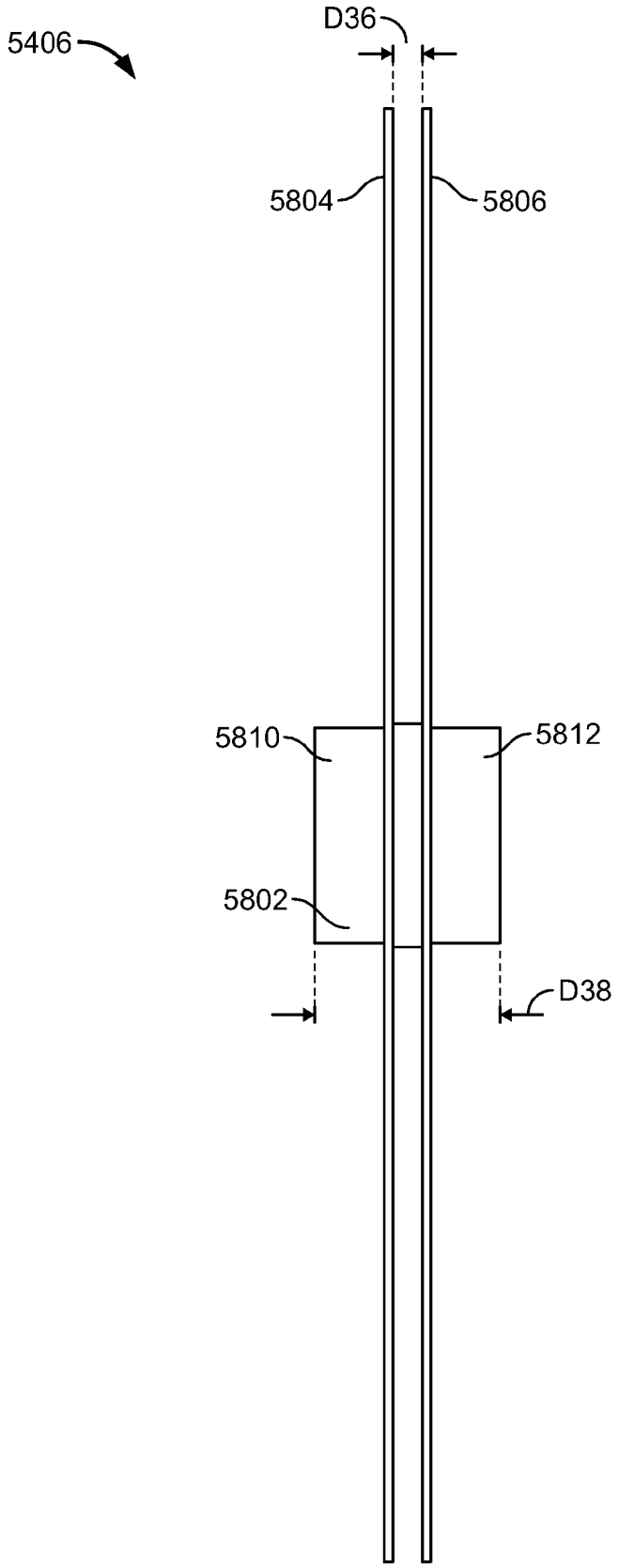
FIG. 60 is a schematic front view of the example spool shown in FIG. 58.

Method 4800 begins with operation 4802 during which elongate strip material is obtained. In one embodiment, elongate strip material is obtained in the form of rolled stock. In some embodiments a spool is used having the rolled elongate strip material wound thereon. An example spool is illustrated in FIGS. 58-60. In some embodiments two spools are obtained—a first spool providing material to make a first elongate strip and a second spool providing material to make a second elongate strip. Dual spools allow the elongate strips to be processed at the same time. An example of an elongate strip material is a long, thin strip of metal or plastic.

In some embodiments, a large number of the same or very similar window assemblies are manufactured. In such embodiments, the size and length of a spacer does not vary. An advantage of this method of manufacturing is that the same elongate strip material can be used to make all of the spacers, such that down time required to change elongate strip materials or make other process modifications is reduced or eliminated. As a result, the productivity of the manufacturing is improved.

In other embodiments, a variety of different window assemblies are manufactured, such as having window assemblies of different sizes or shapes. This type of manufacturing is sometimes referred to as custom window manufacturing or one-for-one manufacturing. In such embodiments, various types and sizes of spacers are needed for assembly with various types and sizes of window sheets. In some embodiments the materials (such as elongate strip materials) are manually selected and installed in a manufacturing system depending on the sealed unit that is next going to be made. However, such manual changing of materials results in a down time that reduces the productivity of the manufacturing system.

An alternative method of custom manufacturing involves the use of an automated material selection device. The automated material selection device is loaded with a plurality of different elongate strip materials, such as having different widths, lengths, thicknesses, shapes, colors, material properties, or other differences. In some embodiments, each material is stored on a spool in which the material is wound around the spool. When a sealed unit is about to be manufactured, a control system determines the type of spacer needed, and the elongate strip material that is needed to make that spacer. The control system then selects that elongate strip material from one or more of the spools and obtains the material from the spool. The automated material selection device then advances that material to the next stage of the manufacturing system where it will be formed into the appropriate spacer.

In some embodiments two or more spools are provided for each elongate strip material. One advantage of having multiple spools is that multiple strips of elongate strip material can be processed at once. For example, if a spacer requires two elongate strips, the two elongate strips can be processed simultaneously to reduce manufacturing time. Another advantage of having multiple spools is that the automated material selection device continues to operate even after one spool of material has been depleted, by selecting another spool having the same material.

Yet another advantage of having multiple spools is that the automated material selection device can be programmed to reduce waste. For example, if about 12 feet (about 3.7 meters) of material remains on a first spool but 40 feet (12 meters) of the same material is on a second spool, the automated material selection device is programmed to determine the most effective use of the available materials to reduce waste. If the next sealed unit to be manufactured requires a length of 8 feet (2.4 meters) of material, the automated material selection device determines whether to use a portion of the 12 feet (3.7 meters) on the first spool or a portion of the 40 feet (12 meters) on the second spool. If the automated material selection device also knows that the following sealed unit to be manufactured requires 12 feet (3.7 meters) of material, the automated material selection device will save the 12 feet (3.7 meters) of material on the first spool for use in the second sealed unit. In this way the entire 12 feet (3.7 meters) is utilized, resulting in no or little waste. On the other hand, if the automated material selection device had instead continued to use the first real until it was depleted, the 8 foot (2.4 meters) section of material would have been removed from the first spool. As a result, 4 feet (1.2 meters) of material would have remained on the first spool. The 4 feet (1.2 meters) of material may be too short for later use, resulting in 4 feet (1.2 meters) of wasted material.

After obtaining elongate strip material, operation 4804 is performed to form undulations in the elongate strip material. In one embodiment, undulations are formed by passing the extra material through a roll-former. The roll-former bends elongate strip material to form the desired undulating shape in the elongate strip material. In some embodiments, the undulations are sinusoidal undulations in the elongate strip material. In other embodiments, the undulations are other shapes, such as squared, triangular, angled, or other regular or irregular shapes. If two or more spools of elongate strip material are provided by operation 4802, the two or more elongate strip materials are processed simultaneously by one or more roll-formers. Such simultaneous processing reduces manufacturing time and can also improve uniformity among elongate strip materials used to form the same spacer.

Although operation 4804 is shown as an operation following operation 4802, alternate embodiments perform operation 4804 prior to operation 4802, such that the undulating shape of elongate strip materials is pre-formed in the elongate strip material prior to wrapping onto the spool. In yet another embodiment, elongate strip materials do not include undulations, such that operation 4804 is not required.

After forming undulations, operation 4806 is then performed to cut the elongate strip material to the desired length. Any suitable cutting apparatus is used. If elongate strip materials are being processed simultaneously, cutting can be performed at the same time to reduce manufacturing time and to improve uniformity of elongate strips, such as to have uniform lengths. Alternatively, each elongate strip is cut sequentially. Operation 4806 can alternatively be performed prior to operation 4804, prior to operation 4802, or after subsequent operations.

In addition to cutting to length, additional processing steps are performed during operation 4806 in some embodiments. One processing step involves the formation of apertures (e.g., apertures 116 shown in FIG. 2) in one of the elongate strips. Another processing step is the formation of additional features in the spacer, such as formation of apertures for connection of a muntin bar or other window feature.

Once the elongate strips have been formed and cut to length, operation 4808 is performed to apply filler between the elongate strips to form an assembled spacer. In one embodiment, application of filler between the elongate strips is performed using a nozzle to insert a filler material between two elongate strips. An example of a suitable nozzle is nozzle 2610 of manufacturing jig 2600 illustrated and described with reference to FIGS. 26-30.

Operation 4808 typically begins by aligning ends of two (or more) portions of substantially parallel elongate strips and inserting the nozzle between the elongate strips at that end. As filler is inserted between the elongate strips, the nozzle moves at a steady rate along the elongate strips to apply a substantially equal amount of filler between the elongate strips.

Operation 4808 continues until the nozzle has reached the opposite ends of the elongate strips, such that substantially all of the spacer contains the filler.

In some embodiments, the nozzle includes a heating element that heats the filler material to a temperature above the melting point of the filler. The heating liquefies (or at least softens) the filler to allow the nozzle to apply the filler between the elongate strips. The filler fills in space between the elongate strips. The elongate strips act as a form to prevent filler from slumping. The flow rate of filler is controlled along with the movement of the nozzle along the elongate strips to provide the correct amount of filler to adequately fill the space between the elongate strips without overfilling. In an alternate embodiment, the nozzle is stationary and the elongate strips are moved relative to the nozzle at a steady rate. After filling, the spacer is allowed to cool. The filler typically stiffens as it cools, and in some embodiments the filler adheres to the internal surfaces of the elongate strips.

Operation 4810 is next performed to connect the spacer to a first sheet. In some embodiments, operation 4810 involves applying an adhesive or a sealant to an edge of the spacer and pressing the spacer onto a surface of the first sheet, such as near a perimeter of the first sheet. Alternatively, the sealant or adhesive is applied to the first sheet, and the spacer is pressed into the sealant or adhesive. Typically, the spacer is placed near to the perimeter of the window. In some embodiments the ends of the spacer are connected together to form a loop. Connection of the ends of the spacer is described in more detail with reference to FIGS. 21-25. The ends are connected in such a way that a sealed joint is formed.

The flexibility of the spacer in multiple directions makes operation 4810 easier than if a rigid spacer were used. The flexibility allows the spacer to be easily moved and manipulated into position on the first sheet whether done manually or automatically, such as using a robot. Specifically, the flexibility allows the spacer to bend and flex in whatever direction is needed to route the spacer to the appropriate location on the first sheet. Furthermore, the flexibility allows the spacer to be easily bent to match the shape of the first sheet, such as to form corners of a generally rectangular sheet, or to match the curves of an elliptical sheet, circular sheet, half-circle sheet, or a sheet having another shape or configuration.

During operation 4810, the spacer can be bent to form one or more corners. Formation of a corner can be done in multiple ways. One method of forming a corner is to do so freely by hand. In this method, the operator carefully bends the spacer to match the shape of the perimeter of the first sheet (or other shape) as closely as possible. Another method of forming a corner involves the use of a corner tool. One example of a corner tool is a corner vice. A portion of the spacer is inserted into the corner vice which is then lightly clamped to the spacer to form the desired shape. Another example of a corner tool is a mandrel that is used to guide the spacer upon formation of a corner. Other embodiments include other guides or tools that assist in the formation of a corner.

Although operation 4810 is described as being performed after operation 4808, other embodiments perform operation 4810 simultaneous to operation 4808. In such embodiments, filler is inserted within elongate strips at the same time as the spacer is connected to a first sheet. Such a process can be performed manually. Alternatively, a nozzle, tool, jig, or automated device (or combination of devices), such as a robotic assembly device is used. An example of a manufacturing jig and nozzle are shown in FIGS. 26-30.

In some embodiments only a single filler material is used. In other embodiments, the nozzle applies a filler as well as one or more separate sealants or adhesives. For example, the filler is applied to a central portion of the spacer, between two elongate strips, and an adhesive or sealant is applied on one or both sides of the filler. In this way the adhesive or sealant is arranged between the spacer and the first sheet to connect the spacer with the first sheet. The adhesive or sealant is also used in some embodiments to connect the second sheet to the opposite side of the spacer during operation 4812. In some embodiments, one or more additional sealant layers are applied to one or more external surfaces of the spacer to further seal edges between the spacer and the first and second sheets. The additional sealant layers can be applied at the same time as operations 4808, 4810, and 4812 or after operation 4812.

Once the spacer has been connected to the first sheet, operation 4812 is then performed to connect a second sheet to the spacer to form a sealed unit. It is noted, however, that additional processing steps are performed between operations 4810 and 4812 in some embodiments, such as adding muntin bars or changing the content of the interior space.

In some embodiments, operation 4812 involves applying the adhesive or sealant of operation 4810 to a side of the spacer opposite the first sheet. Alternatively, the adhesive or sealant is applied directly to the second sheet. The second sheet is then placed onto the spacer to connect the spacer to the second sheet. In this way a sealed interior space is formed between first and second sheets, and surrounded by the spacer. The first and second sheets are held in a spaced relationship to each other by the spacer, to form a complete sealed unit. Alternatively, the first sheet and attached spacer are placed onto the second sheet.

In some embodiments the spacer joint is kept open until after operation 4812 such that air present within the interior space can be removed through the joint, such as by purging with another gas or using a vacuum chamber to remove gas from the interior space. Once the vacuum or purge is completed, the joint is then sealed. In another embodiment, operation 4812 is performed in a vacuum chamber or chamber including a purge gas. In some such embodiments, the joint is sealed as part of operation 4810 prior to connection of the second sheet.

In another possible embodiment, operations 4808, 4810, and 4812 are performed simultaneously. In such an embodiment, the first and second sheets are arranged in a spaced relationship and the spacer is filled and connected directly to the first and second sheets in a single step.

An alternative method is a method of forming and connecting a spacer to a first sheet. This alternative method includes operations 4802, 4804, 4806, 4808, and 4810 shown in FIG. 48. In this embodiment, a second sheet is not required and operation 4812 is not required.

Figure 49:
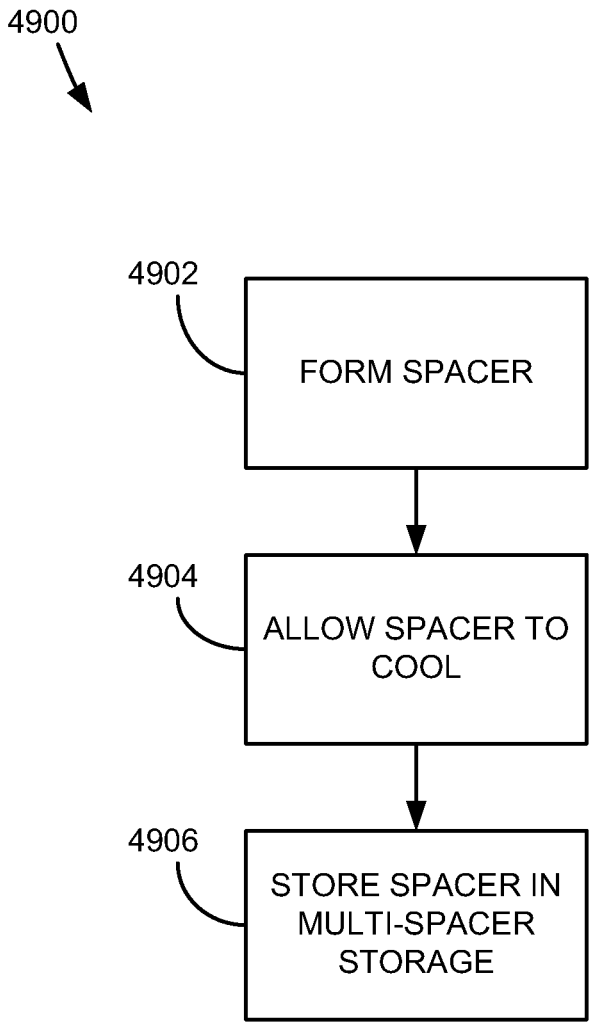
FIG. 49 is a flow chart illustrating an example method of making and storing a spacer according to the present disclosure.
Figure 50:
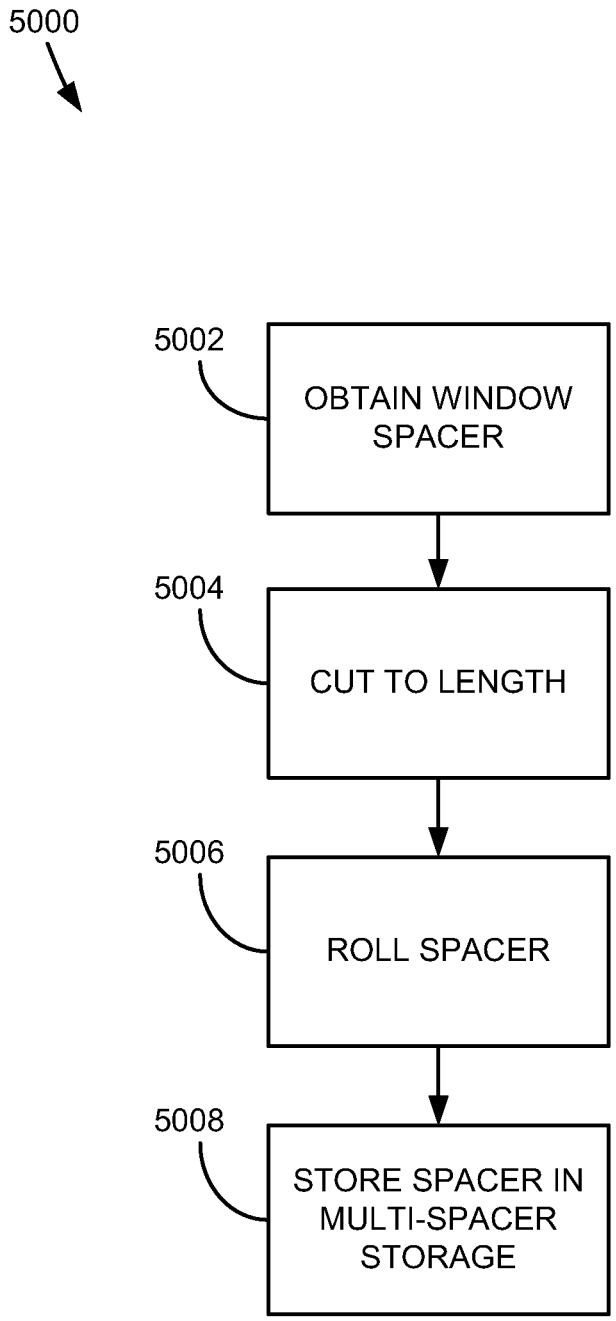
FIG. 50 is a flow chart of an example method of forming a custom spacer and storing the spacer according to the present disclosure.
Figure 51:
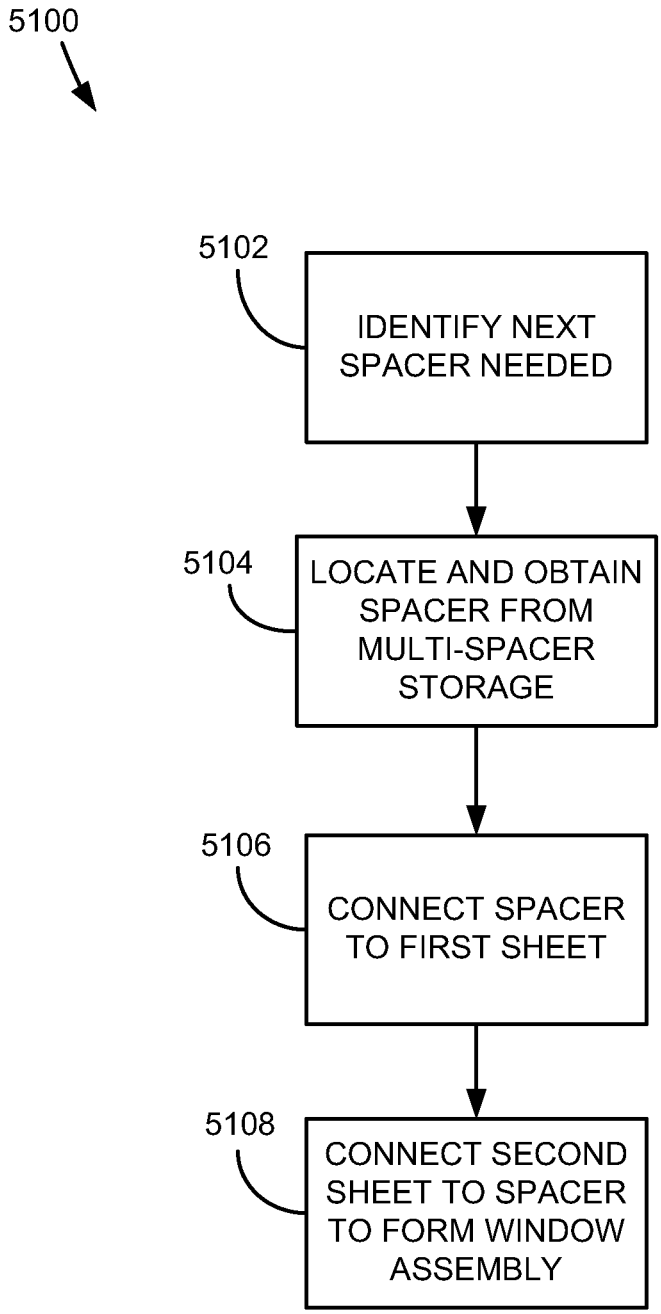
FIG. 51 is a flow chart of an example method of retrieving a stored spacer and connecting the stored spacer to sheets to form a sealed unit according to the present disclosure.
Figure 52:
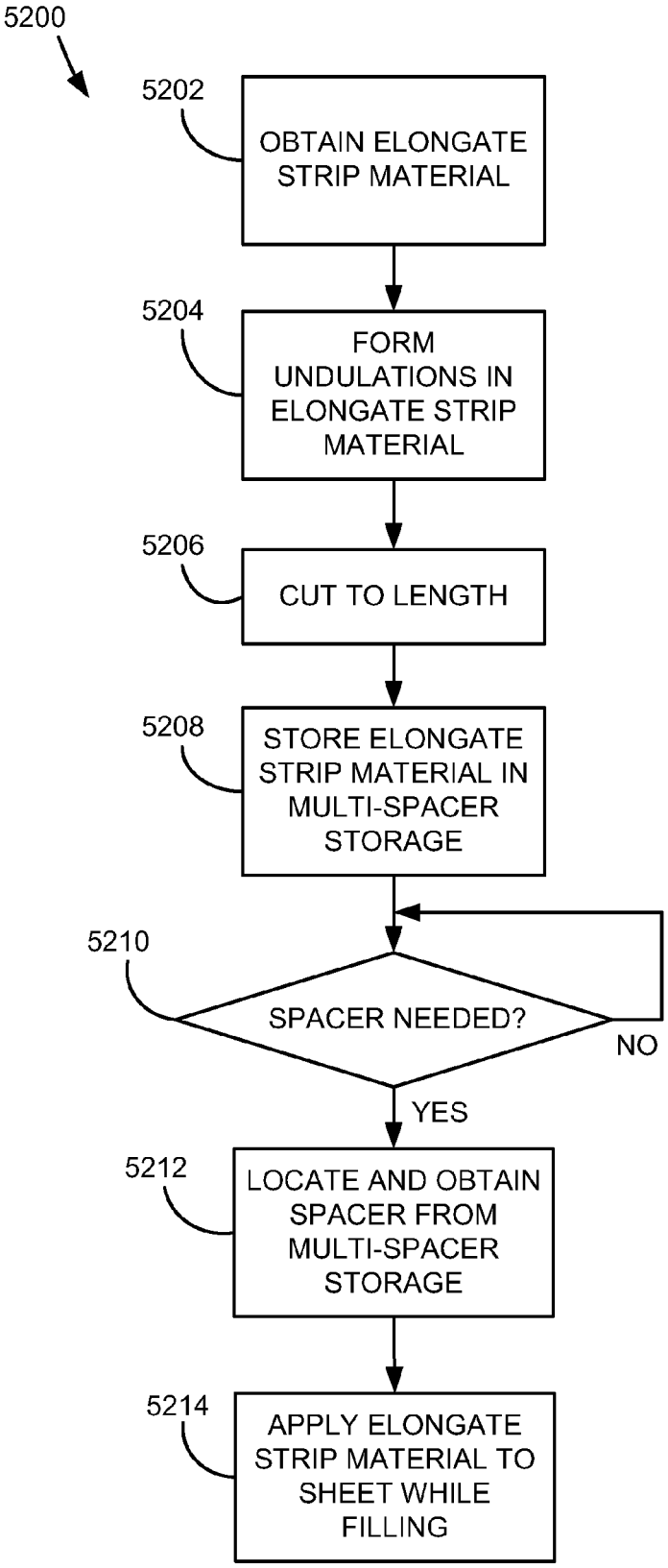
FIG. 52 is a flow chart of an example method of forming and connecting a spacer to a first sheet according to the present disclosure.

FIGS. 49-52 illustrate alternate embodiments of methods useful in the manufacture of a sealed unit. FIG. 49 illustrates an example method of making and storing a spacer. FIG. 50 illustrates an example method of customizing and storing a spacer. FIG. 51 illustrates an example method of retrieving a stored spacer and connecting the stored spacer to sheets to form a sealed unit. FIG. 52 illustrates an example method of forming and connecting a spacer to a first sheet.

FIG. 49 is a flow chart of an example method 4900 of making and storing a spacer. The method includes operations 4902, 4904, and 4906. It is sometimes desirable to store assembled spacers prior to connection with window sheets. A multi-spacer storage is provided for this purpose, such as shown in FIGS. 54-57.

Method 4900 begins with operation 4902 during which a spacer is formed. An example of forming a spacer includes operations 4802, 4804, 4806, and 4808 described with reference to FIG. 48. The spacer includes one or more elongate strips, and preferably two or more elongate strips having an undulating shape. Filler is arranged between the elongate strips.

After formation of the spacer, operation 4904 is performed to allow the spacer to cool, if necessary. In some embodiments, filler is heated when inserted between elongate strips. It is advantageous to allow the filler to cool to allow the filler to set in the appropriate configuration, such as to prevent slumping, dripping, or deformation of the filler. In addition, if the spacer is allowed to cool while straight, the spacer will be less prone to curl during installation. However, operation 4904 is not required by all embodiments. In some embodiments, operation 4904 is performed during or after operation 4906.

Operation 4906 is next performed to store the spacer in multi-spacer storage. In one exemplary embodiment, the spacer is rolled onto a spool. The spool is then placed into a location of the storage rack. An example of a storage rack and spool are described with reference to FIGS. 54-60. A control system is used in some embodiments, and includes memory and a processing device, such as a microprocessor. In some embodiments the control system is a computer. In some embodiments, the control system stores information about the spacer in memory (such as in a lookup table) along with an identifier of the location of the spacer. In this way the control system is subsequently able to locate the spacer and retrieve the spacer from storage. In some embodiments a robotic arm is used to retrieve a spool and spacer from storage.

As each spacer is made, the spacer is rolled onto a spool and stored in the multi-spacer storage, such that a plurality of spacers are stored in the multi-spacer storage. Alternatively, spacers are not rolled but rather are substantially straight when stored, such as on a shelf or in an elongated compartment.

In alternate embodiments, operation 4906 involves storing elongate strips in multi-spacer storage prior to inserting filler. In this embodiment, the method proceeds by storing only elongate strips of the spacer in multi-spacer storage (operation 4906). Then the spacer is formed (operation 4902) and allowed to cool (operation 4904). For example, a pair of elongate strips can be rolled together on a single spool. The elongate strips are then placed into storage. The elongate strips are subsequently retrieved and filled to assemble the spacer.

FIG. 50 is a flow chart of an example method 5000 of forming a custom spacer and storing the spacer. Method 5000 includes operations 5002, 5004, 5006, and 5008. Method 5000 begins with operation 5002, during which a spacer is obtained. In this method, the spacer has already been manufactured (such as by performing at least operations 4802 and 4808 shown in FIG. 48) and the manufactured spacer is now obtained.

Operation 5004 is next performed, during which the spacer is cut to length. The length is determined in some embodiments by the size of the window with which the spacer will be assembled. Operation 5004 is performed either manually or automatically. For example, a cutting tool such as a scissors or tin snips are used by a person to cut the spacer to length. As another example, a punch press is used to cut the spacer to length. Other cutting tools or devices are used in other embodiments.

Operation 5006 is next performed, during which the cut spacer is rolled in preparation for storage. In some embodiments, the spacer is rolled onto a spool. In some embodiments the spool has a diameter sufficient to prevent the spacer from being bent too far and damaged.

Operation 5008 is next performed, during which the spacer is stored in multi-spacer storage. In some embodiments, the multi-spacer storage is a structure, apparatus, or device that stores spacers in an organized manner. Examples include a shelving unit, a box or set of boxes, a cabinet, a drawer or set of drawers, a rack, conveyor belt, or any other suitable storage unit. An example of a storage rack is described with reference to FIGS. 54-57. The multi-spacer storage is a passive structure in some embodiments, but an active structure in other embodiments. For example, an active structure includes motors and drive mechanisms for moving, locating, rearranging, or obtaining a spacer from the multi-spacer storage, in some embodiments. A processing device such as a computer is used to control the multi-spacer storage in some embodiments.

FIG. 51 is a flow chart of an example method 5100 of retrieving a stored spacer and connecting the stored spacer to sheets to form a sealed unit. Method 5100 includes operations 5102, 5104, 5106, and 5108.

Method 5100 begins with operation 5102 during which a spacer is identified that is needed for the next sealed unit that is going to be assembled. In some embodiments, spacers are stored in multi-spacer storage in the intended order of manufacture. In such embodiments, operation 5102 involves identifying the next spacer in the multi-spacer storage. A problem that can arise during the manufacture of window assemblies is that window sheets sometimes do not arrive in the expected order. For example, if a window sheet breaks, cracks, or is found to have some other defect, the window sheet may be removed. If that occurs, the spacer that would have been used for assembly with that window sheet should remain in storage (or be returned to storage) for later use when a replacement sheet has been obtained.

As a result, some embodiments operate to identify the next spacer that is needed. In one example, an identifier, such as a number, label, or barcode is placed on the sheet. The sheet is advanced along a conveyor belt. A reader is arranged adjacent the conveyor belt and reads the identifier on the sheet. The reader conveys the information from the identifier to a control system. The control system matches the identifier with an associated spacer stored in the multi-spacer storage to identify the next spacer needed. Alternatively, operation 5102 is performed manually.

Once the next spacer has been identified, operation 5104 is then performed to locate and obtain the spacer from multi-spacer storage. In some embodiments, operation 5104 involves locating the next spacer within multi-spacer storage according to a predetermined order.

In other embodiments, operation 5104 is performed by a control system. For example, the control system stores a lookup table in memory. The lookup table includes a list of spacer identifiers and the location of an associated spacer in the multi-spacer storage. In some embodiments the lookup table includes a plurality of rows and columns. In one example, spacer identifiers are arranged in a first column and location identifiers are stored in a second column such that the spacer identifier and the location identifier are associated with each other. The control system uses the lookup table to match the identifier (from operation 5102) with the identifier in the lookup table to determine the location of the associated spacer in the multi-spacer storage. In some embodiments, the lookup table includes additional information, such as the characteristics of each spacer stored in multi-spacer storage. In this way, the lookup table can be used to search for a spacer that has one or more desired characteristics. Examples of such characteristics include thickness, width, length, material type, filler type, color, filler thickness, and other characteristics. In some embodiments each characteristic is associated with a separate column of the lookup table.

Once the spacer has been located in multi-spacer storage, the spacer is obtained. In some embodiments, a robot or other automated device is used to remove the spacer from multi-spacer storage. Alternatively, the spacer is manually removed.

After the spacer has been obtained from multi-spacer storage, operation 5106 is next performed to connect the spacer to a first sheet. An example of operation 5106 is operation 4810 described with reference to FIG. 48.

With the spacer connected to the first sheet, operation 5108 is next performed to connect a second sheet to the opposite edge of the spacer to form a sealed unit. An example of operation 5108 is operation 4812 described with reference to FIG. 48. In an alternate embodiment, operations 5106 and 5108 are performed simultaneously. Operation 5108 is not required in all embodiments.

In alternate embodiments, elongate strips are stored in multi-spacer storage without filler. In such embodiments, the filler is inserted between the elongate strips while the spacer is being connected to one or more window sheets.

FIG. 52 is a flow chart of an exemplary method 5250 of forming and connecting a spacer to a first sheet. Method 5250 includes operations 5202, 5204, 5206, 5208, 5210, 5212, and 5214.

Method 5200 begins with operation 5202. During operation 5202 elongate strip material is obtained. In this example, filler has not yet been inserted between elongate strips to form a complete spacer. Rather, the elongate strip material itself is obtained. In some embodiments, the elongate strip material is made of metal or plastic. Other embodiments include other materials. Operation 5202 is not required in all embodiments.

Operation 5204 is then performed, if desired, to form undulations in the elongate strip material. In one example, the elongate strips are passed through a roll-former that forms the undulations in the elongate strip material. The undulations are formed, for example, by bending the elongate strip material into the desired shape. An advantage of some embodiments is increased stability of a resulting spacer. Another advantage of some embodiments is increased flexibility of the elongate strip material and a resulting spacer. Yet another advantage of some embodiments is ease of manufacturing, such as during operation 5214, described below.

Operation 5206 is then performed to cut the elongate strips to length. Cutting is performed by any suitable cutting device, including a manual cutting tool or an automated cutting device. In some embodiments two or more elongate strips are cut simultaneously to form elongate strips having uniform lengths.

By performing operation 5206 after operation 5204, the length of the undulating elongate strip is more precisely controlled. However, in other embodiments operation 5206 is performed at any time before or after operations 5202, 5204, 5208, 5210, 5212, or 5214. If cutting is performed prior to operation 5204, the elongate strip is cut longer than the desired final elongate strip length. The reason is that forming undulations in the elongate strip material (operation 5204) typically reduces the overall length of the elongate strip. However, in some embodiments the elongate strip material is stretched during operation 5204 such that the length before and after operation 5204 is substantially the same.

Operation 5208 is then performed to store elongate strip material in multi-spacer storage. Examples of operation 5208 are operations 4906 and 5008 described herein with reference to FIGS. 49 and 50, respectively.

After at least one spacer has been stored in multi-spacer storage, operation 5210 is performed to determine whether a spacer is needed. If it is determined that a spacer is needed at this time, operation 5212 is performed. If it is determined that a spacer is not needed at this time operation 5210 is repeated until a spacer is needed.

In some embodiments, operations 5202 through 5208 operate independently of operations 5210 through 5214. In other words, operations 5202 and 5208 can, in some embodiments, operate simultaneously with operations 5210 through 5214, when needed.

Once it is determined in operation 5210 that a spacer is needed, operation 5212 is performed to locate and obtain the spacer from multi-spacer storage. This is accomplished, for example, by accessing a lookup table. The spacer is identified in the lookup table as well as the location of the spacer in the multi-spacer storage. The spacer is then obtained from that location in the multi-spacer storage. In another embodiment, operation 5212 is performed manually, by physically inspecting the multi-spacer storage and selecting an appropriate spacer.

With the appropriate elongate strip has been located and obtained, operation 5214 is next performed. During operation 5214 the elongate strip material is applied to a sheet while a filler is inserted between the elongate strips. Examples of operation 5214 are illustrated and described herein.

Figure 53:
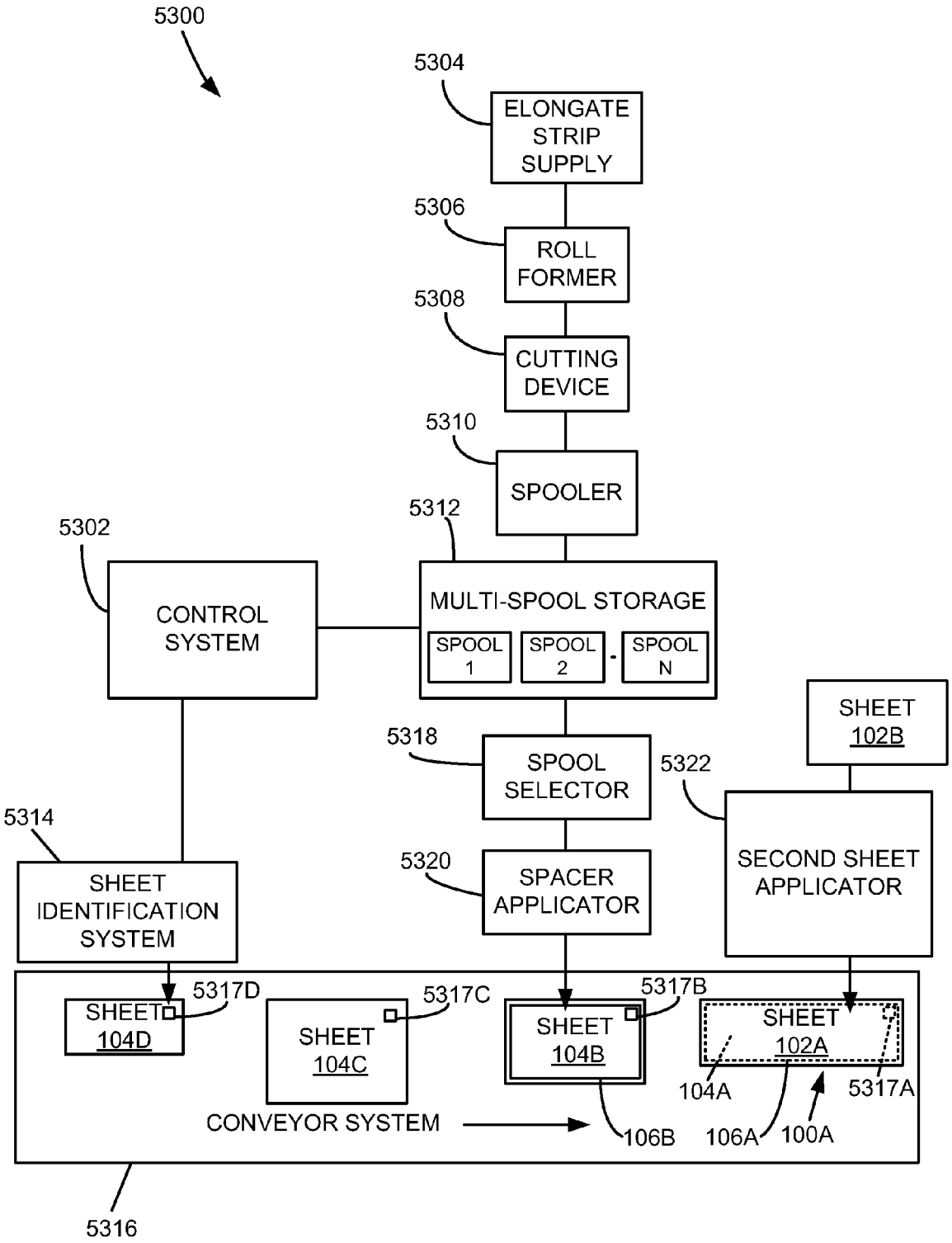
FIG. 53 is a schematic block diagram of an example manufacturing system for manufacturing a sealed unit according to the present disclosure.

FIG. 53 is a schematic block diagram of an example manufacturing system 5300 for manufacturing window assemblies. The present disclosure describes various manufacturing systems, and one particular embodiment is illustrated in FIG. 53. Other embodiments include other devices and operate to perform other methods, such as described herein. Yet other embodiments of manufacturing system 5300 include fewer devices, systems, stations, or components than shown in FIG. 53.

Manufacturing system 5300 includes control system 5302, elongate strip supply 5304, roll-former 5306, cutting device 5308, spooler 5310, multi-spool storage 5312, sheet identification system 5314, conveyor system 5316, spool selector 5318, spacer applicator 5320, and second sheet applicator 5322. In some embodiments, manufacturing system 5300 operates to manufacture a spacer 106 while applying the spacer 106 to a sheet 104. A second sheet 102 is subsequently applied to form a complete sealed unit.

Control system 5302 controls the operation of manufacturing system 5300. Examples of suitable control systems include a computer, a microprocessor, central processing units ("CPU"), microcontroller, programmable logic device, field programmable gate array, digital signal processing ("DSP") device, and the like. Processing devices may be of any general variety such as reduced instruction set computing (RISC) devices, complex instruction set computing devices ("CISC"), or specially designed processing devices such as an application-specific integrated circuit ("ASIC") device. Typically, control system 5302 includes memory for storing data and a communication interface for sending and receiving data communication with other devices. Additional communication lines are included between control system 5302 and the rest of the manufacturing system 5300 in some embodiments. In some embodiments a communication bus is included for communication within manufacturing system 5300. Other embodiments utilize other methods of communication, such as a wireless communication system.

Manufacturing begins with an elongate strip supply 5304. Elongate strip supply 5304 includes elongate strip material, such as in a rolled form. In some embodiments, a variety of elongate strip materials are provided. Control system 5302 selects among the available elongate strip materials to choose an elongate strip material appropriate for a particular sealed unit.

Elongate strip material is then transferred to roll-former 5306. Roll-former bends or shapes elongate strip material into a desired form, such as to include an undulating shape. In some embodiments a roll-former is not included and flat elongate strips are used that do not have an undulating shape. In other embodiments, elongate strip supply provides elongate strip material that already contains an undulating shape, such that roll-former is unnecessary.

The elongate strip material is next passed to cutting device 5308. Cutting device 5308 cuts the elongate strip material to the desired length for the sealed unit. The completed elongate strip material is then rolled onto a spool with spooler 5310, and subsequently stored in multi-spool storage 5312 with other spools of elongate strip material. An example of a multi-spool storage 5312 is spool storage rack 5400, shown in FIG. 54. In other embodiments, multi-spool storage 5312 includes a plurality of storage racks 5400.

Sheet identification system 5314 operates to identify sheets 104 as they are delivered along conveyor system 5316. For example, sheets 104A, 104B, 104C, 104D each include an associated sheet identifier 5317A, 5317B, 5317C, and 5317D. An example of a sheet identifier 5317 is a barcode, a printed label, a radio frequency (RF) identification tag, a color coded label, or other identifier. Sheet identification system 5314 reads sheet identifier 5317 and sends the resulting data to control system 5302 to identify sheet 104. One example of sheet identification system 5314 is a barcode reader. Another example of sheet identification system 5314 is a charge-coupled device (CCD). In some embodiments sheet identification system 5314 reads digital data encoded by sheet identifier 5317 and transmits the digital data to control system 5302. In other embodiments a digital photograph of sheet identification system 5314 is taken and the digital photograph is transmitted to control system 5302. In another embodiment, sheet identification system 5314 is a magnetic or radio frequency receiver that receives data from sheet identifier 5317 identifying sheet 104, which sheet identification system 5314 then transmits to control system 5302. Other embodiments include other identifiers 5317 and other sheet identification systems 5314. Yet other embodiments include only a single size and/or type of sheet, such that identification of a sheet is not necessary.

Once the next sheet 104 on conveyor system 5316 has been identified by control system 5302, control system 5302 instructs spool selector 5318 to obtain one or more spools containing the appropriate elongate strips from multi-spool storage 5312. Spool selector 5318 obtains the spool and provides the elongate strip material to spacer applicator 5320. At the same time, conveyor system 5316 advances the sheet toward spacer applicator 5320.

Spacer applicator 5320 next operates to form spacer 106 (e.g., 106B) on sheet 104 (e.g., 104B). Spacer applicator 5320 receives the elongate strip material and inserts an appropriate filler material while applying the resulting spacer 106 onto sheet 104 (e.g., 104B). In some embodiments spacer applicator 5320 includes a jig and nozzle, such as illustrated and described with reference to FIGS. 26-47.

After spacer 106 has been applied to sheet 104, conveyor system 5316 advances sheet 104 toward second sheet applicator 5322. Second sheet applicator 5322 obtains a sheet 102 (e.g., 102B) and arranges the sheet onto spacer 106B, such that sheets 102 and 104 are on opposite sides of spacer 106. In this way a complete sealed unit 100 (e.g., 100A) is formed.

In some embodiments, other known window processing techniques are used in addition to those specifically illustrated and described herein. Such processing steps may be performed prior to, during, or after placing sheet 102 onto spacer 106. For example, a vacuum evacuation step is performed to remove air from an interior space defined by sheets 102 and 104 and spacer 106 in some embodiments. Alternatively, a gas purge is used to introduce a desired gas into the interior space in some embodiments. In some embodiments, muntin bars or other additional features of the sealed unit are inserted during the manufacture of a sealed unit.

Figure 54:
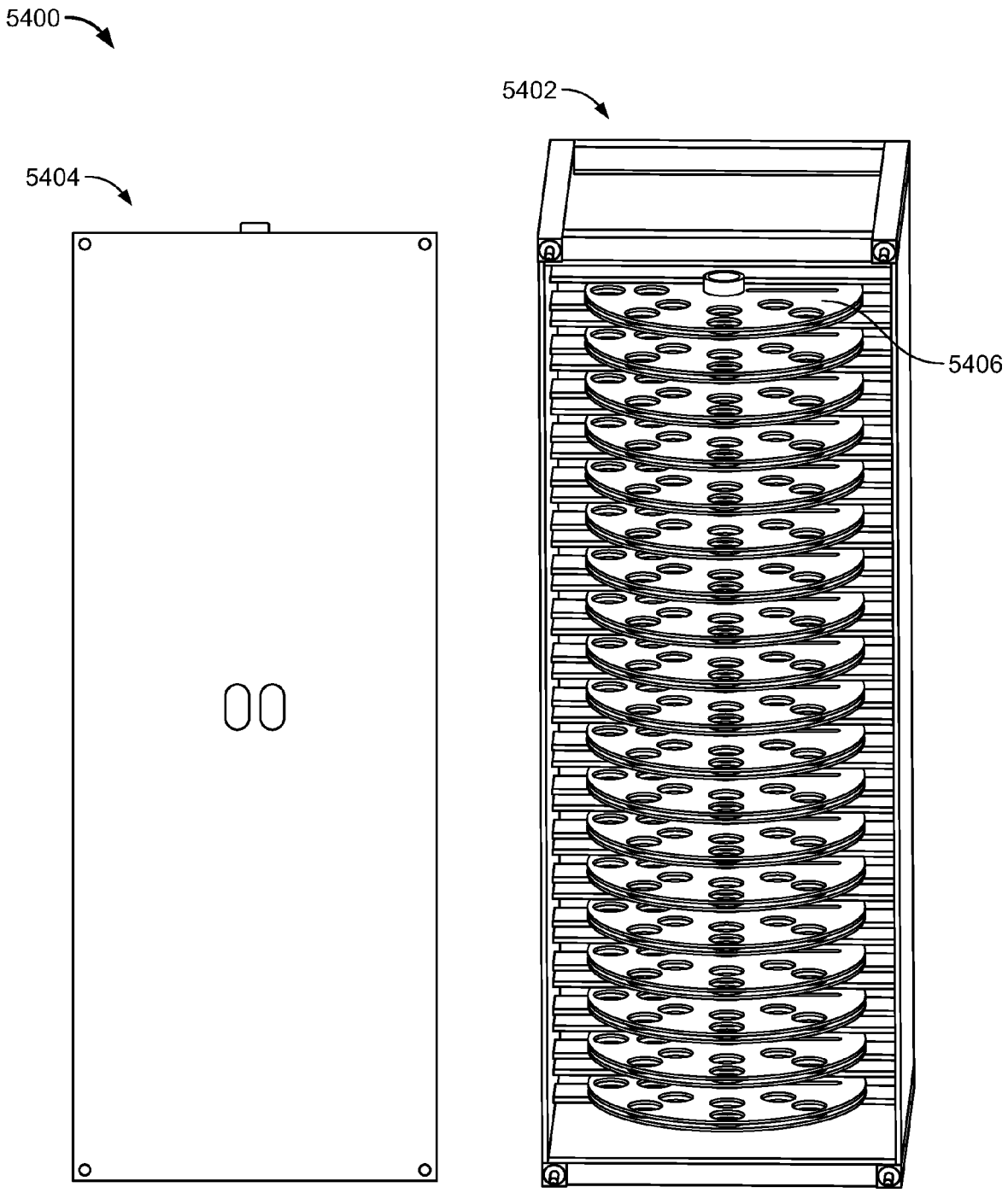
FIG. 54 is a schematic partially exploded perspective top view of an example spool storage rack according to the present disclosure, the spool storage rack including a plurality of example spools for storing spacer material.
Figure 55:
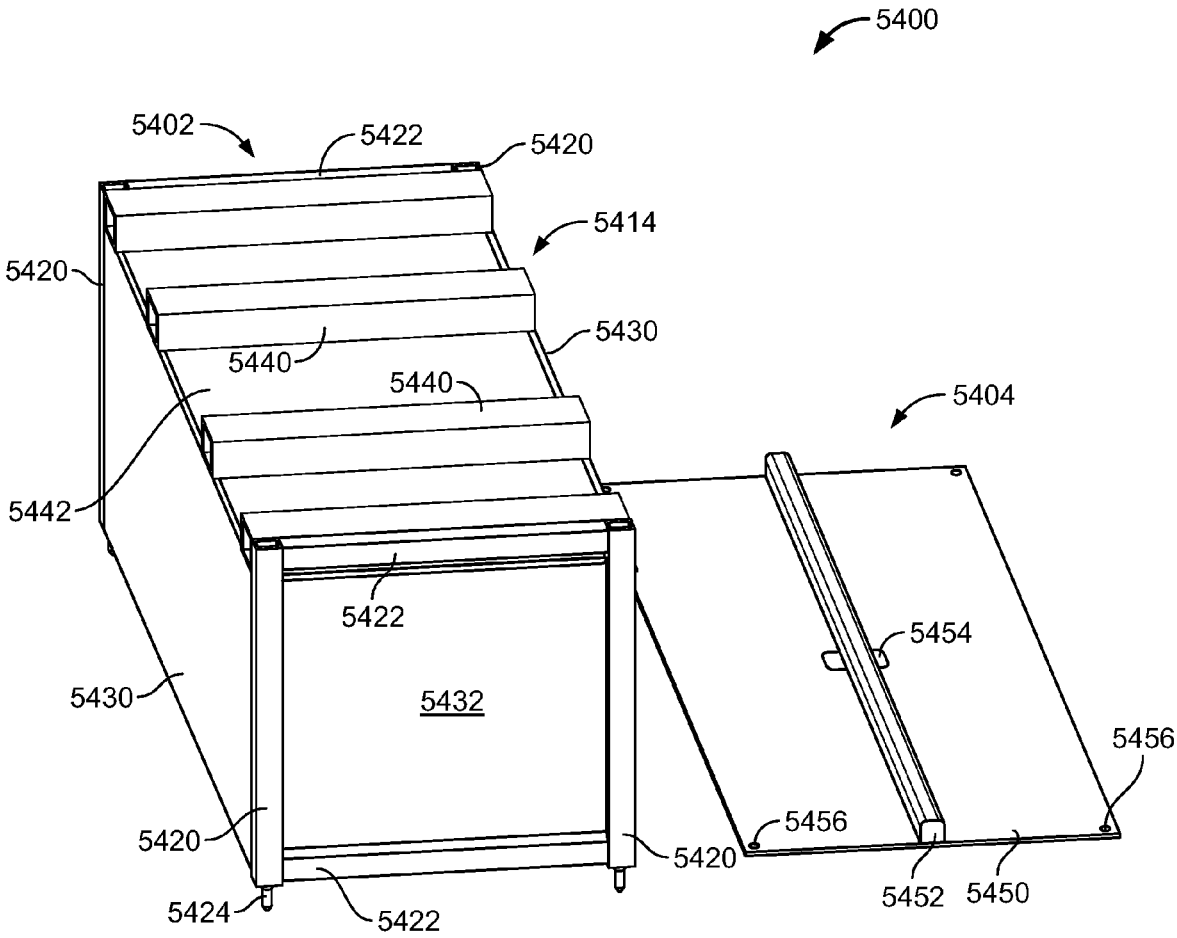
FIG. 55 is a schematic partially exploded perspective bottom and side view of the example spool storage rack shown in FIG. 54.
Figure 56:
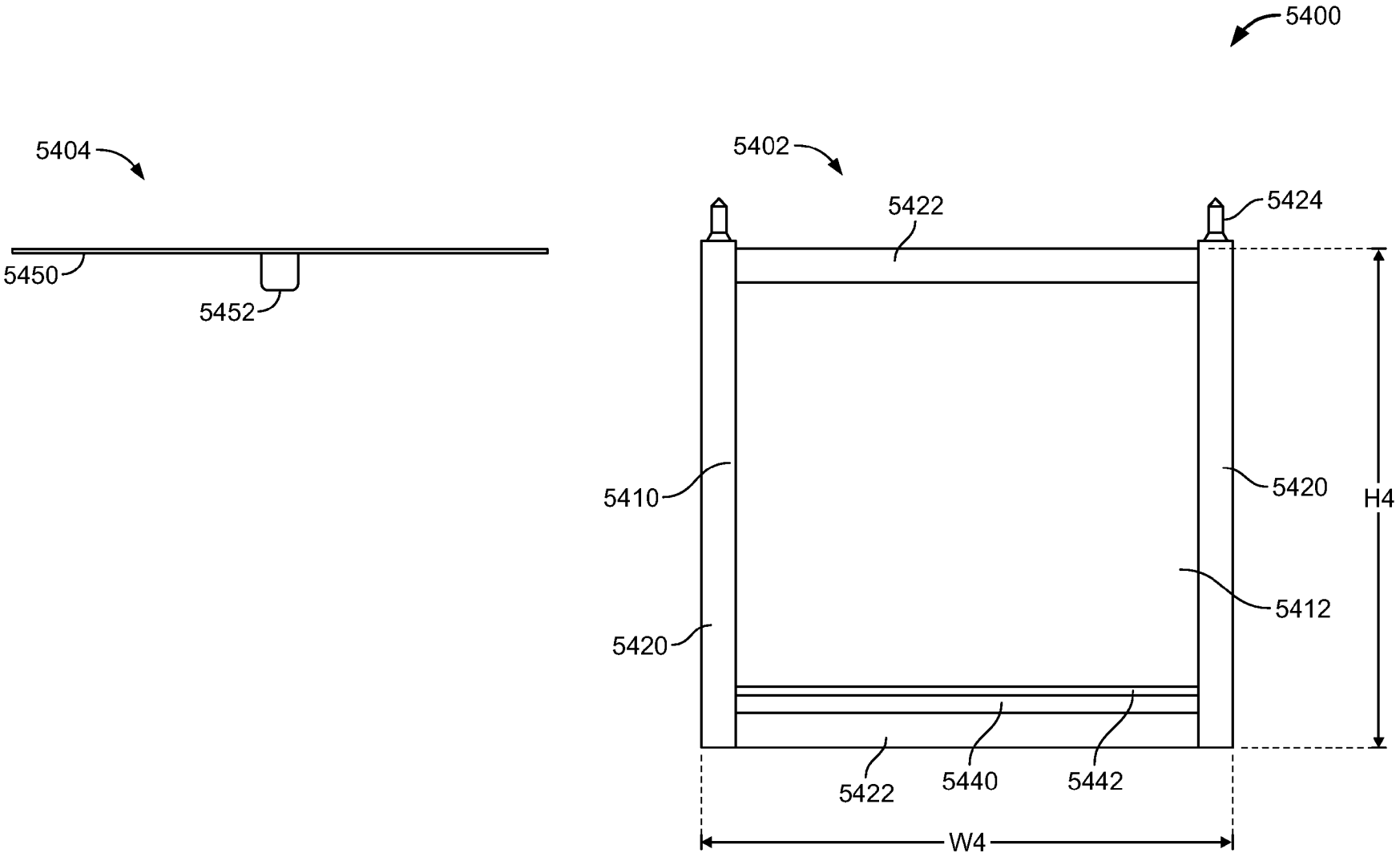
FIG. 56 is a schematic partially exploded side view of the spool storage rack shown in FIG. 54.
Figure 57:
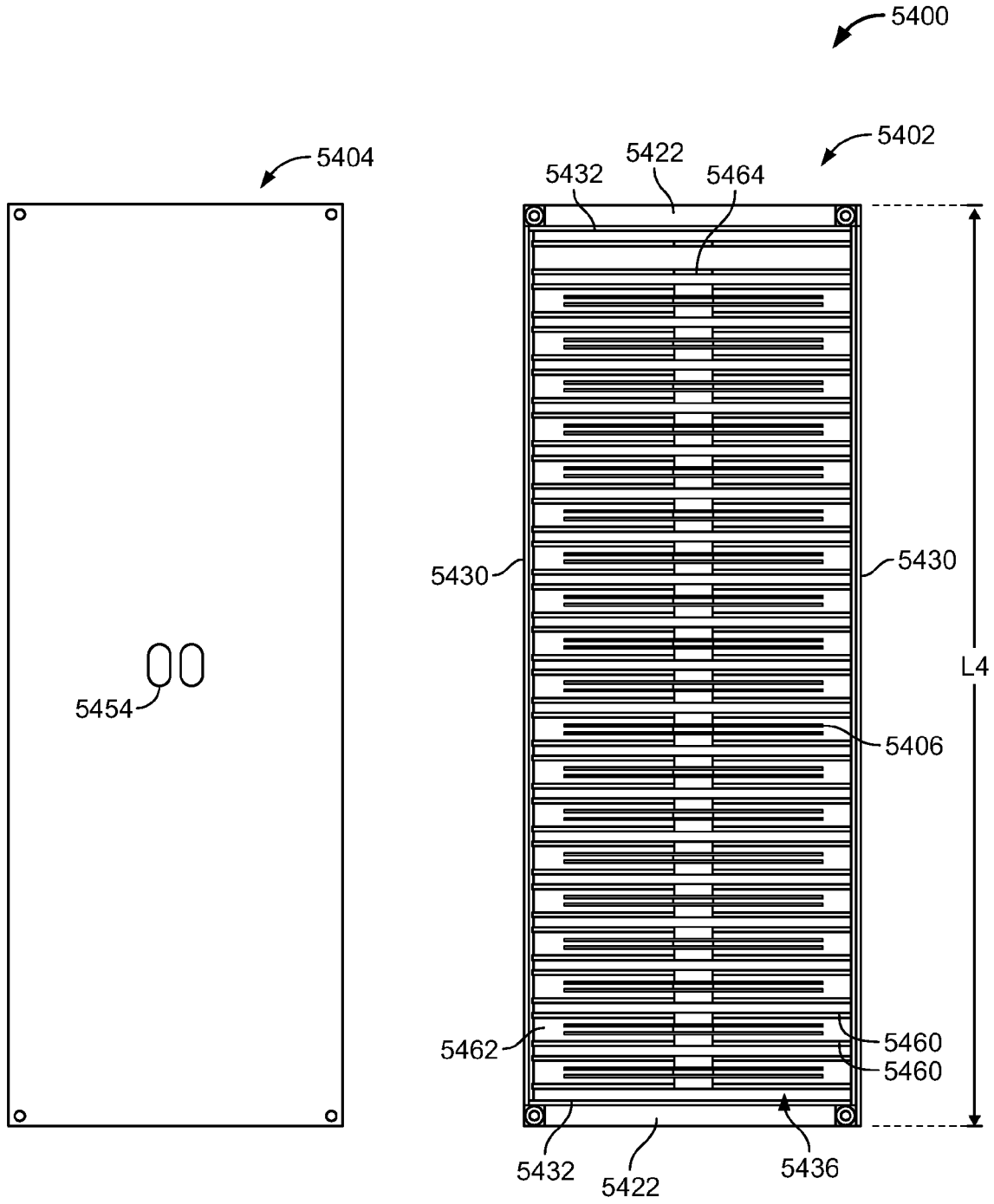
FIG. 57 is a schematic partially exploded top view of the spool storage rack shown in FIG. 54.

FIGS. 54-57 illustrate an example spool storage rack 5400 according to the present disclosure. FIG. 54 is a schematic partially exploded perspective top view. FIG. 55 is a schematic partially exploded perspective bottom and side view. FIG. 56 is a schematic partially exploded side view. FIG. 57 is a schematic partially exploded top view.

Spool storage rack 5400 includes body 5402 and cover 5404. Spool storage rack 5400 stores a plurality of spools 5406. In some embodiments spools 5406 contain a length of a spacer 106 (e.g., shown in FIG. 1). In some embodiments spools 5406 contain a length sufficient to make a plurality of spacers 106. In other embodiments, spools 5406 contain a length of one or more elongate strips (e.g., elongate strips 110 and 114, shown in FIGS. 1-2). In some embodiments elongate strips 110 and 114 are flat ribbons of material. In other embodiments elongate strips 110 and 114 are long and thin strips of material that have an undulating shape. In some embodiments one or more elongate strips 110 and 114 include additional features, such as apertures 116 (shown in FIG. 2).

As shown in FIG. 55, in some embodiments, body 5402 includes frame 5410, sidewalls 5412, and pallet 5414. Frame 5410 includes vertical frame members 5420 and horizontal frame members 5422. In this example, vertical frame members 5420 and horizontal frame members 5422 are connected to form squares at each end of spool storage rack 5400. In some embodiments frame 5410 includes hollow frame members, such as made of metal, wood, plastic, carbon fiber, or other materials.

Pins 5424 are connected to and extend vertically upward from vertical frame members 5420 in some embodiments. Pins 5424 are configured to engage with apertures 5456 of cover 5404. In addition, in some embodiments pins 5424 are longer than the thickness of cover 5404 and can be used to support and align another spool storage rack on top of spool storage rack 5400. For example, if a second spool storage rack (including vertical frame members 5420) is arranged on top of spool storage rack 5400, pins 5424 are sized to fit into the bottom ends of vertical frame members 5420. This ensures proper alignment of the stacked spool storage rack and also acts to prevent side-to-side or front-to-back movement of the second spool storage rack relative to spool storage rack 5400 during transportation of the multiple spool storage racks. In some embodiments pins 5424 are threaded.

In some embodiments, sidewalls 5412 include longitudinal sidewalls 5430 and lateral sidewalls 5432. Sidewalls 5412 are connected to each other at ends and define an interior cavity 5436 (shown in FIG. 57) with pallet 5414 and cover 5404 in which spools 5406 are stored. Lateral sidewalls 5432 are connected to and supported by frame 5410.

Pallet 5414 includes stringer boards 5440 and deckplate 5442. Pallet 5414 forms the base of spool storage rack 5400. Stringer boards 5440 define channels therebetween into which a fork of a forklift can be inserted to lift pallet 5414 by deckplate 5442. In some embodiments stringer boards 5440 are hollow tubes, such as made of metal, wood, plastic, carbon fiber, or other materials. Stringer boards 5440 are connected to a bottom surface of deckplate 5442 and are spaced from each other a sufficient distance to receive fork tines therebetween.

In some embodiments deckplate 5442 is a single sheet of material, such as metal, wood (including plywood, particle board, and the like), plastic, carbon fiber, or other material or combination of materials. In other embodiments, deckplate 5442 is made of multiple boards. In this example stringer boards 5440 extend laterally across deckplate 5442. In other embodiments stringer boards 5440 extend longitudinally across deckplate 5442.

As shown in FIG. 55, cover 5404 includes cover sheet 5450 and bracing member 5452 in some embodiments. Cover 5404 is arranged and configured to enclose a top side of spool storage rack 5400. Cover 5404 includes corner apertures 5456 and handle apertures 5454. Bracing member 5452 provides structural support to cover sheet 5450. Handle apertures 5454 are formed through cover sheet 5450 and preferably toward a center of cover sheet 5450, to provide a handle for easy removal of cover 5404 from body 5402.

Cover 5404 is connectable to body 5402. To do so, cover 5404 is arranged vertically above body 5402 and corner apertures 5456 are vertically aligned with pins 5424. Cover 5404 is then lowered until cover sheet 5450 comes into contact with frame 5422 and/or sidewalls 5430. In some embodiments, nuts (e.g., hex nuts or wingnuts not shown) are screwed onto pins 5424 to prevent cover 5404 from unintentionally disengaging from body 5402.

Referring now to FIG. 56, dimensions for one example embodiment are provided. Other embodiments include other dimensions. H4 is the height of spool storage rack 5400 not including pins 5424. H4 is typically in a range from about 1 foot (about 0.3 meter) to about 4 feet (about 1.2 meters), and preferably from about 20 inches (about 50 centimeters) to about 30 inches (about 76 centimeters). W4 is the width of spool storage rack 5400. W4 is typically in a range from about 1 foot (about 0.3 meter) to about 4 feet (about 1.2 meters), and preferably from about 2 feet (about 0.6 meter) to about 3 feet (about 0.9 meter).

Referring now to FIG. 57, additional dimensions for one example embodiment are provided. L4 is the length of spool storage rack 5400. L4 is typically in a range from about 4 feet (about 1.2 meters) to about 8 feet (about 2.5 meters), and preferably from about 5 feet (about 1.5 meters) to about 7 feet (about 2 meters).

Spool storage rack 5400 includes an interior cavity 5436 for the storage of a plurality of spools. Within the interior cavity 5436 are a plurality of lateral dividers 5460 that are connected to interior sides of sidewalls 5430. Lateral dividers 5460 are spaced from each other to define spool receiving slots 5462. Top edges of lateral dividers 5460 include a notch 5464 at the center to receive and support ends of a core of spool 5406. The notch 5464 prevents spools 5406 from being displaced in any direction other than vertically upward from spool receiving slot 5462. When cover 5404 is arranged on top of spool storage rack 5400, cover 5454 further prevents spools 5406 from displacing vertically upward from spool receiving slot 5462. In this way, spools 5406 are securely contained within spool storage rack 5400.

FIGS. 58-60 illustrate an example spool 5406 configured to store spacer 106 material. In some embodiments spool 5406 stores an assembled spacer including at least one or more elongate strips and a filler material. In other embodiments, spool 5406 stores only one or more elongate strips.

FIG. 58 is a schematic perspective view of the example spool 5406. In this example, spool 5406 includes core 5802 and sidewalls 5804 and 5806. Core 5802 has a generally cylindrical shape and extends through both of sidewalls 5804 and 5806. Core 5802 provides a cylindrically shaped surface inside spool 5406 on which spacer material is wound.

Core 5802 also extends out from both sides of spool 5406 to form grips 5810 and 5812 (not visible in FIG. 58). Grips 5810 and 5812 are used in some embodiments to support spool 5406. For example, in some embodiments spool 5406 is stored in spool storage rack 5400 by resting grips 5810 and 5812 in notches 5464. Notches 5464 support grips 5810 and 5812 to hold spool 5406 in place. Further, in some embodiments an automated spool retrieval mechanism is used to extract a desired spool 5406 from spool storage rack 5400, by reaching into spool storage rack 5400 and grasping grips 5810 and 5812 of the desired spool 5406. The spool 5406 is then retrieved.

In some embodiments core 5802 is hollow. If desired, a rod can be inserted through core 5802. The rod allows spool 5406 to freely rotate around the rod to dispense spacer material contained on spool 5406. Alternatively, the rod can engage with core 5802, such as by including an expansion mechanism to grip the interior of core 5802. The rotation of the spool 5406 is then controlled by rotating the rod.

Sidewalls 5804 and 5806 are connected to and extend radially from core 5802. Sidewalls 5804 and 5806 are typically arranged in parallel planes and are spaced from each other a distance greater than the width of spacer material to be stored thereon. Sidewalls 5804 and 5806 guide spacer material onto core 5802 during winding and guide spacer material off of the core 5802 during unwinding. Sidewalls 5804 and 5806 also prevent spacer material from sliding off of core 5802.

FIG. 59 is a schematic side view of the example spool 5406 shown in FIG. 58. Spool 5406 includes core 5802, sidewall 5804 (not visible in FIG. 59), and sidewall 5806. Window 5902 is formed in one or both of sidewalls 5804 and 5806 in some embodiments. Lightening apertures 5904 are also formed in one or both of sidewalls 5804 and 5806 in some embodiments. Spool 5406 also includes a central axis A10 of rotation.

Core 5802 includes an outer surface 5820 and an inner surface 5822. Dimensions for one example of spool 5406 are as follows. D30 is the overall diameter of spool 5406. D30 is typically in a range from about 1 foot (about 0.3 meter) to about 4 feet (about 1.2 meters), and preferably from about 1.5 feet (about 0.5 meter) to about 2.5 feet (about 0.76 meter). D32 is the outer diameter of core 5802 around outer surface 5820. D32 is typically in a range from about 1 inch (about 2.5 centimeters) to about 6 inches (about 15 centimeters), and preferably from about 3 inches (about 7.6 centimeters) to about 5 inches (about 13 centimeters). D32 is large enough to prevent damaging spacer material when the spacer material is wound thereon. D34 is the inner diameter of core 5802 around inner surface 5822. D34 is typically in a range from about 1 inch (about 2.5 centimeters) to about 6 inches (about 15 centimeters), and preferably from about 2 inches (about 5 centimeters) to about 4 inches (about 10 centimeters).

Window 5902 is a cutout region in sidewall 5806 that allows a user to visually inspect the quantity of spacer material remaining on spool 5406. In some embodiments a control system uses window 5902 to monitor the quantity of material remaining on spool 5406, such as using an optical detector.

Lightening apertures 5904 are formed in sidewalls 5804 and 5806 in some embodiments. Lightening apertures 5904 are holes that are drilled or otherwise machined through sidewalls 5804 and 5806 to reduce the weight of spool 5406.

Lightening apertures also reduce the total amount of material needed to make spool 5406 in some embodiments.

FIG. 60 is a schematic front view of the example spool 5406 shown in FIG. 58. Spool 5406 includes core 5802, sidewall 5804, and sidewall 5806. Core 5802 includes grip 5810 and grip 5812.

Example dimensions for one embodiment of spool 5406 are as follows. D36 is the space between an inner surface of sidewall 5804 and an inner surface of sidewall 5806. D36 is at least slightly larger than the width of spacer material to be stored on spool 5406. D36 is typically in a range from about 0.2 inches (about 0.5 centimeter) to about 2 inches (about 5 centimeters), and preferably from about 0.3 inches (about 0.76 centimeter) to about 1 inch (about 2.5 centimeters). D38 is the overall width of spool 5406 across core 5802. D38 is typically in a range from about 1 inch (about 2.5 centimeters) to about 6 inches (about 15 centimeters), and preferably from about 2 inches (about 5 centimeters) to about 4 inches (about 10 centimeters).

Spool 5406 is able to store long lengths of spacer material. In some embodiments a backing material is first wound around core 5802. The backing material is typically a thin material such as tape. The tape adheres to core 5802. An end of the spacer material is connected toward an end of the backing material. The spacer material is prevented from sliding along core 5802 by the backing material. In some embodiments the backing material has a length of at least about half of the diameter D30 of spool 5406. This allows the entire spacer material to be removed from spool 5406 before the entire backing material disengages from core 5802. In another possible embodiment, spacer material is directly connected to core 5802, such as by inserting an end of the spacer material into a slot formed through core 5802.

The length of spacer material that can be stored on spool 5406 varies depending on the thickness of the spacer material, the diameter D30 of spool 5406, and the diameter D32 of core 5802. As one example, a spool having an outer diameter of about 2 feet (about 0.6 meter) and a core diameter of about 3 inches (about 7.6 centimeters) will typically be able to hold a length of spacer material in a range from about 600 feet (about 180 meters) to about 1000 feet (about 300 meters) if the spacer has a thickness of about 0.2 inches (about 0.5 centimeter). If only elongate strip material is stored on spool 5406, the thickness may be considerably less than 0.2 inches (0.5 centimeter), such that a much greater length of spacer material can be stored on spool 5406. Less spacer material can be stored on spool 5406 if the thickness of the material is larger than 0.2 inches (0.5 centimeter).

Figure 61:
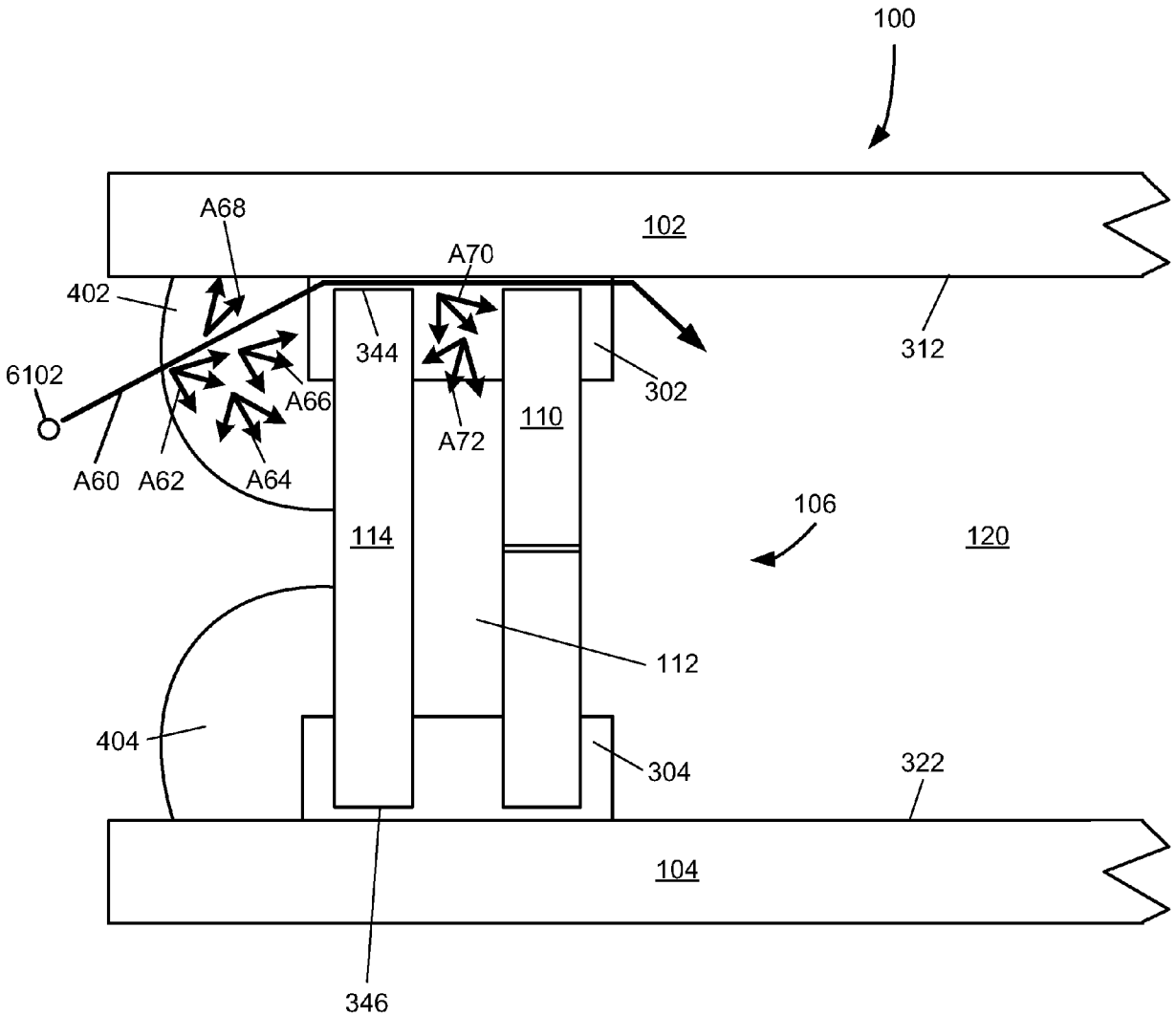
FIG. 61 is a schematic cross-sectional view of the spacer shown in FIG. 4.

Returning now to a previously discussed example spacer, FIG. 61 is a schematic cross-sectional view of an example spacer 106 arranged in a sealed unit 100. (This example embodiment was previously discussed with reference to FIG. 4 herein.) FIG. 61 illustrates how some embodiments provide an improved joint between spacer 106 and sheets 102 and 104.

An example particle 6102 (such as a gas atom or molecule) is shown. Spacer 106 blocks a large percentage of mass transfer from occurring between outside atmosphere and the interior space 120. Mass transfer is the process by which the random motion of particles (e.g., atoms or molecules) causes a net transfer of mass from an area of high concentration to an area of low concentration. It is preferable to prevent or reduce the amount of mass transfer to stop particles from the outside atmosphere from penetrating into the interior space 120, and similarly to stop desired particles from interior space 120 from leaking out into the atmosphere. The arrangement of spacer 106 (and many other embodiments discussed herein) forms a joint with sheets 102 and 104 that provides for reduced mass transfer in some embodiments.

To illustrate this, consider the path A60 that particle 6102 must take to pass from the outside atmosphere (the starting point in this example) to interior space 120 in this example. First particle 6102 must pass through secondary sealant 402 and into primary sealant 302. Particle 6102 must find its way to the small gap between elongate strip 114 and surface 312 of sheet 102 to enter the region between elongate strips 110 and 114. Next, the particle must find its way to the gap between elongate strip 110 and surface 312 of sheet 102. If all of these steps are taken, the particle may then pass into interior space 120.

Although path A60 is schematically illustrated as a straight line, the path of particle 6102 is anything but straight. Rather, particle 6102 moves randomly through the various regions. Only a few of the unlimited number of random paths are schematically represented by arrows A62, A64, A66, A68, A70, and A72. As suggested by these arrows, the random path of particle 6102 has a low probability of passing through secondary sealant 402 and into the gap between elongate strip 114 and sheet 102. If it does, the particle again has a very low probability of advancing to the gap between elongate strip 110 and sheet 102. In fact, once particle 6102 has entered the region between elongate strips 110 and 114, the particle may have an equally likely chance of passing back through the gap between elongate strip 114 and sheet 102 as of passing through the gap between elongate strip 110 and sheet 102. Therefore, the joint formed by spacer 106 with sheets 102 and 104 considerably reduces mass transfer between interior space 120 and the outside atmosphere.

Another advantage of some embodiments of spacer 106 is an improved resistance to strains from movement of sealed unit 100, sometimes referred to as pumping stress. When temperature changes occur, the temperature changes can cause sheets 102 and 104 to move. For example, sheets 102 and 104 may bend, such as moving from a slightly convex shape to a slightly concave shape and back. Further, wind and atmospheric pressure changes apply forces to sheets 102 and/or 104 and causes further movement of sealed unit 100. Spacer 106 is configured to form a joint with sheets 102 and 104 that has improved performance under such conditions.

In some embodiments elongate strips 110 and 114 have an undulating shape. The undulating shape provides a large surface area to which the sealant (e.g., 302 or 304) contact. The large surface area provides a strong joint between the elongate strips 110 and 114 and sheets 102 and 104. The large surface area further reduces the stress applied to the sealant, by distributing the force across a larger area.

Some embodiments of spacer 106 have the advantage of reduced sealant elongation during movement (e.g., pumping stress) of sealed unit 100. Sealant elongation can have a detrimental impact on a sealant, potentially leading to damage to the sealant. In some embodiments, sealant elongation is reduced, providing improved sealant performance.

In one example, sealants 302 and 304 have a thickness that is in a range from about 0.060 inches (about 0.15 centimeter) to about 0.150 inches (about 0.4 centimeter), and preferably in a range from about 0.1 inches (about 0.25 centimeter) to about 0.12 inches (about 0.3 centimeter). Due to the larger thickness of sealants 302 and 304 (as compared to, for example, a sealant having a thickness of 0.01 inches (0.025 centimeter)), the percentage of sealant elongation is reduced. If the total elongation of the sealant 302 or 304 caused by movement is about 0.02 inches (about 0.05 centimeter), the spacer elongation is in a range from about 13% to about 33%, and preferably from about 15% to about 20%. Thus, the joint provides for reduced sealant elongation.

A further advantage of some embodiments of spacer 106 is that elongate strips 110 and 114 are not directly connected and therefore can act independently. For example, when pumping stresses occur, a seal is maintained between both elongate strips 110 and 114 independently with sheets 102 and 104. Thus, both elongate strips and associated sealants provide improved protection to the sealed interior space 120 of the sealed unit.

Although the present disclosure describes various examples in the context of an entire sealed unit, the entire sealed unit is not required by all embodiments. For example, each of the example spacers described herein are themselves an embodiment according to the present disclosure that does not require the entire sealed unit. In other words, some embodiments of spacers do not require sheets of transparent material, even if a particular spacer was described herein in the context of a complete or partial sealed unit. Similarly, particular filler or sealant configurations are not required by all embodiments of a spacer, even if a particular spacer is described herein in the context of particular filler or sealant configurations. These examples are provided to describe example embodiments only, and such examples should not be construed as limiting the scope of the present disclosure.

Further, the present disclosure describes certain elements with reference to a particular example and other elements with reference to another example. It is recognized that these separately described elements can themselves be combined in various ways to form yet additional embodiments according to the present disclosure.

The various embodiments described above are provided by way of illustration only and should not be construed to limit the claims attached hereto. Those skilled in the art will readily recognize various modifications and changes that may be made without following the example embodiments and applications illustrated and described herein, and without departing from the intended scope of the following claims.

What is claimed is:

1. A window assembly comprising:

a first sheet of a translucent, transparent or semi-transparent material;

a second sheet of a translucent, transparent or semi-transparent material;

an intermediary sheet of a translucent, transparent or semi-transparent material between the first sheet and the second sheet;

a spacer extending from the first sheet to the second sheet, wherein the spacer comprises:

a first metal elongate strip having a first surface and having an undulating shape defining peaks, wherein the peaks extend in a direction that is transverse to a longitudinal direction of the first metal elongate strip;

a second metal elongate strip having a second surface and having an undulating shape, wherein the second surface is spaced from the first surface, and wherein each of the first elongate strip and the second elongate strip has a material thickness in a range from about 0.0001 inches (0.00025 cm) to about 0.01 inches (0.025 cm); and at least one filler arranged between the first and second surfaces, the filler including a desiccant; and a sealant material located between the spacer and the first sheet and between the spacer and the second sheet.

2. The window assembly of claim 1 further comprising an adhesive connecting the intermediary sheet to the second elongate strip of the spacer.

3. The Window assembly of claim 1, wherein the undulating shape has a peak to peak period in a range from about 0.005 inches (about 0.013 centimeter) to about 0.1 inches (about 0.25 centimeter).

4. The window assembly of claim 1 wherein the undulating shape has a peak-to-peak period of about 0.02 inches (about 0.05 centimeter) or more.

5. The window assembly of claim 1 wherein the undulating shape has a peak-to-peak period of about 0.04 inch (about 0.1 centimeter) or less.

6. The window assembly of claim 1 wherein the undulating shape has a peak-to-peak amplitude in a range from about 0.005 inches (about 0.013 centimeter) to about 0.1 inches (about 0.25 centimeter).

7. The window assembly of claim 1, wherein the metal is selected from the group consisting of stainless steel, titanium, aluminum, copper, zinc, manganese, an alloy including magnesium, an alloy including manganese, an alloy including silicon, or combinations thereof.

8. The window assembly of claim 1 wherein the metal is stainless steel.

9. The window assembly of claim 1, wherein each of the first elongate strip and the second elongate strip has a material thickness in a range from about 0.0003 inches (about 0.00076 centimeter) to about 0.004 inches (about 0.01 centimeter).

10. The Window assembly of claim 1, wherein the first elongate strip has a first width and the second elongate strip has a second width, and wherein the first width and the second width are each in a range from about 0.1 inches (about 0.25 centimeter) to about 2 inches (about 5 centimeter).

11. The window assembly of claim 10, wherein the first width is substantially equal to the second width.

12. The window assembly of claim 1, wherein at least a portion of the first elongate strip extends along a first plane and at least a portion of the second elongate strip extends along a second plane, and wherein the first plane and the second plane are substantially parallel.

13. The window assembly of claim 1 wherein the second elongate strip defines 10 apertures per inch or more.

14. The window assembly of claim 1 wherein the undulating shape is triangular.

15. The window assembly of claim 1 wherein the undulating shape is sinusoidal.

16. A window assembly comprising:

a first sheet of a translucent, transparent or semi-transparent material;

a second sheet of a translucent, transparent or semi-transparent material;

an intermediary sheet of a translucent, transparent or semi-transparent material between the first sheet and the second sheet;

a spacer extending from the first sheet to the second sheet, wherein the spacer comprises:

a first metal elongate strip having a first surface and having an undulating shape defining peaks, wherein the peaks extend in a direction that is transverse to a longitudinal direction of the first metal elongate strip;

a second metal elongate strip having a second surface and having an undulating shape, wherein the second surface is spaced from the first surface, and wherein each of the first elongate strip and the second elongate strip has a material thickness in a range from about 0.0001 inches (0.00025 cm) to about 0.01 inches (0.025 cm); and at least one filler arranged between the first and second surfaces, the filler including a desiccant; and wherein a width of the first elongate strip is substantially equal to a width of the second elongate strip;

wherein at least a portion of the first elongate strip extends along a first plane and at least a portion of the second elongate strip extends along a second plane, and wherein the first plane and the second plane are substantially parallel;

a sealant material located between the spacer and the first sheet and between the spacer and the second sheet; and an adhesive connecting the intermediary sheet to the second elongate strip of the spacer.

17. The window assembly of claim 1 where the intermediary sheet is coupled to the surface of the second elongate strip.

18. A window assembly comprising:

a first sheet of a translucent, transparent or semi-transparent material;

a second sheet of a translucent, transparent or semi-transparent material;

an intermediary sheet of a translucent, transparent or semi-transparent material between the first sheet and the second sheet;

a spacer extending from the first sheet to the second sheet, wherein the spacer comprises:

a first metal elongate strip having a first surface and having an undulating shape defining peaks, wherein the peaks extend in a direction that is transverse to a longitudinal direction of the first metal elongate strip;

a second metal elongate strip having a second surface and having an undulating shape, wherein the second surface is spaced from the first surface, and wherein each of the first elongate strip and the second elongate strip has a material thickness in a range from about 0.0001 inches (0.00025 cm) to about 0.01 inches (0.025 cm); and at least one filler arranged between the first and second surfaces, the filler including a desiccant; and a sealant material located between the spacer and the first sheet and between the spacer and the second sheet;

wherein the intermediary sheet is connected to the second elongate strip of the spacer.

19. The window assembly of claim 18 further comprising an adhesive connecting the intermediary sheet to the second elongate strip of the spacer.

20. The window assembly of claim 1 the second elongate strip including a plurality of apertures extending through the second elongate strip.

21. The window assembly of claim 16 the second elongate strip including a plurality of apertures extending through the second elongate strip.

* * * * *